US012180031B2

(12) United States Patent
Hong

(10) Patent No.: US 12,180,031 B2
(45) Date of Patent: Dec. 31, 2024

(54) WINDING APPARATUS AND A METHOD OF WINDING A PRODUCT STRIP ONTO A REEL

(71) Applicant: PRACTICAL SOLUTION PTE LTD, Singapore (SG)

(72) Inventor: Hee Meng Hong, Singapore (SG)

(73) Assignee: PRACTICAL SOLUTION PTE LTD, Singapore (SG)

( * ) Notice: Subject to any disclaimer, the term of this patent is extended or adjusted under 35 U.S.C. 154(b) by 0 days.

(21) Appl. No.: 17/771,785

(22) PCT Filed: Jul. 7, 2020

(86) PCT No.: PCT/SG2020/050386
§ 371 (c)(1),
(2) Date: Apr. 25, 2022

(87) PCT Pub. No.: WO2022/010415
PCT Pub. Date: Jan. 13, 2022

(65) Prior Publication Data

US 2022/0356041 A1 Nov. 10, 2022

(51) Int. Cl.
*B65H 75/38* (2006.01)
*B21D 43/00* (2006.01)
(Continued)

(52) U.S. Cl.
CPC ..... *B65H 75/38* (2013.01); *B21D 43/00* (2013.01); *B65H 19/30* (2013.01); *B65H 23/02* (2013.01); *B65H 2301/414324* (2013.01)

(58) Field of Classification Search
None
See application file for complete search history.

(56) References Cited

U.S. PATENT DOCUMENTS 3,094,295 A 6/1963 Frederick
4,546,931 A * 10/1985 Dawson ..... B29D 5/00 242/413.6
(Continued)

FOREIGN PATENT DOCUMENTS

CN 201597771 U 10/2010
CN 207242199 U 4/2018
(Continued)

OTHER PUBLICATIONS

International Application No. PCT/SG2020/050386 received an International Search Report and Written Opinion mailed Mar. 18, 2021, 11 pages.
(Continued)

*Primary Examiner* — Michael R Mansen
*Assistant Examiner* — Henrix Soto
(74) *Attorney, Agent, or Firm* — Kilpatrick Townsend & Stockton LLP

(57) ABSTRACT

A winding apparatus (200) and a method of winding a product strip onto (202) a reel (204) are provided, the winding apparatus (200) comprises, a feeder module (216) for supplying the product strip to the reel; a first winding module part (218) that is configured to engage the reel, the first winding module part (218) being further configured to move along a first alignment path to align the reel in relation to the feeder module (216) at an operative position for receiving the product strip; wherein first winding module part (218) is configured to align the reel (204) in a horizontal position that is normal to a vertical axis (Y) of the winding apparatus and the reel (204) is rotatable at the operative position about a longitudinal axis passing through the reel; and wherein the feeder module (216) is arranged to convey the product strip (202) for winding onto the reel (204), the
(Continued)

product strip (202) being within a vertical plane normal to the ground.

16 Claims, 21 Drawing Sheets

(51) Int. Cl.
*B65H 19/30* (2006.01)
*B65H 23/02* (2006.01)

(56) References Cited

U.S. PATENT DOCUMENTS

| | | | | | |
|---|---|---|---|---|---|
| 4,927,090 | A * | 5/1990 | Matsumoto | B65H 19/30 414/398 |
| 5,486,081 | A * | 1/1996 | Draghetti | B65H 19/123 414/797 |
| 5,895,009 | A * | 4/1999 | Sato | B21C 47/24 156/158 |
| 8,827,197 | B2 * | 9/2014 | Powers | B32B 37/00 242/412 |
| 2011/0271732 | A1 | 11/2011 | Roese et al. | |
| 2021/0035945 | A1 * | 2/2021 | Heinrich | H01L 24/27 |
| 2022/0289510 | A1 * | 9/2022 | Yang | B65H 19/305 |
| 2023/0416035 | A1 * | 12/2023 | Swann | B65H 18/28 |
| 2024/0140749 | A1 * | 5/2024 | Perini | B65H 67/067 |

FOREIGN PATENT DOCUMENTS

| | | | | | |
|---|---|---|---|---|---|
| CN | 108313798 | A | | 7/2018 | |
| CN | 108773714 | A | | 11/2018 | |
| CN | 109368338 | A | * | 2/2019 | B65H 19/29 |
| CN | 209097853 | U | * | 7/2019 | B65H 19/30 |
| CN | 110116925 | A | | 8/2019 | |
| CN | 209553596 | U | | 10/2019 | |
| CN | 112978487 | B | * | 8/2023 | B65H 54/44 |
| DE | 3009200 | A1 | | 9/1981 | |
| EP | 0604673 | B1 | * | 6/1995 | B65H 19/305 |
| JP | H06298417 | A1 | * | 10/1994 | B65H 19/12 |
| KR | 2012138644 | A | * | 12/2012 | B65H 18/08 |
| TW | 202010686 | A | | 3/2020 | |
| WO | 2019/048154 | A1 | | 3/2019 | |

OTHER PUBLICATIONS

International Application No. PCT/SG2020/050386 received an International Preliminary Report on Patentablitly mailed Dec. 8, 2021, 14 pages.

ROC (Taiwan) Patent Application No. 110123001 received a Search Report mailed Jan. 6, 2022, 6 pages (1 page English translation, 5 pages original document).

* cited by examiner

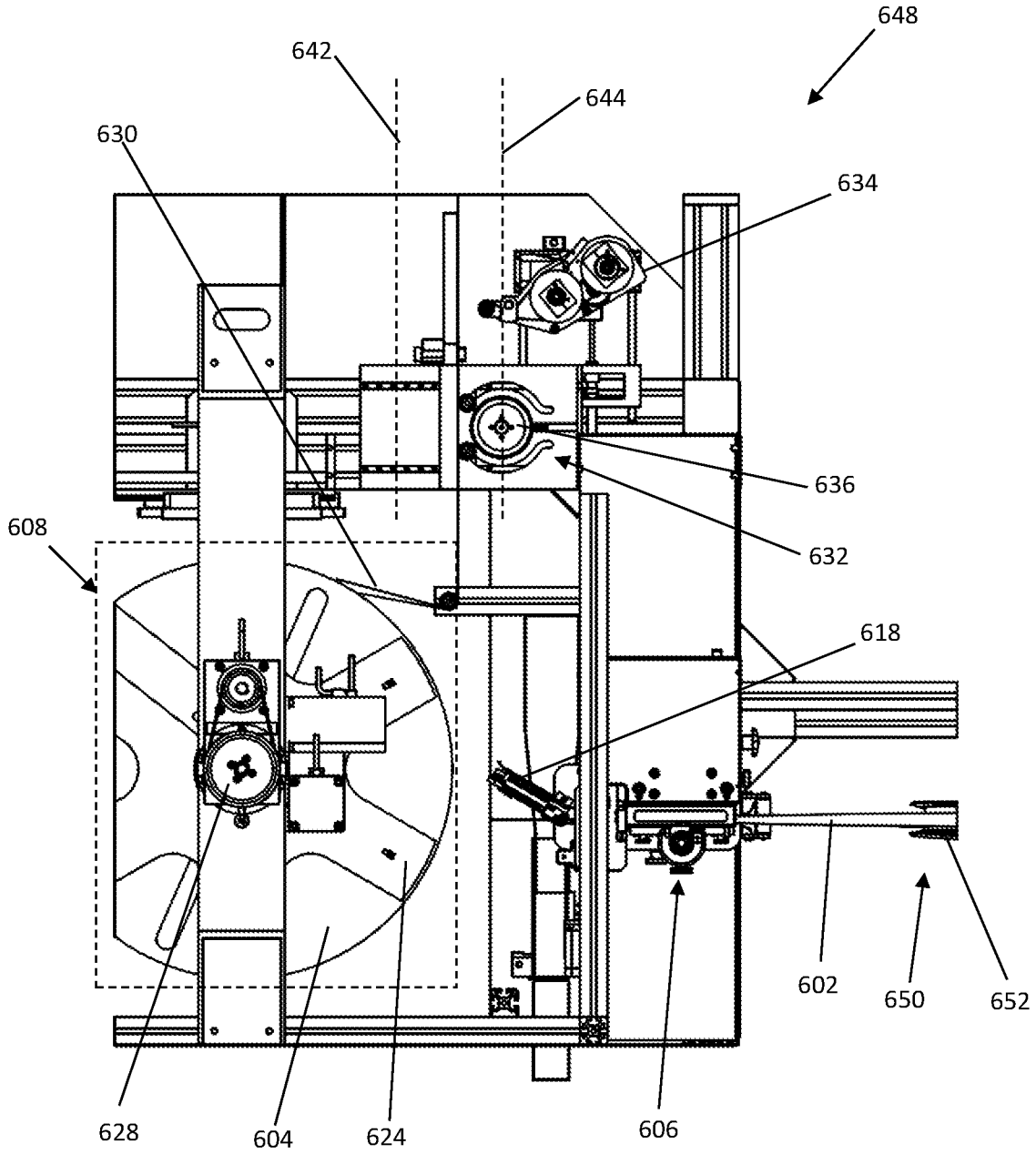
FIG. 6D
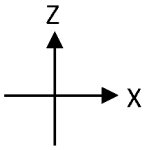

WINDING APPARATUS AND A METHOD OF WINDING A PRODUCT STRIP ONTO A REEL

TECHNICAL FIELD

The present disclosure relates broadly to a winding apparatus and to a method of winding a product strip onto a reel.

BACKGROUND

Products such as connectors, lead frames, electrical contacts are typically manufactured in a stamping line operation using a stamping press machine which is capable of stamping/pressing a strip/strand of material into a desired shape/pattern of the product. Upon manufacture, the strip of stamped products (or "product strip") is typically wound onto a reel or spool for storage, transport and handling purposes.

In general, a reel winding machine is used for winding a product strip onto a reel or spool. Conventionally, reel winding machines adopt a vertical winding configuration wherein a reel is mounted vertically with its longitudinal axis of rotation being substantially parallel to the horizontal axis of the reel winding machine (or parallel to a ground in the ordinary word sense). That is, a reel is held vertically upright while a product strip is wound onto the reel along the circumference of the reel, the reel being within a vertical plane that is normal to the ground. It is recognised that such a vertical winding configuration has limitations in the winding quality of the product strip, e.g. a product strip may come loose upon winding due to the combination of the force of gravity and centrifugal force during rotation. Therefore, significant tensioning is typically required to maintain the product strip onto the reel. Also, in order to fulfil automation in handling of the reel e.g. to successfully transport/transfer fully wound reels for such reel winding machines, relatively complex robotic arms are typically required for handling the reel/spool in the vertical configuration and placement of the product strips. However, apart from imparting complexity due to the use of such robotic arms, such robotic arms are also recognised to occupy a relatively large footprint. This also results in a relatively higher cost of acquisition and maintenance of such machinery.

Thus, there is a need for a winding apparatus and a method of winding a product strip onto a reel that seek to address or alleviate at least one of the above problems.

SUMMARY

In accordance with an aspect of the present disclosure, there is provided a winding apparatus for winding a product strip onto a reel, the winding apparatus comprising, a feeder module for supplying the product strip to the reel; a first winding module part that is configured to engage the reel, the first winding module part being further configured to move along a first alignment path to align the reel in relation to the feeder module at an operative position for receiving the product strip; wherein first winding module part is configured to align the reel in a horizontal position that is normal to a vertical axis of the winding apparatus and the reel is rotatable at the operative position about a longitudinal axis passing through the reel; and wherein the feeder module is arranged to convey the product strip for winding onto the reel, the product strip being within a vertical plane normal to the ground.

The winding apparatus may further comprise, a second winding module part disposed adjacent to the first winding module part, said second winding module part being configured for rotating the reel about the longitudinal axis to facilitate packaging of the reel; a transfer module disposed for movement between the first winding module part and the second winding module part; wherein the transfer module is configured to engage the reel with the reel in its horizontal position, and to move along a transfer path to convey the reel from the first winding module part to the second winding module part; and wherein the second winding module part is configured to move along a second alignment path to engage the reel from the transfer module and to position the reel in relation to one or more end-packaging modules.

The winding apparatus may further comprise, an interleaf module for supplying an interleaf member to the reel such that the interleaf member is capable of being disposed between adjacent layers of the product strip wound onto the reel.

The winding apparatus may further comprise, a swing arm for directing a strip of the interleaf member from an interleaf source to the reel; a tensioning roller for applying tension to the interleaf member, the tensioning roller being configured to translate from a disengaged position to an engaged position such that the tensioning roller is capable of contacting the strip of interleaf member when the interleaf member is disposed between the interleaf source and the reel; wherein the tension applied is controllable by varying a supply of current and/or voltage to an electromagnetic brake that is coupled to the tensioning roller.

The winding apparatus may further comprise, a first compartment disposed in relation to the first winding module part, said first compartment being configured to receive a first container for stacking one or more empty reels; and a first stack lifter disposed in relation to the first winding module part, said first stack lifter being configured for automatically moving a stack of one or more empty reels to provide an empty reel to be engaged by the first winding module part.

The first container may be arranged to be transported on a first autonomous vehicle.

The winding apparatus may further comprise, a second compartment disposed in relation to the second winding module part, said second compartment being configured to receive a second container for stacking one or more filled reels; and a second stack lifter disposed in relation to the second winding module part, said second stack lifter being configured for automatically moving a stack of one or more filled reels to receive a filled reel from the second winding module part.

The second container may be arranged to be transported on a second autonomous vehicle.

The one or more end-packaging modules may comprise, a cross-securing module for securing one or more edge portions of the reel in engagement with the second winding module part, said cross-securing module comprising, a second securing member dispenser for supplying a second securing member; a pair of press rollers disposed such that the second securing member is positioned between the pair of press rollers and the reel, the pair of press rollers being configured to translate along a cross-securing path towards the reel to apply the second securing member over the one or more edge portions of the reel; and wherein the second winding module part is configured to rotate the reel by a pre-programmed angle about the longitudinal axis to facilitate one or more applications of the second securing member over the one or more edge portions of the reel.

In accordance with another aspect of the present disclosure, there is provided a method of winding a product strip onto a reel, the method comprising, supplying the product strip to the reel using a feeder module; engaging the reel using a first winding module part; moving the reel along a first alignment path to align the reel in relation to the feeder module at an operative position for receiving the product strip, the reel also being aligned in a horizontal position that is normal to a vertical axis; conveying the product strip for winding onto the reel using the feeder module, the product strip being within a vertical plane normal to the ground; and rotating the reel at the operative position about a longitudinal axis passing through the reel.

The method may further comprise, engaging the reel in its horizontal position using a transfer module; moving the reel along a transfer path to convey the reel from the first winding module part to a second winding module part disposed adjacent to the first winding module part; moving the second winding module part along a second alignment path to engage the reel from the transfer module; positioning the reel in relation to one or more end-packaging modules; and rotating the reel about the longitudinal axis to facilitate packaging of the reel.

The method may further comprise, supplying an interleaf member to the reel using an interleaf module such that the interleaf member is disposed between adjacent layers of the product strip wound onto the reel.

The step of supplying the interleaf member to the reel using the interleaf module may comprise, directing a strip of the interleaf member from an interleaf source to the reel using a swing arm; translating a tensioning roller from a disengaged position to an engaged position to apply tension to the interleaf member; contacting the strip of interleaf member when the interleaf member is disposed between the interleaf source and the reel; and controlling the tension applied by varying a supply of current and/or voltage to an electromagnetic brake that is coupled to the tensioning roller.

The method may further comprise, receiving a first container for stacking one or more empty reels in a first compartment disposed in relation to the first winding module part; and automatically moving a stack of one or more empty reels using a first stack lifter disposed in relation to the first winding module part to provide an empty reel to be engaged by the first winding module part.

The method may further comprise, transporting the first container on a first autonomous vehicle.

The method may further comprise, receiving a second container for stacking one or more filled reels in a second compartment disposed in relation to the second winding module part; and automatically moving a stack of one or more filled reels using a second stack lifter disposed in relation to the second winding module part to receive a filled reel from the second winding module part.

The method may further comprise, transporting the second container on a second autonomous vehicle.

The step of positioning the reel in relation to one or more end-packaging modules may comprise, securing one or more edge portions of the reel in engagement with the second winding module part using a cross-securing module; supplying a second securing member using a second securing member dispenser; positioning the second securing member between a pair of press rollers and the reel; translating the pair of press rollers along a cross-securing path towards the reel to apply the second securing member over the one or more edge portions of the reel; and rotating the reel using the second winding module part by a pre-programmed angle about the longitudinal axis to facilitate one or more applications of the second securing member over the one or more edge portions of the reel.

BRIEF DESCRIPTION OF THE DRAWINGS

Example embodiments of the invention will be better understood and readily apparent to one of ordinary skill in the art from the following written description, by way of example only, and in conjunction with the drawings, in which:

FIG. 6D is a second schematic top view drawing of the winding apparatus for illustrating the winding operation of the product strip onto the reel in the another example embodiment.

DETAILED DESCRIPTION

Figure 1:
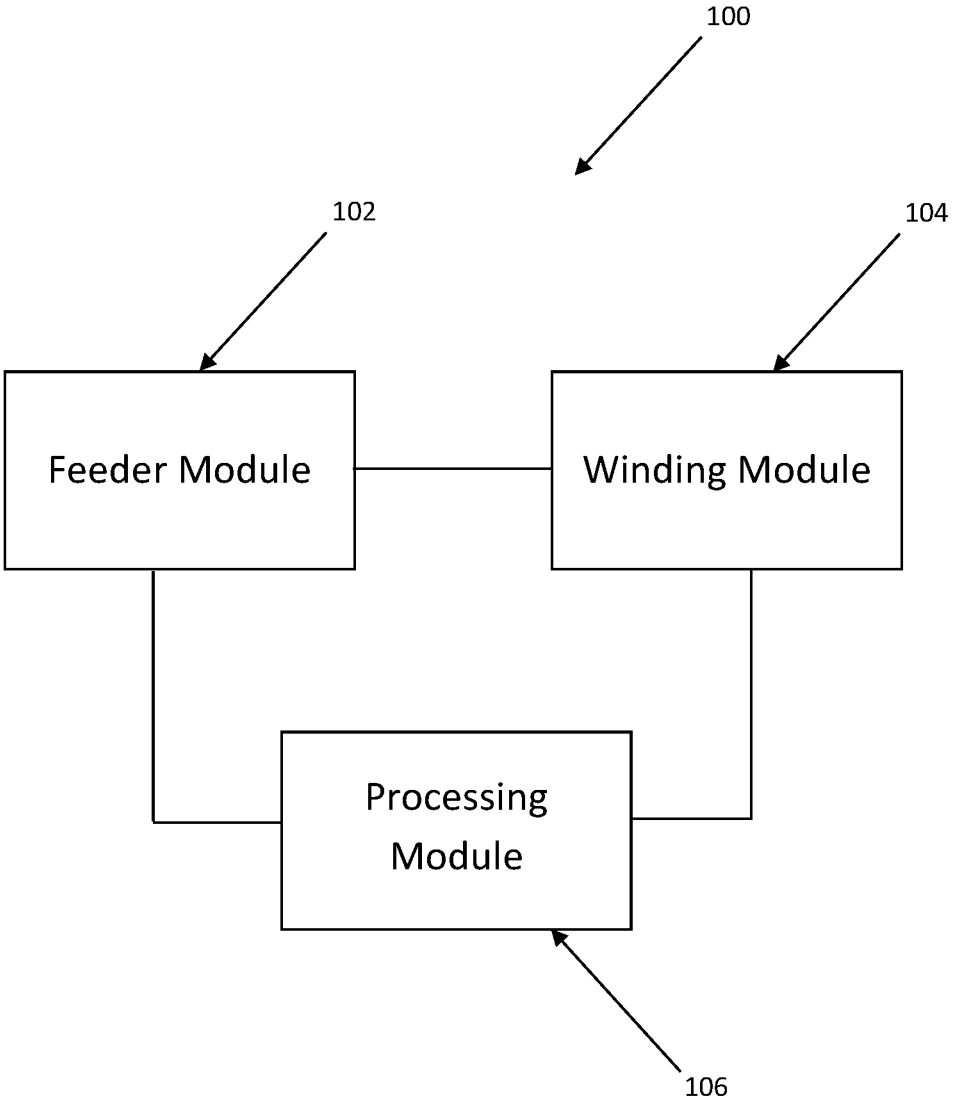
FIG. 1 is a schematic block diagram of a winding apparatus for winding a product strip onto a reel in an example embodiment.

Example, non-limiting embodiments may provide a winding apparatus and a method of winding a product strip onto a reel.

In various example embodiments, the product strip may be in the form of a strip/strand having a plurality of products sequentially coupled thereto, e.g. stamped products such as connectors, lead frames and electrical contacts which are typically manufactured using a stamping press machine on a stamping line operation. The stamped products are typically manufactured from a material (i.e. raw material) which may be a continuous strip of sheet metal. The stamping machine e.g. stamping press machine is a progressive stamping tool which index a strip of material at a designed fixed pitch. The material is progressively cut to shape, leaving a thin sheet of material between the designated pitch, known as a carrier. Typically, the carrier has index holes for driving the material. Material is then progressively bent to shape until a final product is formed. This strip of product (or product strip) is then typically wound into/onto reels. An interleaf member e.g. interleaf paper may also be wound into the reels for separating each layer of product. The product strip may also be in the form of a tray, a tube, or a carrier tape which serves as a packing container for holding/storing separate/distinct products. The carrier tape may have a plurality of pockets, each pocket having a space for holding the product. The pocket containing the product may be sealed by a cover tape and the carrier tape may be wound around the reel. In various example embodiments, the product strip is substantially flexible such that it is capable of being wound onto a reel. The product strip to be wound on each reel may be a single continuous strip or may comprise two or more discontinuous strips. In various embodiments, the product strip has a profile/shape which renders it suitable for winding onto a reel. In one embodiment, the product strip may have a regular profile e.g. rectangular member defined by two opposing top and bottom planar surfaces (i.e. lengthwise) and two opposing lateral-facing side/edge surfaces (i.e. breadthwise). The carrier tape is one example of a product strip with a regular profile, where the products are packed within a plurality of pockets. In another embodiment, the product strip may have a non-regular profile/shape. For example, the product strip may comprise a series of connectors (i.e. having a non-regular profile/shape) attached at spaced intervals along a substrate e.g. a rectangular member having a regular profile, which renders it suitable for winding onto a reel. In various embodiments, during winding operations, the product strip is orientated such that the top and bottom planar surfaces of the rectangular member are substantially parallel to a vertical plane (compare X-Y or Y-Z plane) of the winding apparatus. That is, the product strip is orientated vertically. In this orientation, one of the lateral-facing edges of the product strip may be resting on a horizontal surface.

In various example embodiments, the reel or spool is used for storing and dispensing a product strip e.g. a plurality of stamped products which is capable of being wound over the reel. The reel or spool may comprise a cylindrical tube/hub/core with flanges extending from both ends of the hub. Each flange has an inside and an outside surface. The hub has a longitudinal/cylindrical axis passing through the centre of the hub and the longitudinal axis is substantially perpendicular to the surfaces defined by the flanges. In some embodiments, the flanges of the reel may be attached to the cylindrical tube/hub of the reel via fasteners e.g. screws, or adhesives e.g. glue. In other embodiments, the flanges and the cylindrical tube/hub of the reel may be formed from the same base material to comprise a singular body (i.e. the flanges and hub are not separate components that are attached together to form the reel). The reel is capable of rotating or being rotated about the longitudinal axis. To facilitate storage of different kinds of product strip, the dimensions of the reel may be customised e.g. height of the hub, diameter of the flanges, ratio of the height of the hub to the diameter of the flanges etc. In various embodiments, the reel(s) to be filled with the product strip may be termed "production reel(s)".

In various embodiments, reels or rolls that are holding accompanying materials, e.g. interleaf member, first securing member and second securing member, for the process of producing production reels may be distinguished by their names, e.g. "interleaf member roll", "first securing member roll", "second securing member roll" etc. Such rolls may comprise a cylindrical tube for allowing materials e.g. interleaf member, first securing member and second securing member to be wound thereon and dispensed therefrom.

In various embodiments, unless stated otherwise, the terms "vertical" and "horizontal" are used with reference to a winding apparatus being placed in a position that is ready for its normal operations, e.g. substantially upright on a horizontal surface (e.g. a ground). For example, for a winding apparatus placed upright on a horizontal surface, a vertical axis may pass from the horizontal surface vertically upwards through the winding apparatus. A horizontal axis may be normal/perpendicular to the vertical axis, i.e. a horizontal axis may be parallel to the horizontal surface and passing horizontally through the winding apparatus. In various embodiments, the axes of the winding apparatus are the X, Y and Z axes, and those axes are defined as follows: X-axis is the horizontal axis; Y-axis is the vertical axis; and Z-axis is orthogonal to the X-axis and Y-axis. In various embodiments, these axes are also used to define planes discussed herein. For example, X-Y and Y-Z planes are vertical planes that are normal to a horizontal surface e.g. the ground; and a X-Z plane is a horizontal plane that is parallel to a horizontal surface e.g. the ground and perpendicular to the X-Y and Y-Z planes. For example, when the winding apparatus is viewed from a cross-sectional view showing two winding module parts as disclosed herein, the X-axis may extend horizontally to the left and right, the Y-axis may extend vertically upwards and downwards, and the Z-axis may extend horizontally into and out of the paper.

In various embodiments, unless stated otherwise, the term "longitudinal axis" refers to a cylindrical axis passing through the centre of a cylinder-shaped body in a longitudinal direction. One example of a cylinder-shaped body may be a reel (e.g. production reel, interleaf member roll etc.) having a cylinder-shaped hub/stem, such that the longitudinal axis refers to the cylindrical axis passing through the centre of the hub. Another example of a cylinder-shaped body may be roller units of components such as an accumulator unit as disclosed herein or a securing member dispenser e.g. tape dispenser as disclosed herein.

FIG. 1 is a schematic block diagram of a winding apparatus 100 for winding a product strip onto a reel in an example embodiment. The winding apparatus 100 comprises a feeder module 102, a reel winding module 104 coupled to the feeder module 102, and a processing module 106 coupled to the feeder module 102 and the winding module 104 for controlling and monitoring the processes of winding the product strip onto the reel.

The feeder module 102 functions to supply the product strip to the reel, e.g. to be wound onto the reel. The feeder module 102 is arranged to, for example but not limited to, receive the product strip directly or indirectly from an external machine e.g. stamping press machine that is manufacturing the product strip, holding and directing a first starting portion of the product strip to the reel, cutting a second ending portion of the product strip etc. Additional processes may be implemented in the feeder module depending on the needs of a user.

The winding module 104 functions to rotate the reel about its longitudinal axis to wind the product strip onto the reel. In the example embodiment, the longitudinal axis of the reel is substantially parallel to the vertical axis of the winding apparatus 100 (or vertical to a ground in the ordinary word sense). That is, the reel is positioned in a horizontal position normal to the vertical axis of the winding apparatus while a product strip is wound onto the reel along the circumference of the reel, the reel being rotated within a horizontal plane (compare X-Z plane) parallel to the ground. The winding module 104 is configured to move along a first alignment path to engage the reel. For example, the winding module 104 may move linearly along a substantially vertical path to a pick-up position where the winding module 104 is arranged to engage (e.g. pick up) an empty reel by engaging (e.g. gripping) a top flange of the reel. The winding module 104 is further configured to move along the first alignment path to align the reel in relation to the feeder module at an operative position. For example, the winding module 104 may move along the substantially vertical path to the operative position where the engaged empty reel is aligned with the feeder module 102 for receiving the product strip. At the operative position, the feeder module 102 is arranged to convey/transmit the product strip for winding onto the reel. For example, the feeder module 102 may convey the product strip such that the product strip is within a vertical plane (compare X-Y plane) normal to the ground and may be wound onto a reel that is positioned in a horizontal position.

The winding module 104 may further be configured to position the reel in relation to one or more end-packaging modules for end-packaging (e.g. cross-securing and labelling) of the reel. The winding module 104 may also be configured to perform changing of reels, e.g. by replacing a filled reel with an empty reel. The winding module 104 may comprise a single winding module; or may comprise two or more winding module parts for performing the various functions e.g. winding of the product strip, switching of reels, end-packaging such as cross-securing and labelling etc.

The processing module 106 functions to instruct and coordinate feeding parameters of the feeder module 102 and rotation parameters of the winding module 104. For example, the feeder module 102 may be configured to stop feeding the product strip when the winding module 104 is not at the operative position e.g. when the winding module 104 is picking up an empty reel from the pick-up position. The feeder module 102 may be configured to feed the product strip when the winding module 104 is at the operative position with the empty reel engaged (e.g. gripped) in position. The processing module 106 may coordinate the feed rate of the feeder module 102 and the rotation speed of the winding module 104 such that the feed rate and rotation speed are substantially synchronised. The processing module 106 may further comprise control of other process parameters and workflow of the winding apparatus 100.

Figure 2A:
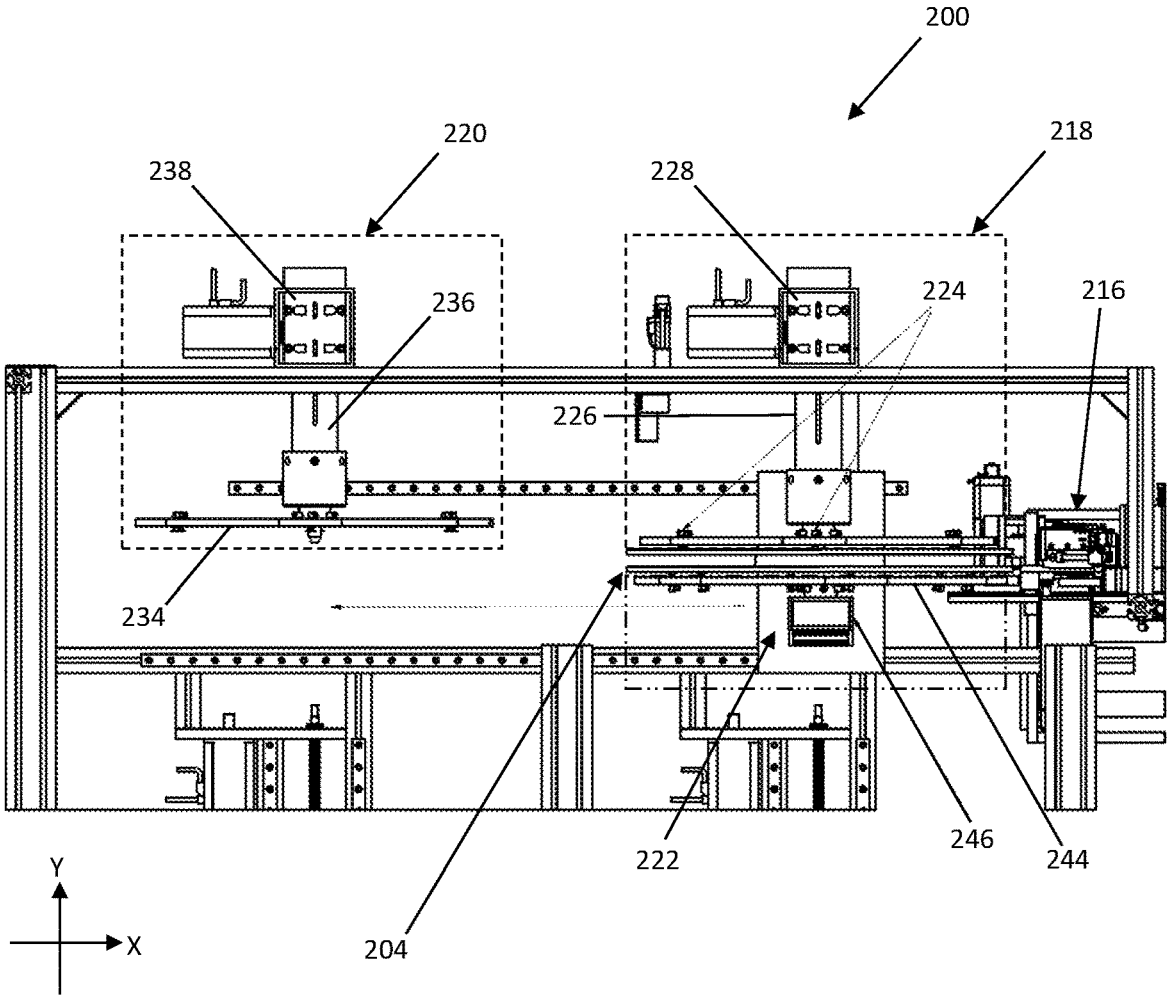
FIG. 2A is a first schematic cross-sectional view drawing of a winding apparatus for winding a product strip onto a reel in an example embodiment.
Figure 2B:
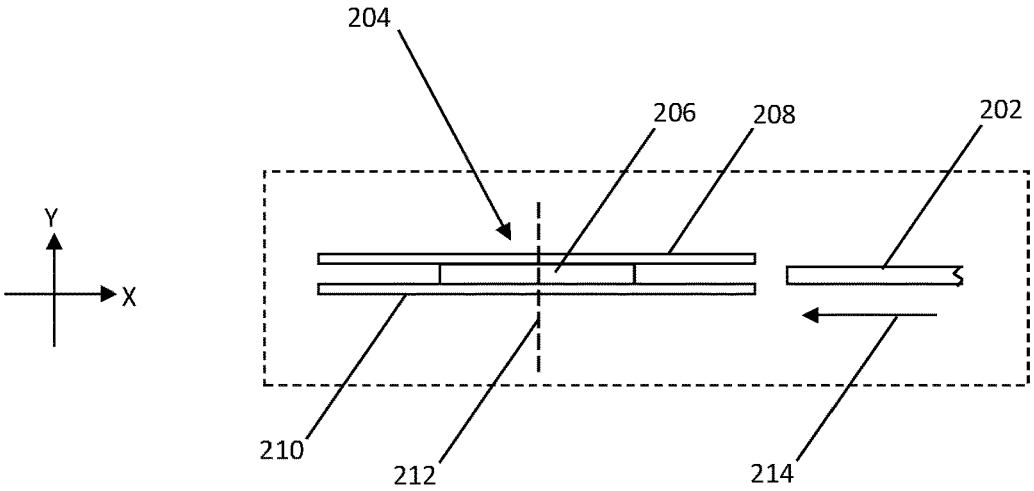
FIG. 2B is a magnified schematic cross-sectional view drawing of the product strip and the reel in the example embodiment.
Figure 2C:
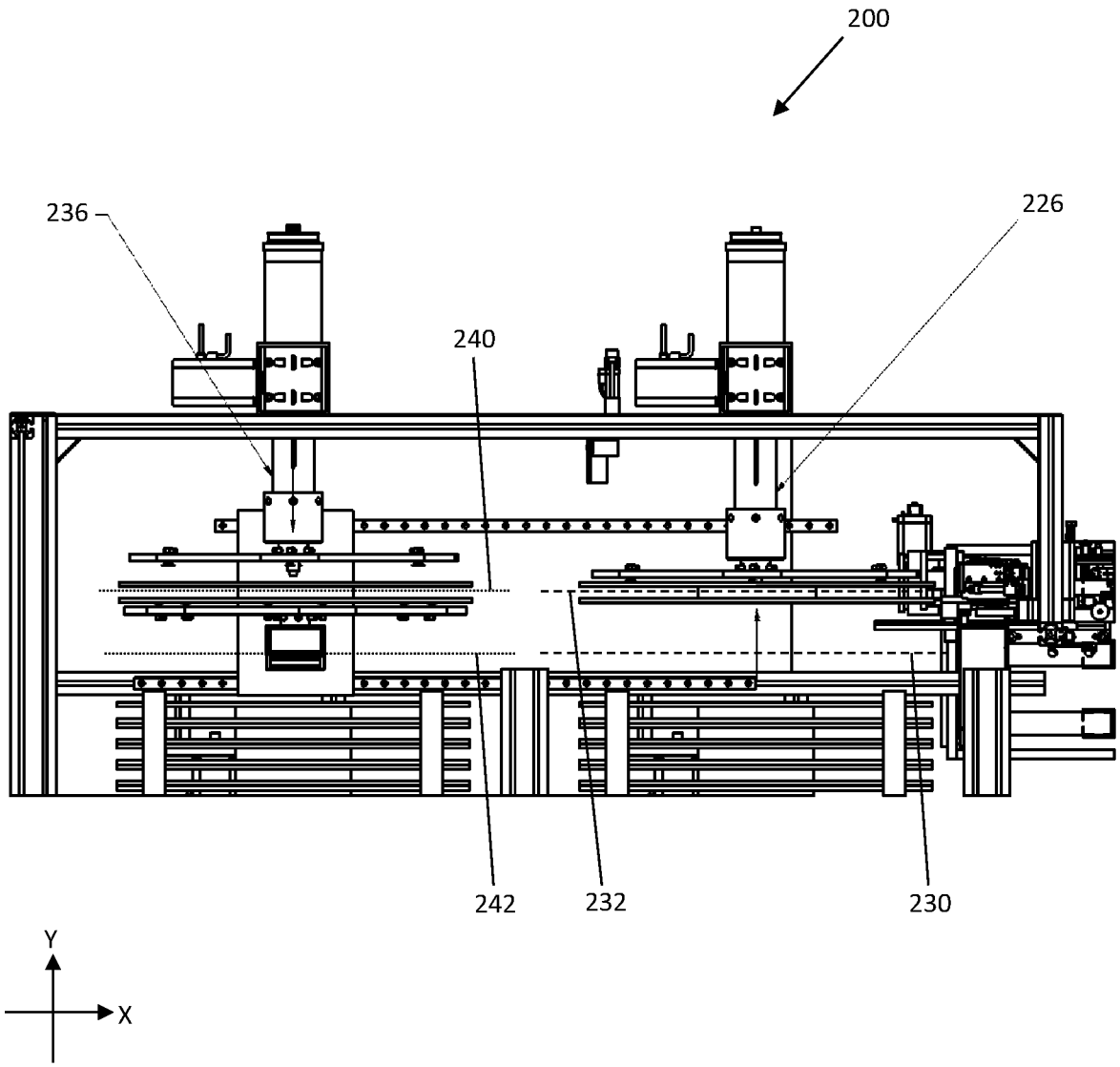
FIG. 2C is a second schematic cross-sectional view drawing of the winding apparatus for winding the product strip onto the reel in the example embodiment.

FIG. 2A is a first schematic cross-sectional view drawing of a winding apparatus 200 for winding a product strip 202 onto a reel 204 in an example embodiment. FIG. 2B is a magnified schematic cross-sectional view drawing of the product strip 202 and the reel 204 in the example embodiment. FIG. 2C is a second schematic cross-sectional view drawing of the winding apparatus 200 for winding the product strip 202 onto the reel 204 in the example embodiment.

With reference to FIG. 2B, the reel 204 comprises a substantially cylindrical hub/stem/tube 206 with a top flange 208 and a bottom flange 210 disposed at both ends of the hub 206. In the example embodiment, the reel 204 is arranged to be positioned in the winding apparatus 200 such that the longitudinal axis 212 of the reel 204 is substantially parallel to a vertical axis (compare Y-axis) of the winding apparatus 200. That is, the top flange 208 and bottom flange 210 of the reel 204 are substantially parallel to the horizontal plane (compare X-Z plane) of the winding apparatus 200. In order to wind the product strip 202 onto the hub 206 in this orientation, the product strip 202 is orientated such that its planar surfaces are substantially parallel to the vertical plane (compare X-Y plane) of the winding apparatus 200. The product strip 202 is arranged to be conveyed along a substantially horizontal path 214 to the hub 206 for winding onto the reel 204. The horizontal path 214 is substantially parallel to a horizontal axis (compare X-axis) of the winding apparatus 200. During a winding operation, the product strip 202 may be arranged such that one of its lateral-facing edges is resting on an inner surface of the bottom flange 210 by virtue of gravity. It will be appreciated that the reel 204 is known in the art as a means for storing and dispensing a product strip. The winding apparatus 200 is capable of being adapted/customised to receive reels of different dimensions for winding various kinds of product strips.

Winding of the product strip 202 in a horizontal orientation as shown in FIG. 2A may advantageously improve the winding quality because during winding, the product strip 202 is resting on an inner surface of the bottom flange 210 due to gravity and this results in an improved alignment of the product strip 202 that is being wound onto the reel 204. This is to be contrasted with a conventional vertical winding configuration where a reel is positioned vertically with its flanges substantially parallel to a vertical plane (e.g. X-Y or Y-Z plane). In a vertical winding configuration, the product strip may shift horizontally along the hub of the reel during winding, leading to misalignment between different layers of product strip wound and an inferior winding quality. Significant tensioning is typically required for a vertical winding configuration to keep the product strip properly aligned onto the reel. There is a likelihood of applying excessive tension for such vertical winding configuration. Excess tension may result in deformation of the product strip, especially in cases where products that are delivered from an external machine e.g. a stamping press machine are stamped on relatively thin sheets of raw material (e.g. about 0.08 mm thickness) and require delicate handling.

In the example embodiment, the winding apparatus 200 comprises a feeder module e.g. a feeder head 216, a first winding module part 218 e.g. a top winding head 218 disposed adjacent to the feeder head 216, a second winding module part 220 e.g. a filled reel pick-up head 220 disposed adjacent to, and in a linear disposition from, the first winding module part 218, and a transfer module 222 e.g. bottom transfer arm 222 disposed for movement between the first winding module part 218 and the second winding module part 220.

The first winding module part 218 e.g. the top winding head 218 comprises a first end-effector/holder 224 for engaging/grasping/gripping/holding the reel 204, a first actuator 226 for moving the first end-effector 224 along a first alignment path e.g. a substantially vertical path (compare Y-axis), and a first motor 228 for rotating the first end-effector 224. The first motor 228 may be a stepper motor, a DC motor, an AC motor, a servo motor, or the like. In the example embodiment, the first end-effector 224 functions to engage/grasp/grip/hold the reel 204. For example, the engagement is by using vacuum suction cap(s) to apply vacuum suction on an outside surface of the top flange 208 of the reel 204.

The first actuator 226 functions to move the first end-effector 224 linearly along the substantially vertical path to various stations/positions disposed along the substantially vertical path. For example, the first actuator 226 is configured to move the first end-effector 224 to an empty reel pick-up position 230 for retrieving/picking up an empty reel (i.e. reel 204 with no product strip 202 wound thereon). The first actuator 226 is further configured to move the first end-effector 224 e.g. first end-effector 224 which is holding onto the empty reel 204 to an operative position 232 such that the hub 206 of the reel 204 is aligned with the feeder module 216 for receiving the product strip 202.

With the first end-effector 224 holding the reel 204 at the operative position 232, the first motor 228 functions to rotate the first end effector 224 such that the product strip 202 is capable of being wound onto the reel 204 as the first end-effector 224 rotates. The first motor 228 is configured to rotate the first end-effector 224 about the vertical axis (compare Y-axis) of the winding apparatus 200. That is, the reel 204 is rotatable in a horizontal plane (i.e. parallel to X-axis). As shown in the magnified drawing of the reel 204, the longitudinal axis 212 of the reel 204 is substantially parallel to the vertical axis (i.e. Y-axis) of the winding apparatus 200.

The transfer module 222 e.g. the bottom transfer arm 222 comprises a third end-effector/holder 244 for engaging/grasping/gripping/holding the reel 204, and a third actuator 246 for moving the third end-effector 244 along a transfer path e.g. a substantially horizontal path (compare X-axis) between a position e.g. that is directly below the top winding head 218 and another position e.g. that is directly below the filled reel pick-up head 220. Thus, the bottom transfer arm 222 may facilitate a linear translation of a reel e.g. 204 in a horizontal disposition, i.e. without a change from the position during rotation at the operative position 232, in a horizontal plane (compare X-axis) between the top winding head 218 and the filled reel pick-up head 220. The third end-effector 244 functions to engage/grasp/grip/hold the reel 204. For example, the engagement is by using vacuum suction cap(s) to apply vacuum suction on an outside surface of the bottom flange 210 of the reel 204.

In some example embodiments, the bottom transfer arm 222 may be disposed such that the third end-effector 244 is abutting the bottom flange 210 of the reel 204 which is engaged at the operative position 232. In other example embodiments, the bottom transfer arm 222 may be disposed such that the third end-effector 244 is spaced apart from the bottom flange 210 of the reel 204 which is engaged at the operative position 232. In such other example embodiments, the third actuator 246 may be further configured to move along the first alignment path to engage the bottom flange 210 of the reel 204.

In some example embodiments, the third end-effector 244 may be engaging/gripping the bottom flange 210 at the operative position 232 after a winding operation. In other example embodiments, the third end-effector 244 may be engaging/gripping the bottom flange 210 during a winding operation at the operative position 232.

The second winding module part 220 e.g. the filled reel pick-up head 220 comprises a second end-effector/holder 234 for engaging/grasping/gripping/holding the reel 204, a second actuator 236 for moving the second end-effector 234 along a second alignment path e.g. a substantially vertical path (compare Y-axis), and a second motor 238 for rotating the second end-effector 234. The second motor 238 may be a stepper motor, a DC motor, an AC motor, a servo motor, or the like. In the example embodiment, the second end-effector 234 functions to engage/grasp/grip/hold the reel 204. For example, the engagement is by using vacuum suction cap(s) to apply vacuum suction on an outside surface of the top flange 208 of the reel 204.

The second actuator 236 functions to move the second end-effector 234 linearly along the substantially vertical path to various stations/positions disposed along the substantially vertical path. For example, the second actuator 236 is configured to move the second end-effector 234 to a filled reel pick-up position 240 for retrieving/picking up a filled reel (i.e. reel 204 with the product strip 202 fully wound thereon) from the transfer module 222. The second actuator 236 is further configured to move the second end-effector 234 to a cross-securing e.g. cross-taping position (not shown) for applying tape at one or more edge portions of the filled reel 204. The second actuator 236 is further configured to move the second end-effector 234 to a drop-off position 242 for depositing/placing/dropping off the filled reel 204.

With the second end-effector 234 holding the reel 204 at the cross-taping position, the second motor 238 functions to rotate the second end effector 234 such that taping can be applied to one or more edge portions of the filled reel 204. The second motor 238 is configured to rotate the second end effector 234 by a pre-programmed angle after cross-taping is applied on a first edge portion of the filled reel 204 such that at least a second or other subsequent edge portions of the filled reel 204 is made accessible for cross-taping to be applied thereon.

In the example embodiment, the bottom transfer arm 222 functions to transfer a filled reel 204 from the top winding head 218 to the filled reel pick up head 220. The filled reel pick-up head 220 functions to pick up the filled reel 204 from the bottom transfer arm 222 and to rotate the filled reel for cross-securing e.g. cross taping.

In the example embodiment, the winding apparatus 200 further comprises compartments provided below the top winding head 218 and the filled reel pick-up head 220, for holding one or more reels e.g. 204 in a stacked manner. As shown in FIG. 2C, a plurality of empty reels e.g. 204 is stacked below the top winding head 218 and is accessible to the first end effector 224 of the top winding head 218 as it moves downwards to the empty reel pick-up position 230. Such empty reels e.g. 204 are shown arbitrarily on the right-hand side of the drawing. Similarly, a plurality of filled reels e.g. 204 is stacked below the filled reel pick-up head 220 and is accessible to the second end effector 234 of the filled reel pick-up head 220 as it moves downwards to place/drop off the filled reel 204 at the filled reel drop-off position 242. Such filled reels e.g. 204 are shown arbitrarily on the left-hand side of the drawing. It will be appreciated that there is a maximum number of empty reels e.g. 204 which can be stacked in the compartment below the top winding head 218 and a maximum number of filled reels e.g. 204 which can be stacked in the compartment below the filled reel pick-up head 220, such that the empty and filled reels e.g. 204 stacked thereon do not obstruct movement of the third end-effector 244 of the bottom transfer arm 222 along the transfer path.

It will be appreciated that the operation of the winding apparatus 200 may be controlled by a processing module (compare 106 of FIG. 1). It will also be appreciated that engagement/holding of the reel 204 using the end effectors 224, 234, 244 are not limited to pneumatic means such as using vacuum suction, and may additionally or alternatively comprise, but not limited to, mechanical components (e.g. claws, robotic fingers, connectors for engaging or gripping or coupling or mating to components/receptacle(s) disposed on the reel 204), magnetic components, or electric components for engaging or grasping the reel. Each end effector may comprise a single member (e.g. one suction cup arranged to engage a central portion of a reel flange e.g. 208) or two or more members (e.g. a plurality of suction cups arranged to engage multiple portions of a reel flange e.g. 208).

It will also be appreciated that the product strip 202 may be wound together with an interleaf member. The interleaf member may be a strip of paper which functions as a separator between adjacent layers of the product strip 202 wound onto the reel 204. It will also be appreciated that securing members such as adhesive taping may be used to anchor/secure a first starting portion of the interleaf member onto the reel 204 (at the start of winding onto an empty reel), as well as used to secure a second ending portion of the interleaf member to prevent the wound product strip 202 and/or interleaf member from unravelling/loosening from the reel 204 (at the end of winding onto a filled reel).

In use, during a winding operation of the product strip 202, the first end-effector 224 of the first winding module part 218 translates downwards to the empty reel pick-up position 230 and applies vacuum suction to engage/grip an empty reel 204 via the top flange 208 of the reel 204. The first end-effector 224 engaging/gripping the empty reel 204 translates upwards to the operative position 232 such that the hub 206 of the reel 204 is aligned with the feeder module 216 to receive a starting portion of the product strip 202.

Prior to winding the reel 204, a starting portion of the interleaf member may be secured on the hub 206. The starting portion of the interleaf member may be secured to the hub 206 using e.g. an adhesive such as a double-sided tape. In one example, the starting portion of the interleaf member may be wound together with the starting portion of the product strip 202, such that the interleaf member and the product strip 202 are wound together onto the reel 204. In another example, the interleaf member may be wound a number of rounds (e.g. five rounds) onto the reel prior to introduction of the product strip 202 to be wound with the interleaf member onto the reel. The starting portions of the interleaf member and product strip 202 may be respectively applied as the first effector 224 initiates rotation of the reel 204. The rotation speed imparted by the first end-effector 224 to the reel 204 may gradually increase and subsequently maintained at a substantially constant level to wind the product strip 202 onto the reel 204. During a winding operation, the product strip 202 and the interleaf member may be arranged such that one of the lateral-facing edges of the product strip 202 and the interleaf member are resting on an inner surface of the bottom flange 210 by virtue of gravity. That is, the product strip 202 and the interleaf member may be arranged to be in a vertical position lengthwise for winding onto a reel that is in a horizontal position. The rotation speed imparted by the first end-effector 224 to the reel 204 may subsequently gradually decrease and rotation is stopped when the reel 204 is filled with the product strip 202, i.e. winding of the reel 204 is completed.

After winding of the reel 204 by the first winding module part 218 is completed, the third end-effector 244 of the bottom transfer arm 222 applies vacuum suction to engage/grip the filled reel 204 via the bottom flange 210 of the reel 204. The first end-effector 224 of the first winding module part 218 releases its engagement/grip on the top flange 208 of the filled reel 204. The first actuator 226 of the first winding module part 218 moves the first end-effector 224 away from the top flange 208 e.g. upwards by an exemplary displacement of from about 5 mm to about 50 mm, such that the first end-effector 224 is not contacting the reel 204, thereby facilitating transfer of the filled reel 204 by the bottom transfer arm 222. The bottom transfer arm 222 transfers the filled reel 204 which is being engaged/gripped by the third end-effector 244 of the bottom transfer arm 222 in a linear horizontal translation (i.e. compare along the X-axis) to be positioned directly under the filled reel pick-up head 220.

As the bottom transfer arm 222 is transferring the filled reel 204 to the filled reel pick-up head 220, the first end-effector 224 of the top winding head 218 translates downwards to the empty reel pick-up position 230 and applies vacuum suction to engage/grip a next empty reel 204 for winding.

After the third end-effector 244 of the bottom transfer arm 222 that is engaging/gripping the filled reel 204 via its bottom flange 210 is positioned directly under the filled reel pick-up head 220, the second end-effector 234 of the second winding module part 220 proceeds to translate downwards to the filled reel pick-up position 240 to engage/grip the filled reel 204 via the top flange 208 of the filled reel 204. After the filled reel 204 is being engaged/gripped by the second end-effector 234, the third end-effector 244 of the bottom transfer arm 222 proceeds to release the engagement/grip on the bottom flange 210 of the filled reel 204. The third end-effector 244 of the bottom transfer arm 222 then returns to the position directly under the top winding head 218, i.e. in position to engage the bottom flange 210 of the next filled reel 204 which is being engaged/gripped by the first end-effector 224 of the first winding module part 218.

The second end-effector 234 of the second winding module part 220 that is engaging/gripping the filled reel 204 translates upwards to position the filled reel 204 in relation to the one or more end-packaging modules. For example, the filled reel 204 may be positioned at the cross-taping position for cross-taping of one or more edge portions of the flanges 208, 210. At the cross-taping position, labels showing product information may also be applied to the filled reel 204 e.g. on a surface of the top flange 208. After cross-taping is performed, the second end-effector 234 of the second winding module part 220 that is engaging/gripping the filled reel 204 translates downwards to the drop-off position 242 to deposit/place/drop off the filled reel 204.

It will be appreciated that a number of variations from the above example embodiments is possible. For example, in other example embodiments, the first end-effector 224 of the first winding module part 218 may engage the top flange 208 and the third end-effector 244 of the bottom transfer arm 222 may engage the bottom flange 210 of the reel 204 prior to rotation of the reel 204. For example, the engagement of the top flange 208 with the first end-effector 224 of the first winding module part 218 and the engagement of the bottom flange 210 with the third end-effector 244 of the bottom transfer arm 222 may occur simultaneously, e.g. by applying vacuum suction. The first end-effector 224 and the third end-effector 244 may rotate in a synchronised manner to wind the product strip 202 onto the reel 204.

Engagement of both the top flange 208 and bottom flange 210 simultaneously may help to ensure smoother conveying of the product strip 202 along the substantially horizontal path 214 to the hub 206 for winding onto the reel 204. In addition, engagement of the third end-effector 244 of the bottom transfer arm 222 to the bottom flange 210 of the reel 204 may provide additional support for the weight of the reel 204 as the product strip 202 is being wound onto the reel 204. For example, a reel e.g. 204 which is fully wound with the product strip 202 may weigh as much as about 15 kg. Engagement of the third end-effector 244 of the bottom transfer arm 222 to the bottom flange 210 of the reel 204 may also provide additional support in cases where the reel 204 is of an inferior quality. For example, the reel 204 may be of the type where the top flange 208 and bottom flange 210 are not firmly glued to the hub 206. As such, during winding, the weight of the wound product strip 202 on the bottom flange 210 of the inferior quality reel e.g. 204 may cause the bottom flange 210 to break off from the hub 206.

In such other example embodiments, the third end-effector 244 of the bottom transfer arm 222 may be passive rotatable, i.e. merely following the rotation of the reel 204 by the first winding module part 218. In such other example embodiments, after winding of the reel 204 is completed, the first end-effector 224 of the first winding module part 218 releases its engagement/grip on the top flange 208 of the filled reel 204 while the third end-effector 244 of the bottom transfer arm 222 maintains its engagement/grip on the bottom flange 210 of the filled reel 204 to transfer the filled reel 204 in a linear horizontal translation (i.e. compare along the X-axis) to be positioned directly under the filled reel pick-up head 220. The first actuator 226 of the first winding module part 218 moves the first end-effector 224 away from the top flange 208 e.g. upwards by an exemplary displacement of from about 5 mm to about 50 mm, such that the first end-effector 218 is not contacting the reel 204, thereby facilitating transfer of the filled reel 204 to the second winding module part 220 by the bottom transfer arm 222.

As another example, in other example embodiments, the second end-effector 234 of the second winding module part 220 may engage the top flange 208 and the third end-effector 244 of the bottom transfer arm 222 may engage the bottom flange 210 of the reel 204 at the same time, for end-packaging e.g. cross securing, labelling etc. Engagement of the third end-effector 244 of the bottom transfer arm 222 to the bottom flange 210 of the reel 204 may provide additional support for the weight of the reel 204 during end-packaging. In such other example embodiments, the one or more end-packaging modules may be positioned in relation to (e.g. aligned to) the filled reel pick-up position 240 such that second end-effector 234 of the second winding module part 220 that is engaging/gripping the filled reel 204 does not have to translate upwards to position the filled reel 204 in relation to the one or more end-packaging modules. In such other example embodiments, the third end-effector 244 of the bottom transfer arm 222 proceeds to release the engagement/grip on the bottom flange 210 of the filled reel 204 after end-packaging is completed. The third end-effector 244 of the bottom transfer arm 222 returns to the position in relation to the first winding module part 218, for example, to engage the bottom flange 210 of a next empty reel 204 which is being engaged/gripped by the first end-effector 224 of the first winding module part 218, to wind the product strip 202 onto the next empty reel 204.

In the example embodiment, the winding apparatus/machine 200 is therefore a high-capacity automatic horizontal reel winder which allows continuous reeling/winding of a product strip e.g. stamped products such as connectors from a stamping press machine together with an interleaf member e.g. interleaf paper. The winding apparatus 200 may provide a pick and place concept whereby the first winding module part 218 is configured to move linearly downwards (compare Y-axis) to pick an empty reel 204 and to move linearly upwards (compare Y-axis) to position the empty reel 204 in an operative winding position for winding. The winding apparatus 200 further provides a linear transfer concept for changing of reels e.g. 204. Filled reels e.g. 204 are transferred horizontally (compare X-axis) from the first winding module part 218 to the adjacent second winding module part 220 for end-packaging (e.g. cross-taping and labelling) at one or more end-packaging modules, so that the first winding module part 218 can proceed to wind the next reel 204 while the second winding module part 220 is performing end-packaging at the one or more end-packaging modules. Advantageously, this configuration of parallel processing increases the throughput and efficiency of the winding apparatus 200.

Figure 3A:
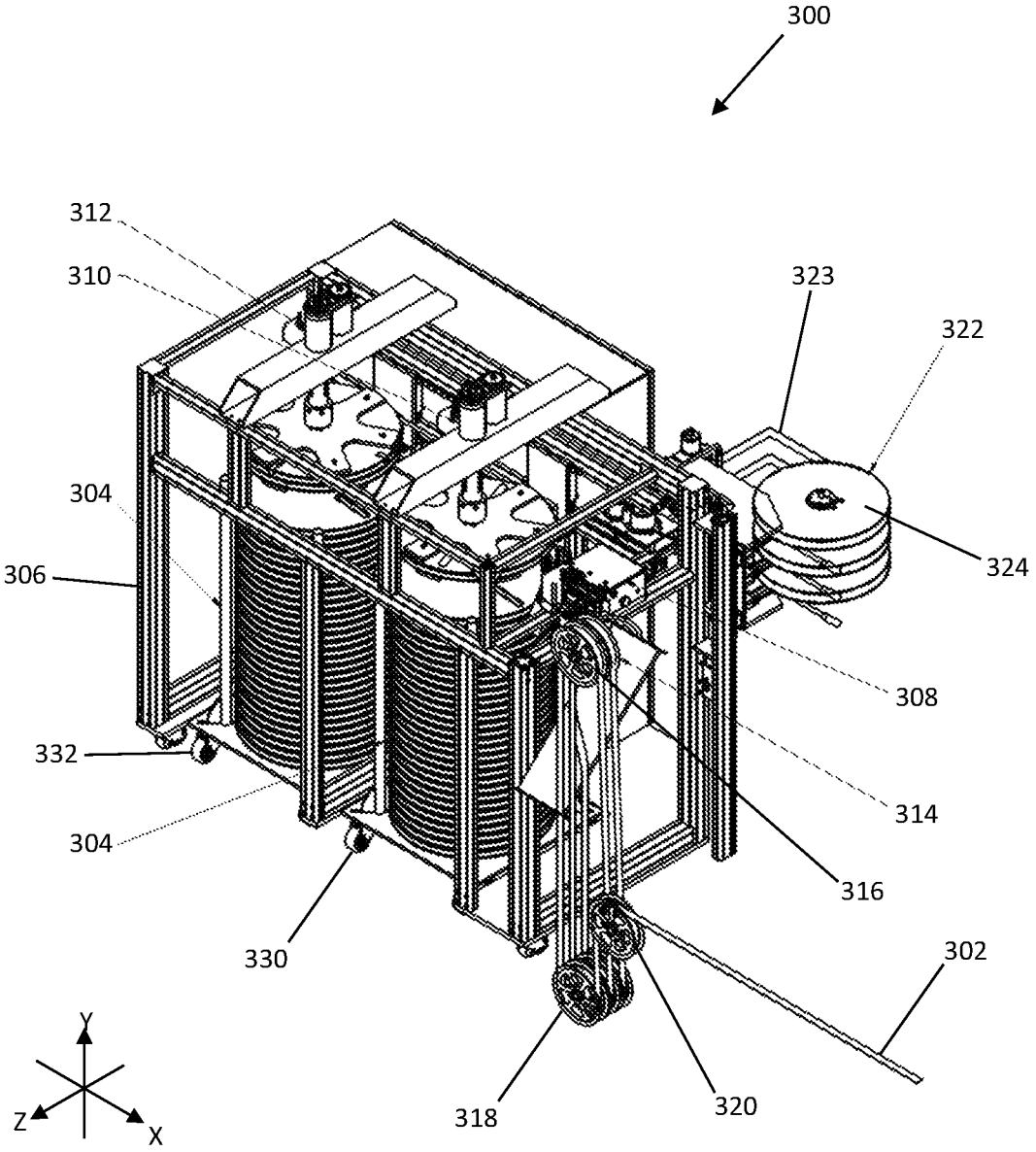
FIG. 3A is a first schematic perspective view drawing of a winding apparatus for winding a product strip onto a reel in an example embodiment.
Figure 3B:
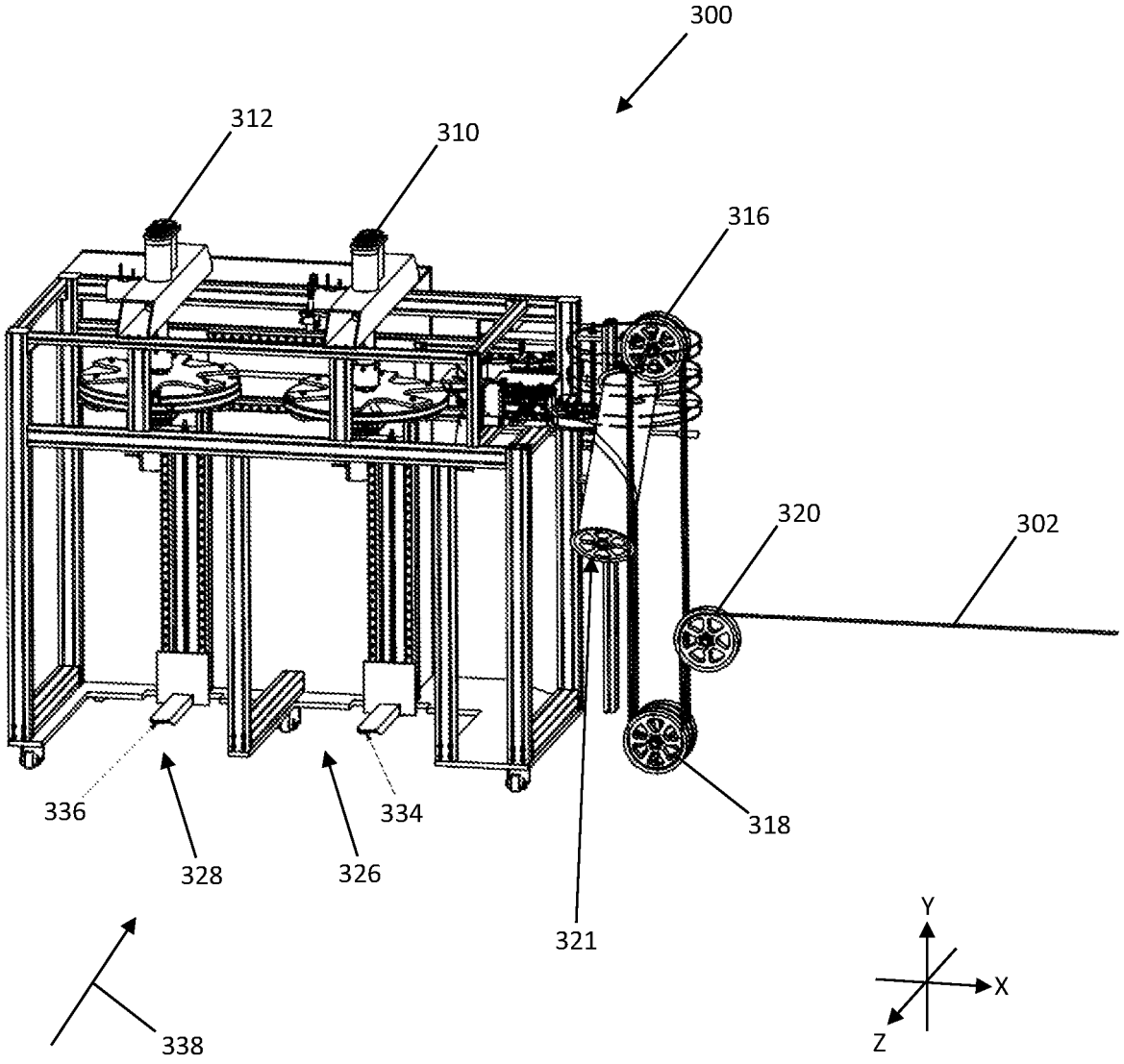
FIG. 3B is a second schematic perspective view drawing of the winding apparatus for winding the product strip onto the reel in the example embodiment.

FIG. 3A is a first schematic perspective view drawing of a winding apparatus 300 for winding a product strip 302 onto a reel e.g. 304 in an example embodiment. FIG. 3B is a second schematic perspective view drawing of the winding apparatus 300 for winding the product strip 302 onto the reel e.g. 304 in the example embodiment. With reference to FIG. 3A and FIG. 3B, a front view of the winding apparatus 300 is defined as a view in a direction along the Z-axis; a side view of the winding apparatus 300 is defined as a view in a direction along the X-axis. FIG. 3A shows a plurality of reels e.g. 304 positioned in a stack/pile on a right-hand side of the winding apparatus 300. These reels e.g. 304 may be empty reels. FIG. 3A also shows a plurality of reels e.g. 304 positioned in a stack/pile on a left-hand side of the winding apparatus 300. These reels e.g. 304 may be filled reels. FIG. 3B shows an absence of the above-mentioned reels e.g. 304.

The winding apparatus 300 comprises a support frame 306 for supporting components of the winding apparatus 300, a feeder module 308 disposed at a side portion of the support frame 306, a first winding module part 310 disposed adjacent to the feeder module 308 for receiving the product strip 302, and a second winding module part 312 disposed adjacent to the first winding module part 310 on the supporting frame 306.

The feeder module 308 is configured to feed a product strip 302 to the first winding module part 310. The first winding module part 310 is configured to retrieve the reel e.g. 304 from a stack of empty reels e.g. 304 and rotate the reel e.g. 304 to wind the product strip 302 onto the reel e.g.

304. The second winding module part 312 is configured to package (e.g. cross-tape, affix label(s) etc.) the reel e.g. 304 having the product strip 302 wound thereon by the first winding module part 310 and to deposit/place/drop off the reel e.g. 304 onto a stack of filled reels e.g. 304. The feeder module 308, first winding module part 310 and second winding module part 312 function substantially similarly respectively to the feeder module 216, first winding module part 218 and second winding module part 220 of FIG. 2.

The winding apparatus 300 further comprises an accumulator unit 314 coupled to the feeder module 308, the accumulator unit 314 for holding/storing a buffer length or excess length of the product strip 302. The accumulator unit 314 comprises a top array of roller units 316 disposed near/at a top portion of the support frame 306, a bottom array of roller units 318 disposed near/at a bottom portion of the support frame 306, an input roller unit 320 disposed between the top array of roller units 316 and the bottom array of roller units 318, and an output roller unit 321 disposed in relation to the feeder module 308. Each array of roller units e.g. 316, 318 may comprise, for example but not limited to, about 3 to 5 roller units.

The accumulator unit 314 is configured to receive the product strip e.g. stamped products 302 from an external machine for manufacturing the product strip e.g. a stamping press machine (not shown). The input roller unit 320 is fixed at a height in relation to (e.g. aligned to) an output terminal of the external machine to receive the product strip that is being output from the external machine.

The accumulator unit 314 is further configured to convey the product strip to the feeder module 308. The output roller unit 321 is oriented horizontally in the X-Z plane and is disposed in relation to (e.g. aligned to) the feeder module 308 such that the product strip 302 is arranged to be fed/transmitted into the feeder module 308. It will be appreciated that the product strip 302 from the external machine may not be in an orientation which is suitable for winding onto the reel e.g. 304 that is positioned horizontally in the X-Z plane. In this respect, the horizontally positioned output roller unit 321 of the accumulator unit 314 functions as an adapter/converter to orientate the product strip 302 for winding onto the reel e.g. 304, i.e. the product strip 302 may be orientated to have its planar surfaces substantially parallel to a vertical plane such that the product strip 302 may be fed and wound onto the reel e.g. 304 that is positioned horizontally in the X-Z plane.

The accumulator unit 314 functions to hold/store a buffer length or excess length of the product strip 302 e.g. stamped products 302 that is being transmitted from the external machine during a reel changing/transfer operation between the first winding module part 310 and second winding module part 312. The buffer/excess length of product strip 302 is looped around the top array of roller units 316 and bottom array of roller units 318. The bottom array of roller units 318 is configured to be movable e.g. along the vertical Y-axis to vary its relative distance from the top array of roller units 316, thereby varying the length of product strip 302 which can be held/stored in the accumulator unit 314. The bottom array of roller units 318 may be referred to as an array of dancing roller units.

During a winding operation, there may be little or no buffer length of the product strip 302 in the accumulator unit 314. When there is little or no buffer length of the product strip 302 in the accumulator unit 314, the top array of roller units 316 and the bottom array of roller units 318 may be nearer or adjacent to each other. For example, the top array of roller units 316 may be positioned adjacent to the bottom array of roller units 318 (e.g. side by side, bottom-side to top-side), such that both arrays of roller units are closed up/collapsed together when there is little or no buffer length of the product strip 302.

During a reel change operation where a filled reel e.g. 304 at the first winding module part 310 is replaced with a next empty reel e.g. 304, the bottom array of roller units 318 may move further with respect to the top array of roller units 316, e.g. downwards, such that a buffer length of the product strip 302 is stored or an increasing buffer length of the product strip 302 is capable of being stored in the accumulator unit 314. After the reel change operation is completed, the first winding module part 310 picks up (i.e. increases) its winding speed such that the bottom array of roller units 318 may move closer with respect to the top array of roller units 316, e.g. upwards towards the top array of roller units 316 and become collapsed/closed together again. The position of the bottom array of roller units 318 may be used to control a feed rate of the feeder module 308 during threading/transmission of the product strip 302 into the reel e.g. 304 (i.e. feeding of an initial length of the product strip 302 into the reel e.g. 304). Once the threading of the product strip 302 is completed, a feeder roller of the feeder module 308 disengages to stop the threading. The position of the bottom array of roller units 318 may also be used to control and/or coordinate with the winding speed of the first winding module part 310 until a reel e.g. 304 is filled with product strip 302.

In the example embodiment, the feeder module 308 is configured to vary a feed rate (i.e. a rate of supply of the product strip 302) during a threading operation by e.g. varying a rotation speed of the feeder module 308 feeding the product strip 302 based on the relative position of the bottom array of roller units 318 in the accumulator unit 314. The feed rate of the feeder module 308 may be increased as the buffer length/loop of product strip 302 in the accumulator unit 314 increases and decreased as the buffer length/loop of product strip 302 in the accumulator unit 314 decreases. During a reel change operation between the first winding module part 310 and second winding module part 312, the feeder module 308 is configured to stop the supply of product strip 302 by holding the product strip 302 in position. As the product strip 302 is being held in position by the feeder module 308, the relative distance between the top array of roller units 316 and the bottom array of roller units 318 in the accumulator unit 314 changes (i.e. increases) to increase the buffer length of product strip 302 which can be held in the loops around the top array of roller units 316 and the bottom array of roller units 318, thereby providing increased storage for excess product strip 302. After a new empty reel e.g. 304 is in position for winding, the excess product strip 302 can be removed from the accumulator unit 314 (to the feeder module 308) at a rate faster than that entering the accumulator unit 314 from the machine for manufacturing the product strip. The relative position of the bottom array of roller units 318 with respect to the top array of roller units 316 then changes again to decrease the length of product strip 302 which can be held in the loops around the top array of roller units 316 and the bottom array of roller units 318.

As shown in FIG. 3A, the winding apparatus 300 further comprises an automatic interleaf member roll changer 322 disposed near the top portion of the support frame 306 in proximity to the feeder module 308 and the first winding module part 310. The automatic interleaf member roll changer 322 comprises a plurality of interleaf member roll holders e.g. 323 for receiving/mounting thereon one or more interleaf member rolls e.g. 324 in a stacked manner/formation. Each interleaf member roll e.g. 324 is positioned horizontally and is configured to be rotatable about its longitudinal axis within a horizontal plane of the winding apparatus 300. That is, the longitudinal axis of the interleaf member roll e.g. 324 is substantially parallel to the vertical axis of the winding apparatus 300 (or vertical to a ground in the ordinary word sense). Each interleaf member roll e.g. 324 contains a strand/strip of interleaf member e.g. interleaf paper which is arranged to be dispensed and wound together with the product strip 302 onto the reel e.g. 304. In order to wind the interleaf member onto the reel e.g. 304 in this orientation, the interleaf member is orientated such that its planar surfaces are substantially parallel to a vertical plane (compare X-Y plane) of the winding apparatus 300. The interleaf member e.g. interleaf paper is arranged to be conveyed to the reel e.g. 304 e.g. along a substantially horizontal path. Such a horizontal path may be substantially parallel to a horizontal plane (compare X-Z plane) of the winding apparatus 300. The interleaf paper functions to provide a separation layer between every layer of product strip e.g. stamped products 302 that is wound onto the reel e.g. 304 and to provide a tension to the wound product strip 302 in order to properly pack the product strip 302 onto the reel e.g. 304.

The automatic interleaf member roll changer 322 is configured to align one of the mounted interleaf member rolls e.g. 324 in relation to an operative position (compare 232 of FIG. 2) of the first winding module part 310. In the operative winding position, the interleaf member rolls e.g. 324, feeder module 308 and the first winding module part 310 may be positioned at substantially the same level in the horizontal plane (compare X-Z plane) of the winding apparatus 300 such that the interleaf member e.g. interleaf paper dispensed from the interleaf member roll e.g. 324 is arranged to be wound together with the product strip 302 supplied by the feeder module 308 onto the reel e.g. 304 which is engaged/gripped by the first winding module part 310. The automatic interleaf member roll changer 322 is further configured to translate along a substantially vertical path (compare Y-axis) to replace a depleted/empty interleaf member roll e.g. 324 with a filled/loaded/fresh interleaf member roll e.g. 324 which is loaded with interleaf member by aligning the fresh interleaf member roll e.g. 324 in relation to the operative position. The automatic switching of an empty interleaf member roll e.g. 324 to a fresh interleaf member roll e.g. 324 advantageously minimises apparatus/machine downtime.

The winding apparatus 300 further comprises a first compartment 326 disposed in relation to the first winding module part 310 and a second compartment 328 disposed in relation to the second winding module part 312. For example, the first compartment 326 is disposed below/under the first winding module part 310 and the second compartment 328 is disposed below/under the second winding module part 312. The first compartment 326 is configured to receive a first container 330 e.g. a first trolley 330 for stacking one or more empty reels e.g. 304 (i.e. reel with no product strip wound thereon). The second compartment 328 is configured to receive a second container 332 e.g. a second trolley 332 for stacking one or more filled reels e.g. 304 (i.e. reel with product strip wound thereon). As such, with the containers 330, 332 received within the winding apparatus 300, there can be space savings in terms of the footprint of the winding apparatus 300. As shown in FIG. 3A, a stack of empty reels e.g. 304 is placed on the first trolley 330 which is positioned/parked within the first compartment 326 and a stack of filled reels e.g. 304 is placed on the second trolley 332 which is positioned/parked within the second compartment 328. The configuration of holding a plurality of reels e.g. 304 in a stacked manner as shown in FIG. 3A may advantageously save space and minimises the footprint of the winding apparatus 300. In addition, the configuration of using containers e.g. trollies allows a user to replace a trolley 332 stacked with filled reels e.g. 304 with an empty trolley 332 to hold more filled reels e.g. 304, as well as to reload/replenish the trolley 330 with a fresh stack of empty reels e.g. 304 with relative ease and without interrupting the winding operation of the winding apparatus 300.

In use, a loaded first trolley 330 containing a stack of empty reels e.g. 304 is introduced/wheeled into the first compartment 326 and an empty second trolley 332 is introduced/wheeled into the second compartment 328, both in a direction as indicated by the arrow 338. As winding operations of reels e.g. 304 progress, the stack of empty reels e.g. 304 on the first trolley 330 is gradually depleted while a stack of filled reels e.g. 304 is gradually accumulated on the second trolley 332. When the first trolley 330 is empty and/or the second trolley 332 is stacked with filled reels e.g. 304, the trollies 330, 332 are respectively replaced with a new loaded first trolley 330 containing a stack of empty reels e.g. 304 and a new empty second trolley 332.

In the example embodiment, the containers may be manually positioned e.g. pushed into the compartments 326, 328 by a user e.g. a technician. It will be appreciated that the container(s) for stacking reels e.g. 304 is not limited to a trolley(s) which is manually pushed into the compartments 326, 328 by a user e.g. a technician, and may include other forms such as usage of autonomous vehicles which are capable of self-driving and parking into the compartments 326, 328 for carrying/transporting the container(s). Such example usage may significantly reduce the manpower and labour required to operate the winding apparatus 300, and may allow integration of a production facility with a warehousing facility such that production/filled reels produced by the winding apparatus at the production facility are directly transported to a warehouse(s) for storage, thus leading to even more cost saving and efficiency.

The winding apparatus 300 further comprises a first stack lifter 334 disposed in relation to, e.g. directly below/under, the first winding module part 310 and a second stack lifter 336 disposed in relation to, e.g. directly below/under, the second winding module part 312. The first stack lifter 334 is configured for automatically moving reels, e.g. up/down e.g. lifting a stack of empty reels e.g. 304 whenever the topmost reel e.g. 304 in the stack is picked up by the first winding module part 310. For example, the first stack lifter 334 may be a resilient member coupled to a contactor for exerting a force in an upward direction upon removal of one reel e.g. 304. For example, the first stack lifter 334 is configured to lift the stack of empty reels e.g. 304 upwards by a displacement which is substantially equivalent to the height of a reel e.g. 304, thereby providing a new empty reel e.g. 304 to be picked up by the first winding module part 310. The height of a reel e.g. 304 may be the distance between the top flange and bottom flange of the reel e.g. 304. The second stack lifter 336 is configured for automatically moving reels e.g. up/down e.g. lowering a stack of filled reels e.g. 304 whenever a new filled reel e.g. 304 is added/placed/dropped off by the second winding module part 312 to the stack of filled reels e.g. 304. For example, the second stack lifter 336 may be a resilient member coupled to a contactor for cushioning a stack of reels e.g. 304 upon addition of one reel e.g. 304. For example, the second stack lifter 336 is configured to lower the stack of filled reels e.g. 304 downwards by a displacement which is substantially equivalent to the height of a reel e.g. 304, thereby providing space for accommodating a new filled reel e.g. 304 to be placed/dropped off by the second winding module part 312.

Figure 3C:
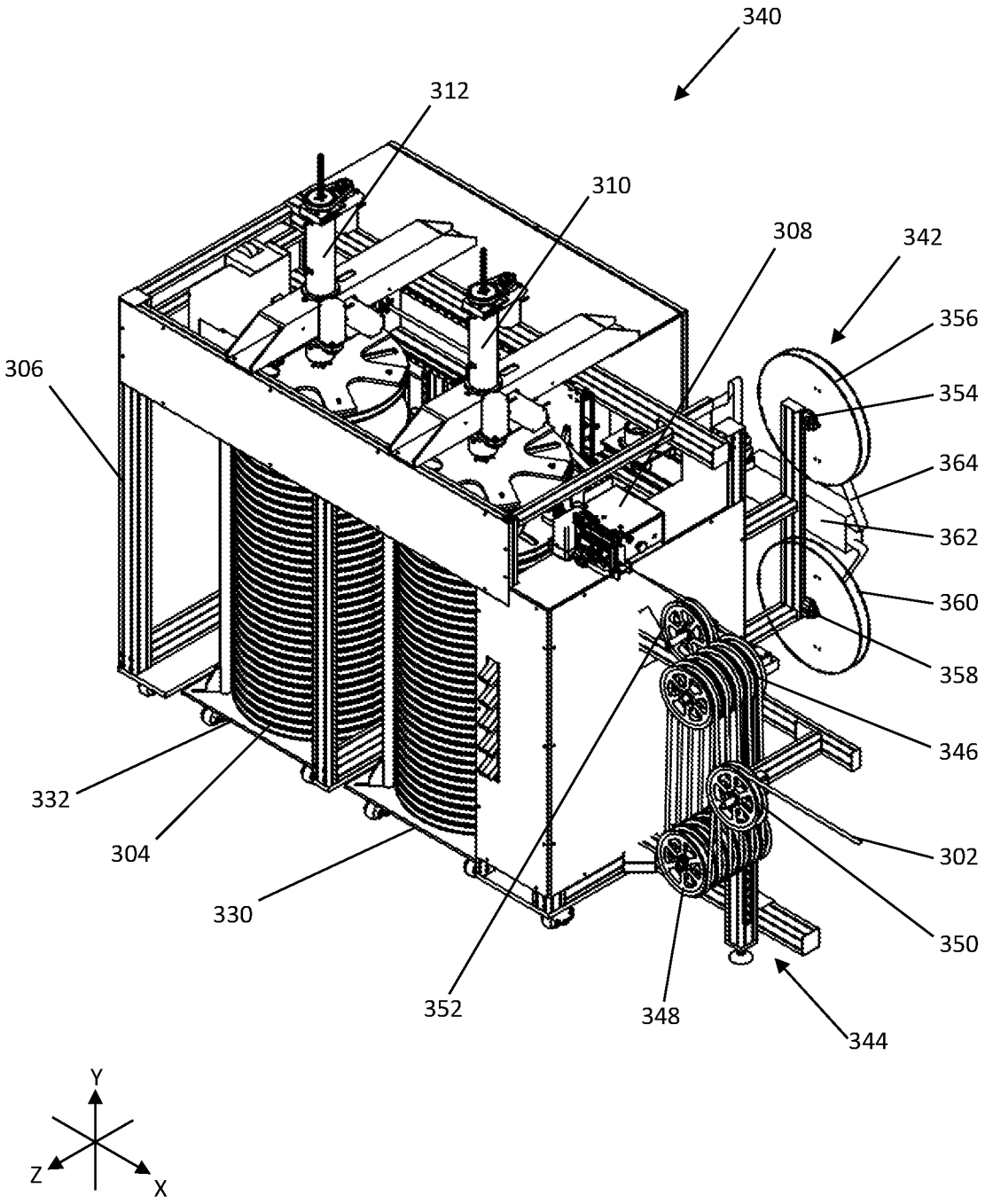
FIG. 3C is a first schematic perspective view drawing of a winding apparatus for winding a product strip onto a reel in another example embodiment.
Figure 3D:
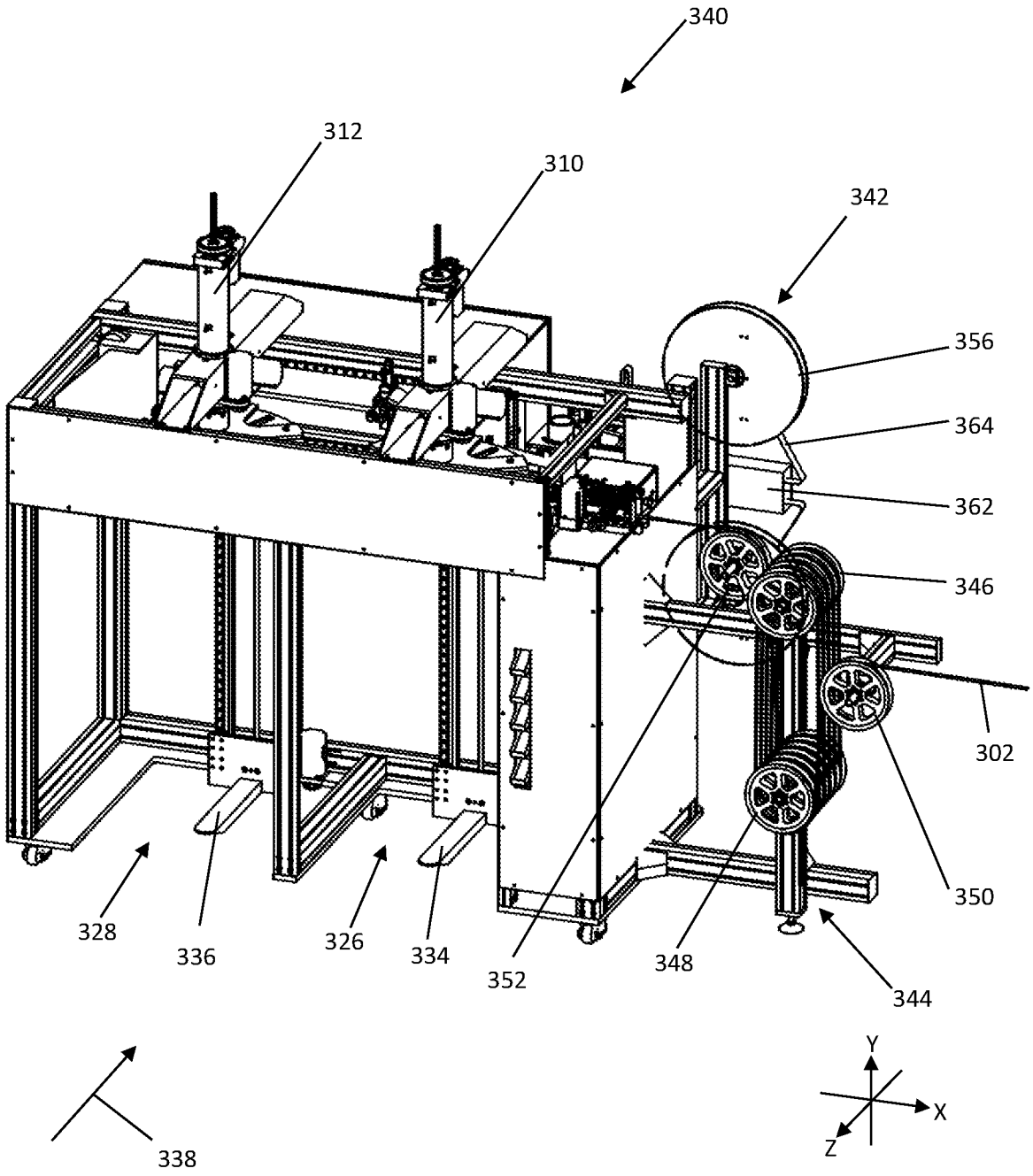
FIG. 3D is a second schematic perspective view drawing of the winding apparatus for winding the product strip onto the reel in the another example embodiment.

FIG. 3C is a first schematic perspective view drawing of a winding apparatus 340 for winding a product strip 302 onto a reel e.g. 304 in another example embodiment. FIG. 3D is a second schematic perspective view drawing of the winding apparatus 340 for winding the product strip 302 onto the reel e.g. 304 in the another example embodiment. The winding apparatus 340 is substantially similar in structure and function to the winding apparatus 300. For ease of understanding and illustration, components of the winding apparatus 340 that are identical in structure and function to corresponding components of the winding apparatus 300 are labelled with the same reference numerals.

The winding apparatus 340 comprises a support frame 306 for supporting components of the winding apparatus 340, a feeder module 308 disposed at a side portion of the support frame 306, a first winding module part 310 disposed adjacent to the feeder module 308 for receiving the product strip 302, and a second winding module part 312 disposed adjacent to the first winding module part 310 on the supporting frame 306.

The winding apparatus 340 further comprises an automatic interleaf member roll changer 342 and an accumulator unit 344 that are different in structure from the automatic interleaf member roll changer 322 and the accumulator unit 314 of FIG. 3A and FIG. 3B.

In the example embodiment, the accumulator unit 344 of the winding apparatus 340 functions to hold/store a buffer length or excess length of the product strip 302. The accumulator unit 344 comprises a top array of roller units 346 disposed near/at a top portion of the support frame 306, a bottom array of roller units 348 disposed near/at a bottom portion of the support frame 306, an input roller unit 350 disposed between the top array of roller units 346 and the bottom array of roller units 348, and an output roller unit 352 disposed in relation to the feeder module 308. Each array of roller units e.g. 346, 348 may comprise, for example but not limited to, about 3 to 5 roller units.

The accumulator unit 344 is configured to receive the product strip e.g. stamped products 302 from an external machine for manufacturing the product strip e.g. a stamping press machine (not shown). The input roller unit 350 is fixed at a height in relation to (e.g. aligned to) an output terminal of the external machine to receive the product strip 302 that is being output from the external machine.

The accumulator unit 344 is further configured to hold/store a buffer length or excess length of the product strip 302 e.g. stamped products 302 that is being transmitted from the external machine during a reel changing/transfer operation between the first winding module part 310 and second winding module part 312. The buffer/excess length of product strip 302 is looped around the top array of roller units 346 and bottom array of roller units 348. The bottom array of roller units 348 is configured to vary its relative distance from the top array of roller units 346, thereby varying the length of product strip 302 which can be held/stored in the accumulator unit 344. The bottom array of roller units 348 may be referred to as an array of dancing roller units.

The accumulator unit 344 is further configured to convey the product strip 302 to the feeder module 308. The output roller unit 352 is oriented vertically in the X-Y plane and is disposed in relation to (e.g. aligned to) the feeder module 308 such that the product strip 302 is arranged to be fed/transmitted into the feeder module 308.

It will be appreciated that the output roller unit 352 is different from the output roller 321 of the accumulator unit 314 which is oriented horizontally in the X-Z plane. In other words, the output roller unit 352 does not function as an adapter/converter to re-orientate the product strip 302 for winding onto the reel e.g. 304. Instead, the accumulator unit 344 of the winding apparatus 340 is positioned to be spaced further apart from the feeder module 308 as compared to the accumulator unit 314 of the winding apparatus 300. This provides a space/gap which allows the product strip 302 to rotate/twist 90 degrees (due to end-to-end holding forces) as the product strip 302 is being dispensed from the output roller 352 of the accumulator unit 344 and fed/transmitted into the feeder module 308. That is, the product strip 302 that is being dispensed immediately from the output roller 352 of the accumulator unit 344 is orientated with its planar surface in a horizontal position (i.e. substantially parallel to the X-Z plane). The feeder module 308 receives the product strip 302 with the planar surface of the product strip in a vertical position and conveys the product strip 302 to the reel e.g. 304 in such a position. As the product strip 302 travels to the feeder module 308, the product strip 302 twists/rotates 90 degrees such that its planar surface is in a vertical position (i.e. substantially parallel to the X-Y plane) when entering the feeder module 308. This re-orientation allows the product strip 302 to be wound onto the reel e.g. 304 that is in a horizontal position. It will be appreciated that the space/gap allows the product strip 302 to be rotated/twisted without being deformed or tensed in a manner which would affect the quality of the product strip 302.

During a winding operation, there may be little or no buffer length of the product strip 302 in the accumulator unit 344. When there is little or no buffer length of the product strip 302 in the accumulator unit 344, the top array of roller units 346 and the bottom array of roller units 348 may be nearer or adjacent to each other. For example, the top array of roller units 346 may be positioned adjacent to the bottom array of roller units 348 (e.g. side by side, bottom-side to top-side), such that both arrays of roller units are closed up/collapsed together when there is little or no buffer length of the product strip 302.

During a reel change operation where a filled reel e.g. 304 at the first winding module part 310 is replaced with a next empty reel e.g. 304, the bottom array of roller units 348 may move further with respect to the top array of roller units 346, e.g. downwards, such that a buffer length of the product strip 302 is stored or an increasing buffer length of the product strip 302 is capable of being stored in the accumulator unit 344.

After the reel change operation is completed, the first winding module part 310 picks up (i.e. increases) its winding speed such that the bottom array of roller units 348 may move closer with respect to the top array of roller units 346, e.g. upwards towards the top array of roller units 346 and become collapsed/closed together again. The position of the bottom array of roller units 348 may be used to control a feed rate of the feeder module 308 during threading/transmission of the product strip 302 into the reel e.g. 304 (i.e. feeding of an initial length of the product strip 302 into the reel e.g. 304). Once the threading of the product strip 302 is completed, a feeder roller of the feeder module 308 disengages to stop the threading. The position of the bottom array of roller units 348 may also be used to control and/or coordinate with the winding speed of the first winding module part 310 until a reel e.g. 304 is filled with product strip 302.

In the example embodiment, the automatic interleaf member roll changer 342 is disposed near/at the top portion of the support frame 306 in proximity to the feeder module 308 and the first winding module part 310. The automatic interleaf member roll changer 342 comprises a top holder 354 for receiving and holding a first interleaf member roll 356, a bottom holder 358 for receiving and holding a second interleaf member roll 360, and a conveyor unit 362 for receiving an interleaf member 364 from the interleaf member rolls 356, 360 and conveying the interleaf member 364 to other components of the winding apparatus 340. Each interleaf member roll e.g. 356, 360 contains a strand/strip of the interleaf member e.g. interleaf paper 364 which is arranged to be dispensed and wound together with the product strip 302 onto the reel e.g. 304. Each interleaf member roll e.g. 356, 360 may be viewed as a cylinder body defined by a lateral surface joining two base surfaces that are substantially parallel to each other.

In the example embodiment, the conveyor unit 362 of the automatic interleaf member roll changer 342 is configured to convey the interleaf member 364 to other components of the winding apparatus 340. The conveyor unit 362 is further configured to perform securing, e.g. by using adhesive tape, of an end portion of interleaf member 364 from a depleted interleaf member roll e.g. first interleaf member roll 356 to a starting portion of interleaf member 364 from a fresh interleaf member roll e.g. second interleaf member roll 360. For example, when the first interleaf member roll 356 is dispensing interleaf member 364, the fresh second interleaf member roll 360 is placed on standby and is prepared with an adhesive tape e.g. double-sided tape applied to its starting portion of interleaf member 364. When the first interleaf member roll 356 is depleted, the starting portion of interleaf member 364 from the fresh second interleaf member roll 360 (with adhesive tape applied thereon) is secured/applied to the end portion of interleaf member 364 from the depleted first interleaf member roll 356 via an actuator for performing a cylinder motion. The cylinder motion may be performed manually or automatically. It will be appreciated that the securing of the starting and ending portions of the interleaf member 364 are guided to ensure proper securing. It will also be appreciated that during securing of the starting and ending portions of the interleaf member 364, the first winding module part 310 stops rotating to facilitate the securing, and a buffer length of product strip 302 accumulates in the accumulator unit 344 while the first winding module part 310 stops rotating.

The conveyor unit 362 is further configured to rotate/twist the interleaf member 364 that is dispensed from the interleaf member roll e.g. 356, 360 by e.g. 90 degrees. A rod (not shown) is disposed at an end portion of the conveyor unit 362 to facilitate the rotation/twisting of the interleaf member 364. It will be appreciated that the interleaf member 364 enters the conveyor unit 362 with its planar surfaces being substantially parallel to the X-Z plane. In order to wind the interleaf member 364 onto the reel e.g. 304, the interleaf member 364 is re-orientated/twisted by 90 degrees such that its planar surfaces are substantially parallel to a vertical plane (e.g. X-Y or Y-Z plane) of the winding apparatus 340.

The conveyor unit 362 is positioned in relation to other components of the winding apparatus 340. For example, the conveyor unit 362 of the automatic interleaf member roll changer 342, the feeder module 308 and the first winding module part 310 may be positioned at substantially the same level in the horizontal plane (compare X-Z plane) of the winding apparatus 340 such that the interleaf member 364 e.g. interleaf paper 364 dispensed from the interleaf member roll e.g. 356, 360 is arranged to be wound together with the product strip 302 supplied by the feeder module 308 onto the reel e.g. 304 which is engaged/gripped by the first winding module part 310.

It will be appreciated that the automatic interleaf member roll changer 342 of the winding apparatus 340 is different in construction from the automatic interleaf member roll changer 322 of the winding apparatus 300. In the automatic interleaf member roll changer 342 of the winding apparatus 340, the first interleaf member roll 356 is positioned above the second interleaf member roll 360 such that each interleaf member roll e.g. 356, 360 is vertically positioned with its base surfaces being substantially parallel to a vertical plane e.g. X-Y plane of the winding apparatus 340. On the other hand, in the automatic interleaf member roll changer 322 of the winding apparatus 300, the interleaf member rolls e.g. 324 are stacked on top of one another such that each interleaf member roll 324 is horizontally positioned with its base surface being substantially parallel to a horizontal plane e.g. X-Z plane of the winding apparatus 300.

It will also be appreciated that each interleaf member roll e.g. 356, 360 is positioned vertically and is configured to be rotatable about its longitudinal axis within a vertical plane of the winding apparatus 340. That is, the longitudinal axis of the interleaf member roll e.g. 356, 360 is substantially parallel to the horizontal axis (i.e. Z-axis) of the winding apparatus 340 (or parallel to a ground in the ordinary word sense). In order to wind the interleaf member 364 onto the reel e.g. 304 in this orientation, the interleaf member 364 that is dispensed from the interleaf member roll e.g. 356, 360 is re-orientated/twisted by 90 degrees as it passes through the conveyor unit 362, such that its planar surfaces are substantially parallel to a vertical plane (e.g. X-Y or Y-Z plane) of the winding apparatus 340. The interleaf member e.g. interleaf paper 364 is arranged to be conveyed to the reel e.g. 304 e.g. along a substantially horizontal path. Such a horizontal path may be substantially parallel to a horizontal plane (compare X-Z plane) of the winding apparatus 340. The interleaf member 364 functions to provide a separation layer between every layer of product strip e.g. stamped products 302 that is wound onto the reel e.g. 304 and to provide a tension to the wound product strip 302 in order to properly pack the product strip 302 onto the reel e.g. 304.

It will also be appreciated that during a winding operation, only one of the interleaf member rolls e.g. 356 is dispensing the interleaf member 364 while the other interleaf member rolls e.g. 360 is on standby. For example, when the first interleaf member roll 356 is dispensing interleaf member 364, the second interleaf member roll 360 is on standby. When the first interleaf member roll 356 is depleted (i.e. runs out of interleaf member 364), the second interleaf member roll 360 is automatically activated to dispense interleaf member 364 such that the winding operation can proceed with little or no interruption. The conveyor unit 362 performs securing of an end portion of interleaf member 364 from the depleted first interleaf member roll 356 to a starting portion of interleaf member 364 from the fresh second interleaf member roll 360 such that a continuous strip of the interleaf member 364 is dispensed. The depleted first interleaf member roll 356 can be replaced with a new first interleaf member roll 356 while the second interleaf member roll 360 is dispensing interleaf member 364. The automatic switching from a depleted interleaf member roll to a loaded interleaf member roll that is on standby may advantageously minimise apparatus/machine downtime. The configuration of having two vertically positioned interleaf member rolls may also provide a more simplified design and workflow, as well as a smaller machine footprint, as compared to having more than two horizontally positioned interleaf member rolls stacked on top of one another.

Figure 4A:
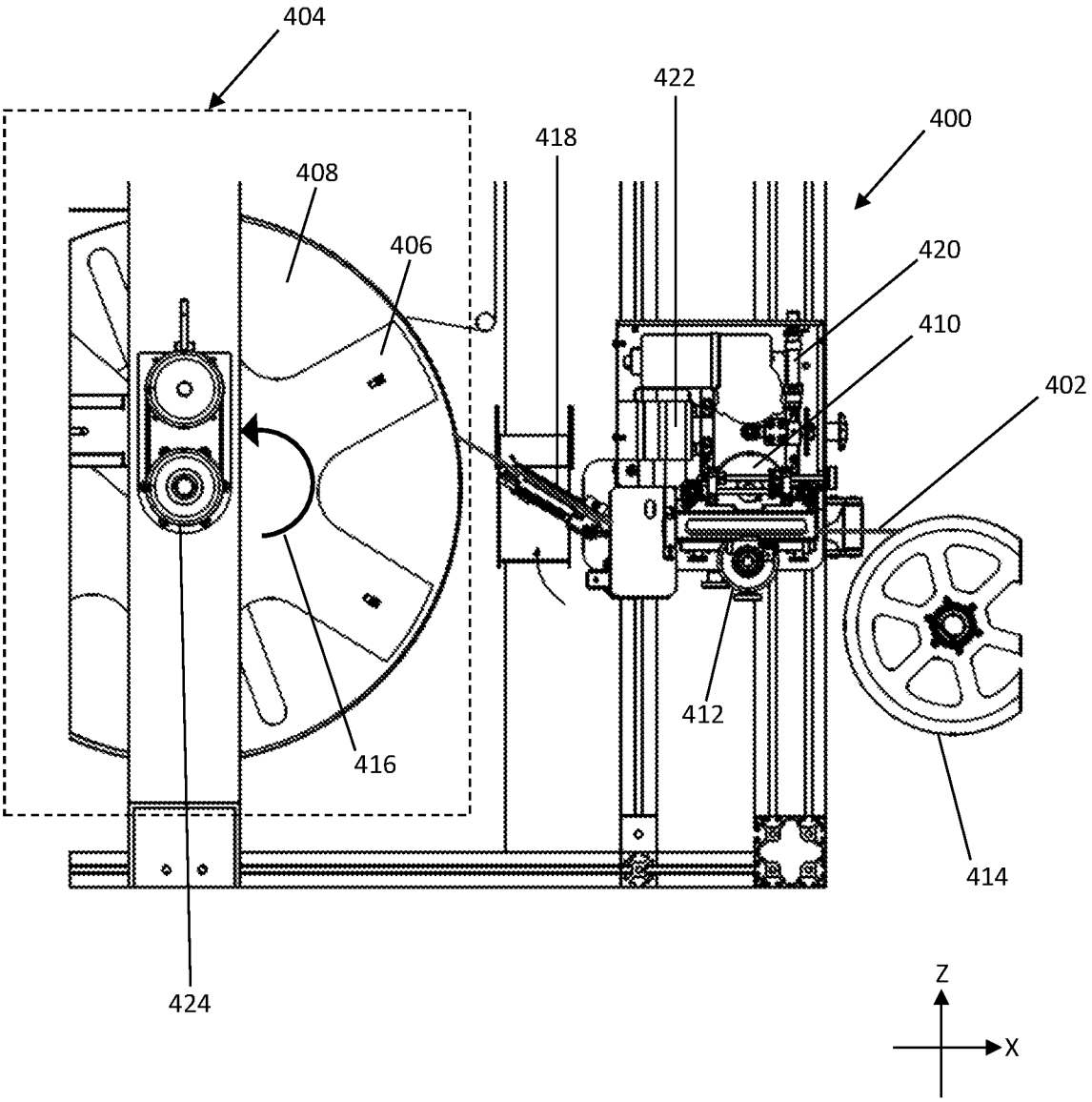
FIG. 4A is a schematic top view drawing of a feeder module for feeding a product strip to a reel that is being held by a first winding module part in an example embodiment.

FIG. 4A is a schematic top view drawing of a feeder module 400 (compare e.g. 102 of FIG. 1, 216 of FIG. 2, and 308 of FIG. 3) for feeding a product strip 402 to a reel 408 that is being held by a first winding module part 404 in an example embodiment. The first winding module part 404 functions substantially similarly to the first winding module part 218 of FIG. 2.

The first winding module part 404 comprises an end-effector 406 for engaging/gripping the reel 408, and a motor 424 for rotating the end-effector 406 about a vertical axis of rotation. For illustration, the axis is into the paper, i.e. about the Y-axis. In FIG. 4A, the end-effector 406 is shown to be engaging/gripping the reel 408 in an operative position whereby the reel 408 is aligned to the feeder module 400 and is capable of rotating and receiving the product strip 402 onto a hub of the reel 408.

The feeder module 400 e.g. a feed head 400 comprises a motorised feed roller 410 and an idling/passive (i.e. non-motorised) roller 412 spaced apart from each other for allowing the product strip 402 to pass therebetween. The pair of rollers 410, 412 is arranged to receive the product strip 402 from an accumulator unit 414 (compare 314 of FIG. 3A and FIG. 3B) and to convey the product strip 402 to the reel 408 as the reel 408 is being rotated by the first winding module part 404. In the example embodiment, the motorised feed roller 410 is arranged to feed a pre-programmed threading length of product strip 402 e.g. of stamped products into the reel 408 as the reel 408 rotates about an anticlockwise direction as indicated by the arrow 416.

The feeder module 400 further comprises a swivel chute 418 e.g. a motorised swivel chute 418 rotatably mounted at one end to the feeder module 400. The motorised swivel chute 418 functions to aim/guide/direct the product strip 402 to the hub of the reel 408 at a feed angle e.g. by rotating to a desired angle to direct/align/aim at an inner reel position (i.e. the hub of the reel 408). The motorised swivel chute 418 is capable of rotating about its mounted end to the feeder module 400 and is configured to adjust/change the feed angle of the product strip 402 to adapt to an increasing length of product strip 402 being wound onto the reel 408. As a coiling diameter of the product strip 402 e.g. of stamped products about the reel 408 increases (i.e. while the winding operation progresses), the motorised swivel chute 418 changes its feeding angle gradually based on feedback received by a processing module (compare e.g. 106 of FIG. 1). The ability to vary the feeding angle may advantageously avoid an occurrence of undesirable feeding angles e.g. acute angle which may result in excessive stress or breakage of the product strip 402 e.g. stamped products.

The feeder module 400 further comprises a feed roller engage cylinder 420 coupled to the motorised feed roller 410. The feed roller engage cylinder 420 is configured to actuate the motorised feed roller 410 to contact (i.e. engage) the product strip 402 and to actuate the motorised feed roller 410 to break contact (i.e. disengage) with the product strip 402.

The motorised feed roller 410 is arranged to break contact with the product strip 402 during a winding operation. That is, the motorised feeder roller 410 of the feeder module 400 does not actively convey the product strip 402 during winding operations. Only the first winding module part 404 is responsible for retrieving/drawing in the product strip 402 during rotation.

The motorised feed roller 410 is arranged to contact the product strip 402 during a threading operation and a reel change operation. During a threading operation, the motorised feed roller 410 is engaged with the product strip 402. Rotation of the motorised feed roller 410 conveys an initial threading length of the product strip 402 to an empty reel 408 that is being engaged by the end-effector 406 of the first winding module part 404. The motorised feed roller 410 is arranged to break contact with the product strip 402 after the initial threading length of the product strip 402 is wound onto the reel 408. During a reel change operation, the motorised feed roller 410 is engaged with the product strip 402 and does not rotate, such that the product strip 402 is held/suspended in position and is not being conveyed to the first winding module part 404. It will be appreciated that when the motorised feed roller 410 is in the engaged position, the product strip 402 that is being transmitted from a manufacturing line e.g. stamping press machine may be stored in the accumulator unit 414.

The feeder module 400 further comprises a sensor e.g. optical sensor (not shown) mounted inside a feeder track (not shown) of the feeder module 400 for counting the quantity/number of products (of the product strip) that are wound onto each reel 408. The quantity of products per reel may be programmable by a user. This ensures that there is consistency in the number of products per reel.

The feeder module 400 further comprises a cutter cylinder 422 for cutting the product strip 402 when a targeted/desired count/quantity of products in the product strip 402 per reel is reached. In the example embodiment, when the reel 408 is filled with the target quantity of products in the product strip 402, the feeder module 400 holds the product strip by engaging the motorised feed roller 410 (without rotation of the motorised feed roller). The cutter cylinder 422 is then activated to cut the product strip 402. After the product strip 402 is cut, if one or more samples of the product strip 402 are required for performing QA (quality assurance) test(s), the feeder module 400 may be configured to further dispense one or more short, programmed length(s) of the product strip 402. The cutter cylinder 422 of the feeder module 400 may be configured to cut the product strip 402 such that the one or more samples of the product strip 402 can be collected, e.g. by dropping onto a sample tray positioned below the cutter cylinder 422 of the feeder module 400. The counting sensor resets to zero to be ready for counting the quantity of products for the next reel 408 after the product strip 402 and optionally, the one or more samples of the product strip 402 are cut.

In the example embodiment of FIG. 4A, the output roller unit (compare 321 of FIGS. 3A and 3B) of the accumulator unit 414 is depicted as a roller unit which is oriented horizontally in the X-Z plane and disposed immediately prior to feeding the product strip 402 into the feeder module 400. It will be appreciated that the product strip 402 from a manufacturing line e.g. from a stamping press machine may not be in an orientation which is suitable for winding onto the reel 408 that is positioned horizontally in the X-Z plane. In this respect, the horizontally positioned roller unit of the accumulator unit 414 functions as an adapter to re-orientate the product strip 402 for winding onto the reel 408, i.e. the product strip 402 may be orientated to have its planar surfaces in a vertical position such that the product strip 402 may undergo winding onto the reel 408 that is in a horizontal position.

Figure 4B:
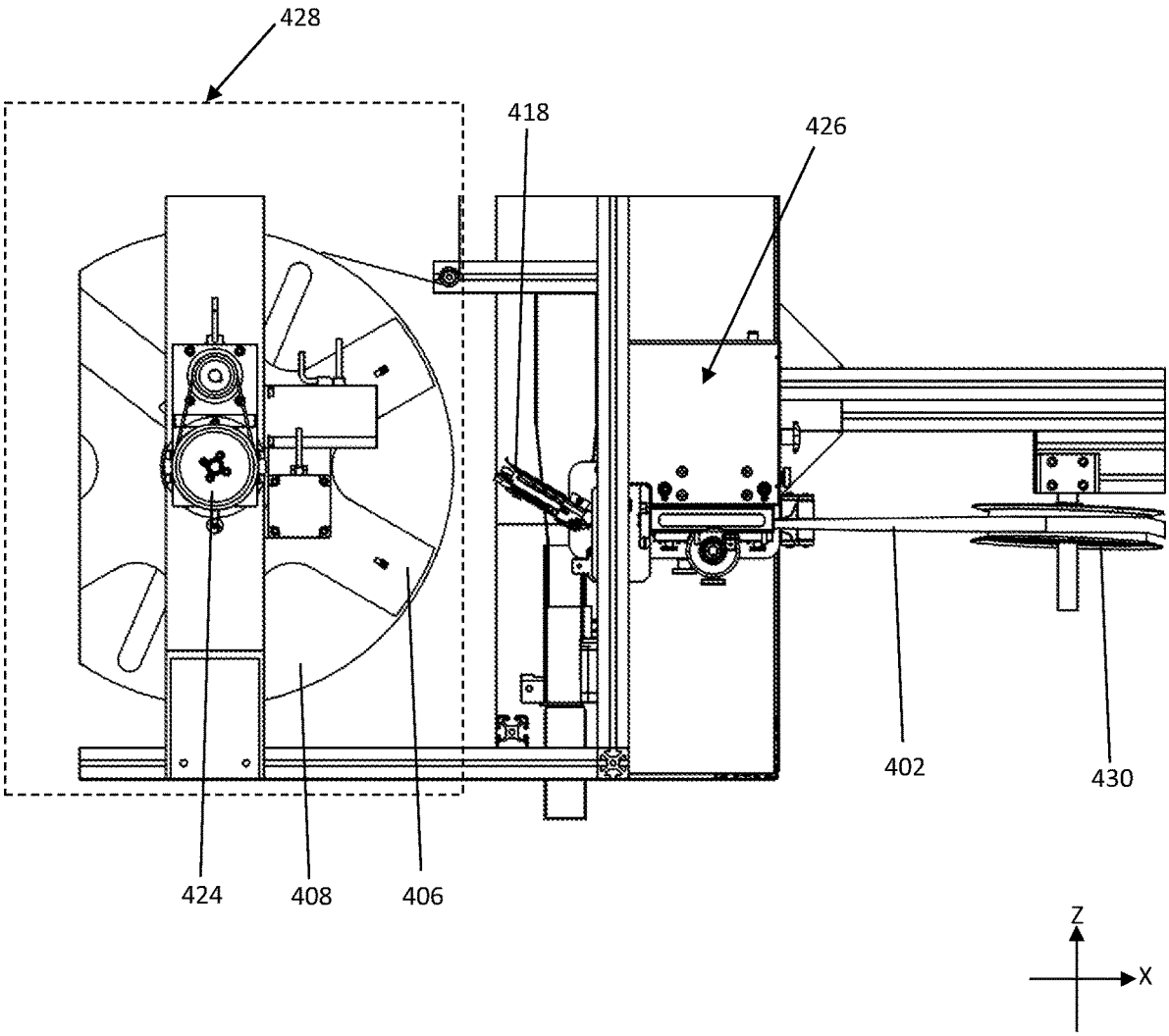
FIG. 4B is a schematic top view drawing of a feeder module for feeding a product strip to a reel that is being held/engaged by a first winding module part in another example embodiment.

FIG. 4B is a schematic top view drawing of a feeder module 426 (compare e.g. 102 of FIG. 1, 216 of FIG. 2, and 308 of FIG. 3) for feeding a product strip 402 to a reel 408 that is being held/engaged by a first winding module part 428 in another example embodiment. The feeder module 426 and first winding module part 428 are substantially similar in structure and function to the feeder module 400 and first winding module part 404 of FIG. 4A. For ease of understanding and illustration, components of the feeder module 426 and first winding module part 428 that are identical in structure and function as corresponding components of the feeder module 400 and first winding module part 404 are labelled with the same reference numerals.

FIG. 4B depicts an accumulator unit 430 that is different in structure from the accumulator unit 414 of FIG. 4A. The accumulator unit 430 is substantially similar in structure to the accumulator unit 344 of FIG. 3C and FIC. 3D. In FIG. 4B, the accumulator unit 430 is depicted as an output roller unit which is oriented vertically in the X-Y plane and is disposed in relation to (e.g. aligned to) the feeder module 426 such that the product strip 402 is arranged to be fed/transmitted into the feeder module 426. It will be appreciated that the output roller unit of the accumulator unit 430 is different from the output roller unit of the accumulator unit 414 which is oriented horizontally in the X-Z plane. The output roller unit of the accumulator unit 430 does not function as an adapter/converter to re-orientate the product strip 402 for winding onto the reel 408. Instead, the accumulator unit 430 is positioned such that the output roller unit of the accumulator unit 430 is spaced further apart from the feeder module 426 (compare distance of 414 from 400 in FIG. 4A and compare distance of 430 from 426 in FIG. 4B). This provides a space/gap which allows the product strip 402 to rotate/twist 90 degrees (due to end-to-end holding forces) as the product strip 402 is being dispensed from the output roller of the accumulator unit 430 and fed/transmitted into the feeder module 426. That is, the product strip 402 that is being dispensed immediately from the output roller of the accumulator unit 430 is orientated with its planar surface in a horizontal position (i.e. substantially parallel to the X-Z plane). The feeder module 426 receives the product strip 402 with the planar surface of the product strip in a vertical position and conveys the product strip 402 to the reel e.g. 408 in such a position. As the product strip 402 travels to the feeder module 426, the product strip 402 rotates 90 degrees such that its planar surface is in a vertical position (i.e. substantially parallel to the X-Y plane) when entering the feeder module 426. This re-orientation allows the product strip 402 to be wound onto the reel 408 that is in a horizontal position (i.e. substantially parallel to the X-Z plane). It will be appreciated that the space/gap allows the product strip 402 to be rotated/twisted without being deformed or tensed in a manner which would affect the quality of the product strip 402.

Figure 5A:
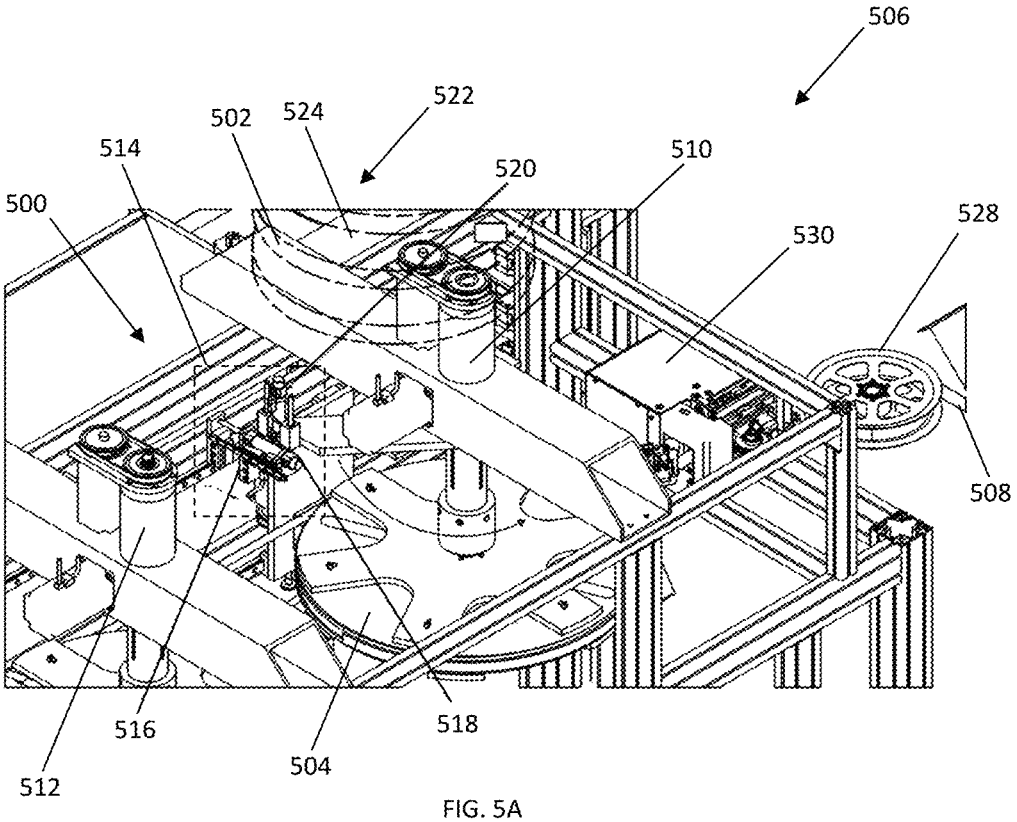
FIG. 5A is a schematic perspective view drawing of an interleaf module for supplying an interleaf member onto a reel for winding in an example embodiment.

FIG. 5A is a schematic perspective view drawing of an interleaf module 500 for supplying an interleaf member 502 onto a reel 504 for winding in an example embodiment. The interleaf module 500 is shown as a part of a winding apparatus 506 (partially shown) for winding a product strip 508 onto the reel 504. The winding apparatus 506 comprises a first winding module part 510 and a second winding module part 512 which function substantially similarly to the first winding module part 218 and second winding module part 220 of FIG. 2.

Figure 5B:
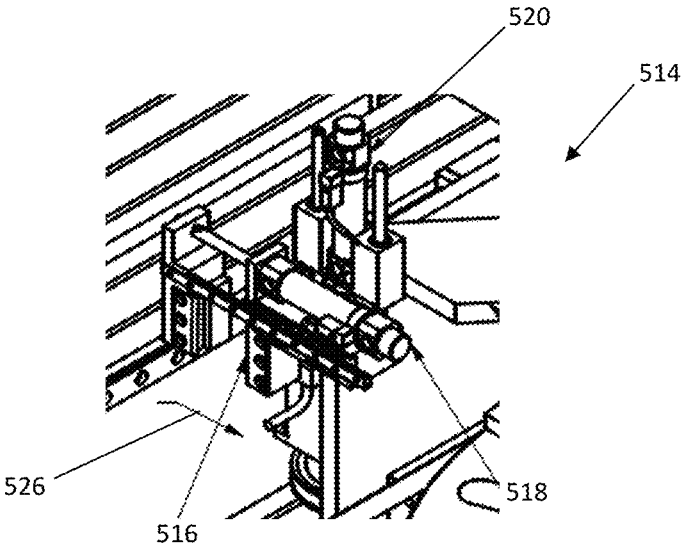
FIG. 5B is a magnified drawing of a swing arm in the example embodiment of FIG. 5A.

FIG. 5B is a magnified drawing of a swing arm 514 e.g. a paper swing arm 514 in the example embodiment of FIG. 5A. The swing arm 514 of the winding apparatus 506 is disposed between the first winding module part 510 and the second winding module part 512. The swing arm 514 comprises a cutter 516 e.g. a paper cutter 516, a cutter cylinder 518 coupled to the cutter 516, and a down cylinder 520 coupled to the cutter 516 and cutter cylinder 518. The swing arm 514 functions to hold and swing/direct the interleaf paper 502 for coiling onto an empty reel 504 that is being engaged/gripped by the first winding module part 510. The interleaf member 502 is arranged to be wound/coiled together with the product strip 508 onto the reel 504, thereby providing a separation layer between adjacent layers of product strip 508 that is wound onto the reel 504 and to provide a tension to the wound product strip 508 in order to properly pack the product strip 508 onto the reel 504.

The swing arm 514 also functions to hold/grip and cut the interleaf member e.g. interleaf paper 502 on a filled reel 504. The cutter cylinder 518 is configured to translate the cutter 516 along a substantially horizontal cutting path (as depicted by the arrow 526) such that a portion of the interleaf member 502 that is disposed along the substantially horizontal cutting path is cut breadth-wise by a cutting edge of the cutter 516. The down cylinder 520 is configured to translate the cutter 516 and cutter cylinder 518 upwards and downwards along a substantially vertical path (compare Y-axis) for aligning and directing the interleaf member 502 onto the reel 504. The down cylinder 520 is further configured to align the cutter 516 for cutting across the breadth of the interleaf member 502.

The interleaf module 500 further comprises an automatic interleaf member roll changer 522 (compare e.g. 322 of FIG. 3). The automatic interleaf member roll changer 522 is configured to allow one or more interleaf member rolls e.g. 524 to be mounted thereon. Each interleaf member roll e.g. 524 contains a continuous strand/strip of interleaf member 502 which may be supplied to the swing arm 514 for winding/coiling onto the reel 504. The automatic interleaf member roll changer 522 is further configured to automatically switch an empty interleaf member roll e.g. 524 to a fresh interleaf member roll e.g. 524 loaded with interleaf member 502 so as to minimize apparatus/machine downtime.

The winding apparatus 506 further comprises an accumulator unit 528 and a feeder module 530. The accumulator unit 528 conveys the product strip 508 from an external machine to the feeder module 530. The feeder module 530 conveys the product strip 508 to the reel 504 that is engaged by the first winding module part 510.

During a reel change operation and prior to a winding operation, the swing arm 514 directs a starting portion of the interleaf member 502 from the interleaf member roll e.g. 524 to a hub of the reel 504 that is being engaged/gripped by the first winding module part 510. In order to wind the interleaf member 502 onto the reel 504, the interleaf member 502 is orientated by the swing arm 514 such that its planar surfaces are substantially parallel to a vertical plane (compare X-Y or Y-Z plane) of the winding apparatus 506. The interleaf member 502 may be first-secured/anchored to the hub of the reel 504 using a first securing member e.g. an adhesive such as a double-sided tape. The first winding module part 510 may rotate to wind the first-secured interleaf member 502 for a few rounds (e.g. about two to about five rounds) about the hub of the reel 504 such that the interleaf member 502 is properly/securely gripped onto the hub of the reel 504. Thereafter, a starting portion of the product strip 508 (i.e. a threading length of the product strip 508) is directed to the hub of the reel 504. After the starting portion of the product strip 508 is wound onto the reel 504, the first winding module part 510 rotates to wind the interleaf member 502 and product strip 508 onto the reel 504. When a target quantity of product to be wound onto the reel is reached, the product strip 508 is cut by a cutter cylinder (compare e.g. 422 of FIG. 4A) of the feeder module 530. Depending on a user-programmed number of rounds from cutting of the product strip 508 to end-securing of the reel 504, the first winding module part 510 continues to rotate until the programmed number of rounds is reached. After the reel 504 is fully wound with the interleaf member 502 and the product strip 508, the first winding module part 510 stops rotating. The swing arm 514 moves e.g. downwards via actuation of the down cylinder 520 to grip the interleaf member 502, e.g. to grip the interleaf member 502 at a portion between sites of application of two instances of a first-securing member. The cutter cylinder 518 translates the cutter 516 to cut the interleaf member 502 breadth-wise. An ending portion of the interleaf member 502 may be end-secured in position on the reel 504 using e.g. an adhesive such as a double-sided tape. The reel 504 that is fully wound with the interleaf member 502 and the product strip 508 is transferred to the second winding module part 512 for end-packaging (e.g. cross-taping and labelling) and the first winding module part 510 proceeds to retrieve a fresh empty reel e.g. 504 to be wound with the interleaf member 502 and the product strip 508. The swing arm 514 that is holding on to the interleaf member 502 proceeds to direct the interleaf member 502 onto the fresh empty reel e.g. 504.

Figure 5C:
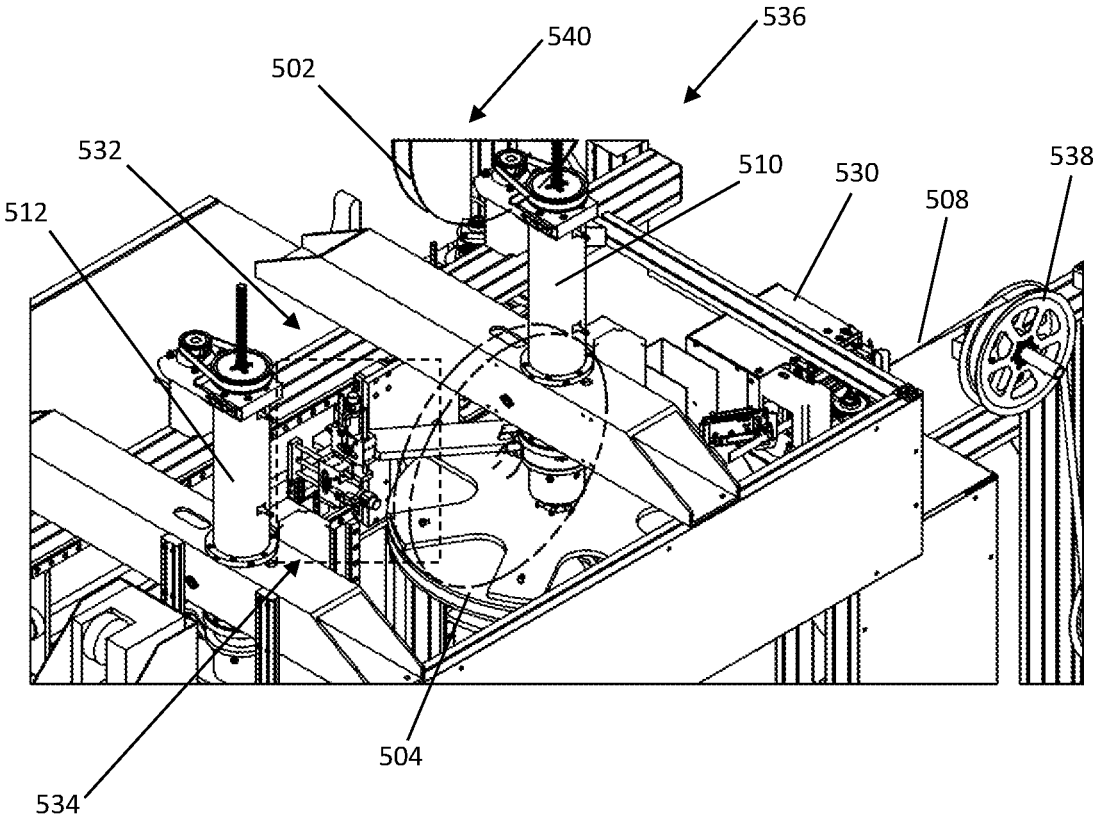
FIG. 5C is a schematic perspective view drawing of an interleaf module for supplying an interleaf member onto a reel for winding in another example embodiment.
Figure 5D:
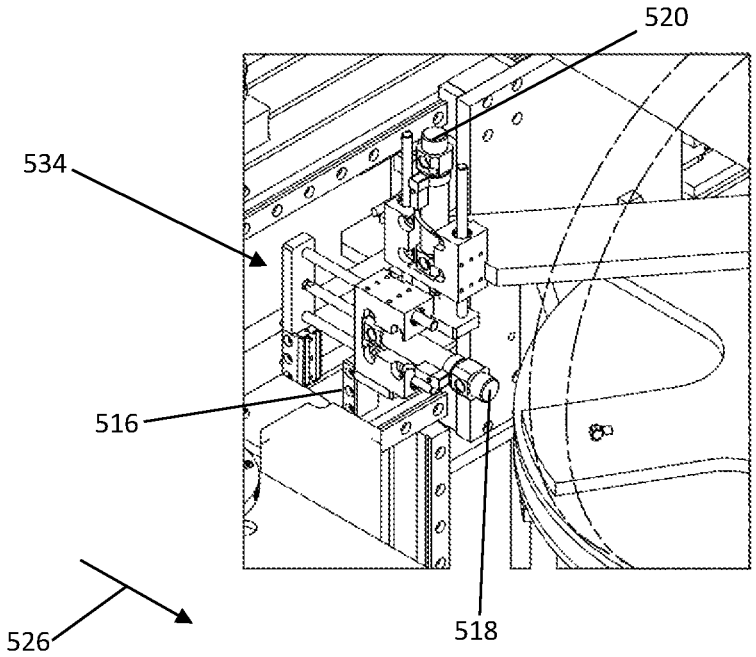
FIG. 5D is a magnified drawing of a swing arm in the another example embodiment of FIG. 5C.

FIG. 5C is a schematic perspective view drawing of an interleaf module 532 for supplying an interleaf member 502 onto a reel 504 for winding in another example embodiment. FIG. 5D is a magnified drawing of a swing arm 534 e.g. a paper swing arm 534 in the another example embodiment of FIG. 5C. The interleaf module 532 is shown as a part of a winding apparatus 536 (partially shown) for winding a product strip 508 onto the reel 504.

The winding apparatus 536 comprises an accumulator unit 538 and an automatic interleaf member roll changer 540 which are different in structure from the accumulator unit 528 and an automatic interleaf member roll changer 522 of the winding apparatus 506. The accumulator unit 538 and automatic interleaf member roll changer 540 are substantially similar in structure/position to the accumulator unit 344 and automatic interleaf member roll changer 342 of FIG. 3C and FIC. 3D. Apart from the accumulator unit and the automatic interleaf member roll changer, the rest of the components in the winding apparatus 536 are substantially similar in structure and function to the winding apparatus 506. For ease of understanding and illustration, components of the winding apparatus 536 that are identical in structure and function as corresponding components of the winding apparatus 506 are labelled with the same reference numerals.

In the example embodiments as illustrated in FIG. 5A to FIG. 5D, the swing arm e.g. 514, 534 is positioned between the first winding module part 510 and the second winding module part 512. It will be appreciated that in other example embodiments, the swing arm (compare e.g. 514, 534 of FIG. 5A to FIG. 5D) may alternatively be positioned in a region between the first winding module part 510 and the feeder module 530. This results in the swing arm (compare e.g. 514, 534) being disposed nearer to the automatic interleaf member roll changer e.g. 522, 540 and a first securing tape dispenser (compare 634 of FIG. 6A to FIG. 6D). The first securing member dispenser may be an adhesive tape dispenser e.g. a double-sided tape dispenser for dispensing double-sided tape to be applied onto the interleaf member 502. Two instances of the first securing member may be applied onto the interleaf member 502. A first instance of the first securing member may be used for end-securing the interleaf member 502 to a current filled reel e.g. 504 and a second instance of the first securing member may be used for first-securing the interleaf member 502 to a next empty reel.

In such other example embodiments, after the two instances of first securing member are applied onto the interleaf member 502, the portion of the interleaf member 502 with the two instances of first securing member applied thereon travels a shorter distance to reach and be held by the swing arm as compared to the example embodiments of FIG. 5A to FIG. 5D, where the portion of the interleaf member 502 with the two instances of first securing member applied thereon travels a longer distance to reach the swing arm e.g. 514, 534 which is disposed between the first winding module part 510 and the second winding module part 512. In such other example embodiments with the alternative disposition of the swing arm, the shorter travel distance of the interleaf member 502 may advantageously reduce/minimise a loose/dangling length of the interleaf member 502 that is ready for first-securing onto the next empty reel. This may improve the quality of the filled reel e.g. 504.

It will be appreciated that, in this exemplary embodiment, the interleaf module 500, 532 is a passive device which does not actively feed/drive the interleaf member 502 to the reel 504. In this exemplary embodiment, the first winding module part 510 is responsible for retrieving/drawing in the interleaf member 502 into the reel 504 during rotation.

Figure 6A:
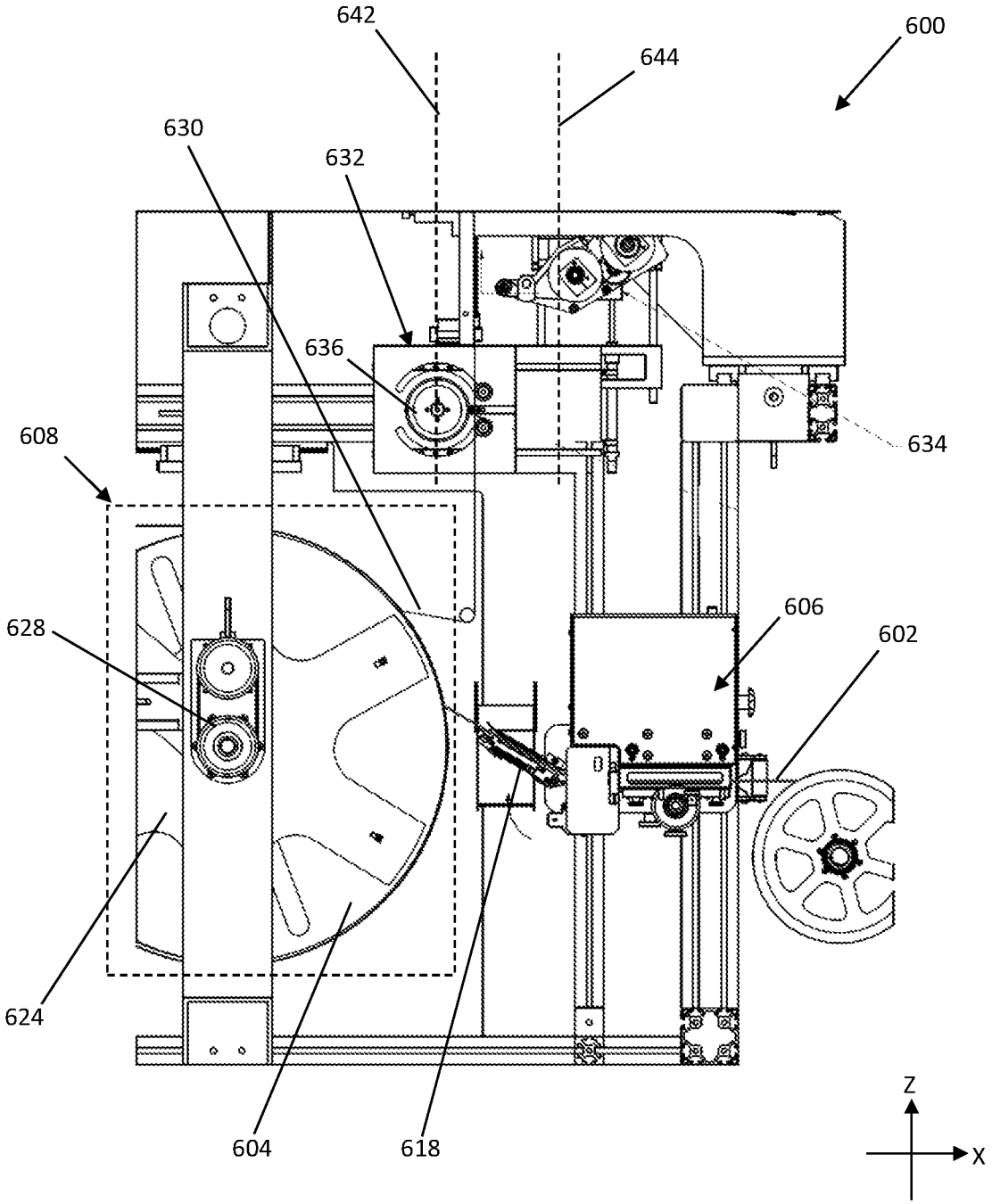
FIG. 6A is a first schematic top view drawing of a winding apparatus for illustrating a winding operation of a product strip onto a reel in an example embodiment.
Figure 6B:
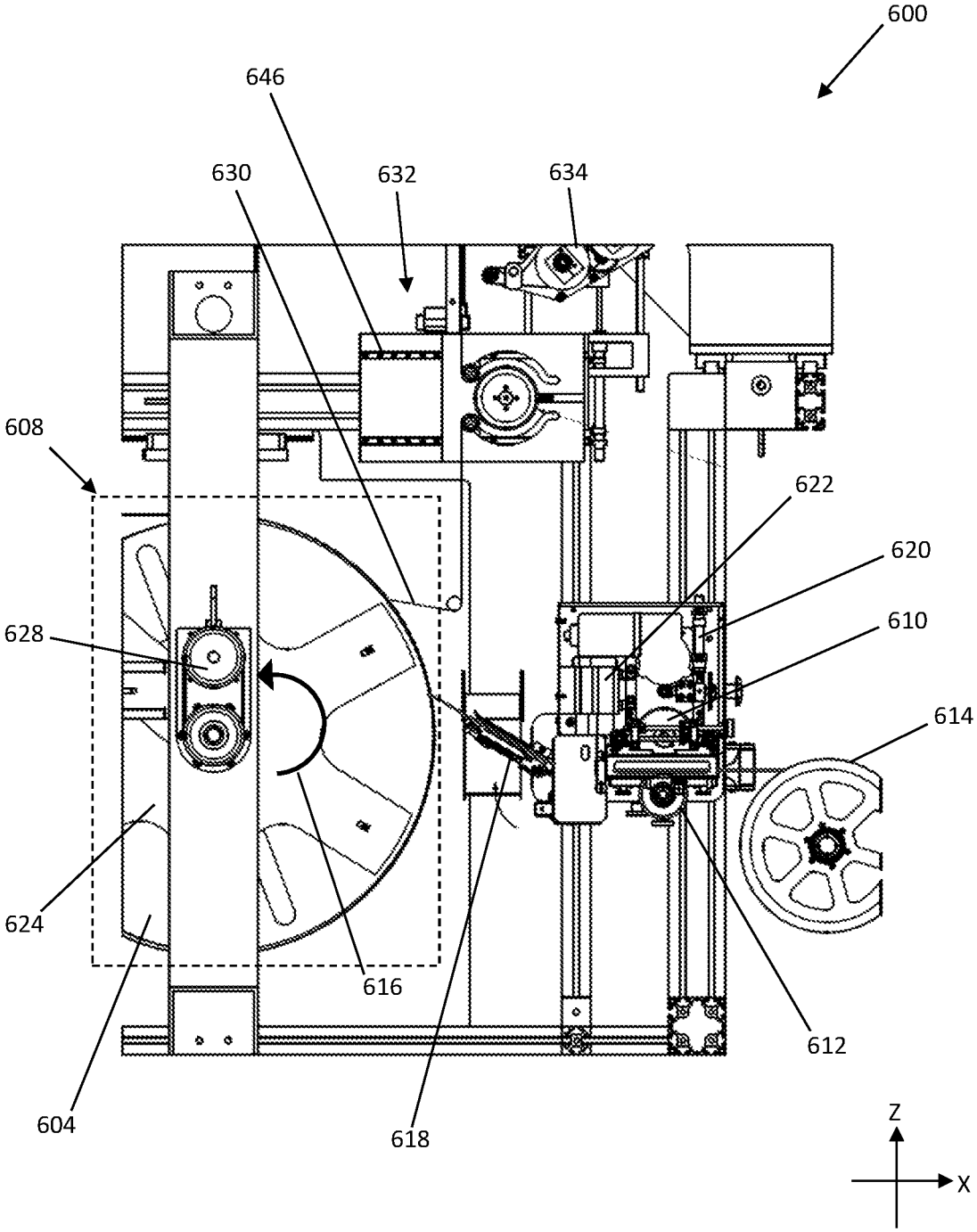
FIG. 6B is a second schematic top view drawing of the winding apparatus showing internals of a number of components of the example embodiment.

FIG. 6A is a first schematic top view drawing of a winding apparatus 600 for illustrating a winding operation of a product strip 602 onto a reel 604 in an example embodiment. FIG. 6B is a second schematic top view drawing of the winding apparatus 600 showing internals of a number of components of the example embodiment.

The winding apparatus 600 comprises a feeder module 606 for supplying the product strip 602 and a first winding module part 608 for receiving the product strip 602 from the feeder module 606 and winding the product strip 602 onto the reel 604.

The feeder module 606 comprises a motorised feed roller 610 (compare 410 of FIG. 4A) and an passive/idling (i.e. non-motorised) roller 612 (compare 412 of FIG. 4A) for receiving the product strip 602 from an accumulator unit 614 (compare 414 of FIG. 3) and conveying the product strip 602 to the reel 604 as the reel 604 is being rotated by the first winding module part 608 in an anticlockwise direction as indicated by the arrow 616. The feeder module 606 further comprises a swivel chute 618 e.g. a motorised swivel chute 618 (compare 418 of FIG. 4A) rotatably mounted at one end to the feeder module 606, a feed motor engage cylinder 620 (compare 420 of FIG. 4A) coupled to the motorised feed roller 610, a cutter cylinder 622 (compare 422 of FIG. 4A) for cutting the product strip 602 when a target quantity of product to be wound onto the reel 604 is reached. The feeder module 606 functions substantially similarly to the feeder module 400 of FIG. 4A.

The first winding module part 608 comprises an end-effector/holder 624 (compare 224 of FIG. 2) for engaging/grasping/gripping/holding the reel 604, an actuator (compare 226 of FIG. 2) for moving the end-effector 624 along the vertical Y-axis (i.e. along an axis into the paper) of the winding apparatus 600, and a motor 628 (compare 228 of FIG. 2) for rotating the end-effector 624 about the vertical Y-axis of the winding apparatus 600. The first winding module part 608 functions substantially similarly to the first winding module part 218 of FIG. 2.

In the example embodiment, the winding apparatus 600 further comprises an interleaf module (not shown) for dispensing/supplying an interleaf member 630, a tensioner 632 for applying a tension on the interleaf member 630, and a first securing member dispenser 634. In the example embodiment, the first securing member dispenser 634 is an adhesive tape dispenser 634 e.g. a double-sided tape dispenser 634 for dispensing double-sided tape. It will be appreciated that the first securing member is not limited to an adhesive tape such as a double-sided tape and may include other forms of securing such as liquid adhesive compounds e.g. glue and the like.

While the interleaf module is not shown in FIGS. 6A and 6B, it will be appreciated that the interleaf module functions substantially similarly to the interleaf module 500 of FIG. 5A. The interleaf module functions to supply a strip/strand of the interleaf member 630 e.g. interleaf paper 630 from an interleaf member roll (compare 324 of FIG. 3A, 524 of FIG. 5A) for winding onto the reel 604. The interleaf member 630 is wound together with the product strip 602 onto the reel 604 such that the interleaf member 630 is disposed between any two adjacent layers of product strip 602.

The tensioner 632 comprises a tensioning roller 636 for tensioning the interleaf member 630, an electromagnetic brake coupled to the tensioning roller 636 for rotating the tensioning roller 636, and an encoder for measuring and controlling a position of the first securing member to be applied and/or that has been applied onto the interleaf member 630. The electromagnetic brake and encoder are positioned below the tensioning roller 636 along the Y-axis and therefore obscured from view by the tensioning roller 636 in FIG. 6A. The tensioning roller 636 may be made from polymeric material such as, but not limited to, urethane. In the example embodiment, the tensioner 632 is configured to apply a controlled and/or substantially constant tension on the interleaf member 630. The tensioner 632 is configured to switch between a disengaged position 642 as shown in FIG. 6A and an engaged position 644 as shown in FIG. 6B. As shown in FIG. 6A, in the disengaged position 642, the tensioning roller 636 is positioned such that tension is not applied on the interleaf member 630. Compare the relatively unaffected length of the interleaf member 630 passing by the tensioning roller 636. In the disengaged position 642, the tensioning roller 636 is not obstructing/blocking a dispensing path of the first securing member dispenser 634 such that a length of double-sided tape is allowed to pass through from the double-sided tape dispenser 634 to the reel 604. As shown in FIG. 6B, in the engaged position 644, the tensioning roller 636 is laid over/contacting/pressing against the interleaf member 630 and is arranged to apply a controlled tension on the interleaf member 630 as the first winding module part 608 rotates the reel 604. The tensioning roller 636 is configured to translate along a linear track 646 to move between the disengaged position 642 and the engaged position 644. In the engaged position 644, the amount of tension applied may be controlled by varying a supply of current and/or voltage to the electromagnetic brake below the tensioning roller 636. In the engaged position 644, the tensioning roller 636 is obstructing/blocking the dispensing path of the first securing member dispenser 634 such that double-sided tape may be obstructed in passing through.

It will be appreciated that the tensioning roller 636 of the tensioner 632 moves to the disengaged position 642 only when allowing interleaf member 630 applied with an instance of a first-securing member to pass through. Other than that, the tensioning roller 636 of the tensioner module 632 is maintained in the engaged position 644 to maintain tension in the interleaf member 630. This may provide a form of control and support with the application of the tension.

The first securing member dispenser 634 e.g. double-sided tape dispenser 634 is configured to apply an instance/length of a first securing member e.g. double-sided tape such that a starting portion of the interleaf member 630 is first-adhered/secured/anchored to a hub of the reel 604, and to apply another instance/length of the first securing member e.g. double-sided tape upon completion of winding of the product strip 602 by the first winding module part 608 to end-secure an ending portion of the interleaf member 630 to the reel 604.

The following paragraphs describe the sequence of a winding operation of the product strip 602 onto the reel 604 using the winding apparatus 600 in the example embodiment.

Prior to a winding operation of the product strip 602, the first end-effector 624 engages/grips and aligns an empty reel 604 to an operative position. A swing arm (compare 514 of FIG. 5A) swivels a starting portion of an interleaf member 630 having an instance of the first-securing member e.g. double-sided tape applied thereon onto the hub of the reel 604. The first winding module part 608 rotates the empty reel 604 to wind the interleaf member 630 about the hub of the reel 604 for a few rounds (e.g. about two to about five rounds) to properly secure/anchor the interleaf member 630 onto the hub of the reel 604.

After the interleaf member 630 is secured onto the hub of the empty reel 604, the feeder module 606 proceeds to feed/transmit a pre-programmed threading length (i.e. a starting portion) of the product strip 602 to the hub of the reel 604. The accumulator unit 614 receives the product strip 602 from an external machine and the output roller unit of the accumulator unit 614 disposed immediately prior to the feeder module 606 orientates the product strip 602 such that the product strip 602 is positioned with its planar surfaces substantially parallel to the vertical plane (compare X-Y plane) of the winding apparatus 600. The product strip 602 is then fed in this orientation into the feeder module 606. During feeding of the threading length of the product strip 602, the motorised feed roller 610 and passive roller 612 of the feeder module 606 are engaged to (i.e. contacting) the product strip 602. Rotation of the motorised feed roller 610 conveys the threading length of the product strip 602 along a horizontal path (compare X-axis). The motorised swivel chute 618 of the feeder module 606 rotates to direct/guide the threading length of the product strip 602 to the hub (i.e. inner reel position) of the reel 604 while the reel 604 is rotating. An encoder, e.g. rotary encoder (not shown), on the feeder module 606 may be used to measure a feeding length of the product strip 602 for threading.

After the product strip 602 is contacted and wound onto the hub of the reel 604, the motorised feed roller 610 and passive feed roller 612 of the feeder module 606 disengage (i.e. break contact) from the product strip 602. Rotation of the first winding module part 608 causes the product strip 602 to be wound onto the reel 604. The product strip 602 is arranged to be wound around the reel 604 together with the interleaf member 630 such that each layer of product strip 602 is sandwiched by the interleaf member 630. A rotation speed of the reel 604 may vary based on a relative position of a dancer roller unit (not shown) of the accumulator unit 614. The rotation speed may increase as a loop of buffer product strip 602 in the accumulator unit 614 increases and decrease as the loop of buffer product strip 602 in the accumulator unit 614 decreases.

As the coiling diameter of the product strip 602 around the hub of the reel 604 increases, the motorised swivel chute 618 changes its feeding angle based on feedback received by a processing module (compare 106 of FIG. 1). From the start of the winding operation, the rotation speed of the reel 604 may gradually increase and then be maintained at a substantially constant level to wind the product strip 602, before gradually decreasing and stopping when the reel 604 is filled with the product strip 602.

As the reel 604 is being rotated by the first winding module part 608, a counting sensor, e.g. optical sensor, on the feeder module 606 counts the number of products that is being wound onto the reel 604. When a target number of products e.g. 20,000 products is counted, the feed rollers 610, 612 of the feeder module 606 engages (i.e. contacts) to hold the product strip 602 in position to stop supply of the product strip 602 to the first winding module part 608 and to prevent the product strip 602 from dropping off. The motorised feed roller 610 does not rotate when holding the product strip 602 in position.

While the motorised feed roller 610 and passive feed roller 612 of the feeder module 606 are holding the product strip 602 in position, incoming product strip 602 from the external machine e.g. stamping press machine is held in the accumulator unit 614. While the motorised feed roller 610 and passive feed roller 612 of the feeder module 606 are holding the product strip 602 in position, the cutter cylinder 622 of the feeder module 606 cuts the product strip 602 breadthwise. The counting sensor resets to zero after the product strip 602 is cut (i.e. ready for the next reel). It will be appreciated that the interleaf member 630 is not cut at the same time as the product strip 602. The interleaf member 630 is cut at a later stage and the cutting depends on user-programmed settings for the length of the interleaf member 630 desired for end-packaging.

After the product strip 602 is cut, if a sample of the product strip 602 is required for performing QA (quality assurance) test(s), the feeder module 606 is configured to further feed a short, programmed length of product strip 602. The cutter cylinder 622 of the feeder module 606 then cuts the product strip 602 again such that the sample of the product strip 602 may drop onto a sample tray, and the counting sensor resets to zero (i.e. ready for the next reel).

After the product strip 602 is cut, the first winding module part 608 continues to rotate for a pre-programmed number of rounds, or continues to rotate for a pre-programmed duration, for a pre-programmed length of interleaf member 630 to wrap the filled reel 604 for subsequent end-packaging.

After the product strip 602 is cut, the following sequence of events occurs at the interleaf module. A first instance/strip of the first-securing member e.g. double-sided tape for end-securing of the current filled reel 604 is applied by the first-securing member dispenser 634 onto the interleaf member 630. The tensioning roller 636 of the tensioner 632 moves to the disengaged position 642 to allow the interleaf member 630 with the first strip of double-sided tape applied thereon to pass through (otherwise it is appreciated that the double-sided tape may be stuck onto the tensioning roller 636). The tensioning roller 636 of the tensioner 632 moves to the engaged position 644 to maintain tension in the interleaf member 630 after the interleaf member 630 with the first strip of double-sided tape applied thereon has passed through. A second instance/strip of the first-securing member e.g. double-sided tape for first-securing of the next empty reel 604 is applied by the first-securing member dispenser 634 onto the interleaf member 630 at a pre-programmed distance away from the first strip of double-sided tape. The tensioning roller 636 of the tensioner 632 moves to the disengaged position 642 to allow the interleaf member 630 with the second strip of double-sided tape applied thereon to pass through. The tensioning roller 636 of the tensioner 632 moves to the engaged position 644 to maintain tension in the interleaf member 630 after the interleaf member 630 with the second strip of double-sided tape applied thereon has passed through.

The interleaf member 630 with the first and second strips of double-sided tape applied thereon are conveyed to the filled reel 604. Once the first strip of double-sided tape is inside the filled reel 604, the first winding module part 608 stops rotating. The swing arm (compare 514 of FIG. 5B) moves e.g. downwards via actuation of the down cylinder (compare 520 of FIG. 5B) to grip and thereafter cut the interleaf member 630 breadthwise at a portion of the interleaf member 630 between the sites of application of the first and second strips of double-sided tape. With the cut, the portion of the interleaf member 630 with the first strip of double-sided tape may be used for end-securing relating to the current filled reel 604 and the portion of the interleaf member 630 with the second strip of double-sided tape may be used for first-securing relating to a next reel for winding. It will be appreciated that timing is co-ordinated for the swing arm (compare 514 of FIG. 5B) to grip the interleaf member 630 at a position between the sites of application of the two strips of double-sided tape. The timing is programmed based on known parameters. The first strip of double-sided tape is applied as an end-securing member to the current filled reel 604 that is being engaged by the first winding module part within its last round of rotation.

After the interleaf member 630 is cut and after the first strip of double-sided tape has end-secured the interleaf paper 630 to the filled reel 604, the end-effector 624 releases its engagement/grip on the filled reel 604 and the filled reel 604 is transferred to another station of the winding apparatus 600 for end-packaging. For example, a bottom transfer arm (compare 222 of FIG. 2) may be used to transfer the filled reel 604 to a second winding module part (compare 220 of FIG. 2) for end packaging.

The interleaf member 630 with the second strip of double-sided tape applied thereon is held by the swing arm (compare 514 of FIG. 5B). During transfer of the filled reel 604 to the second winding module part (compare 220 of FIG. 2), the first end-effector 624 actuates along the vertical Y-axis (i.e. along an axis into the paper) of the winding apparatus 600 to retrieve/pick up a next empty reel e.g. 604 and aligns the next empty reel e.g. 604 at the operative position. The swing arm (compare 514 of FIG. 5B) swivels the interleaf member 630 with the second strip of double-sided tape applied thereon onto the hub of the next empty reel 604. The first winding module part 608 rotates the next empty reel 604 to wind the interleaf member 630 about the hub of the next empty reel 604 to properly secure/anchor the interleaf member 630 onto the hub. After the interleaf member 630 is secured onto the hub of the next empty reel 604, the feeder module proceeds to feed a threading length of product strip 602 onto the hub of the reel 604 and winding operation is repeated for the next empty reel 604.

It will be appreciated that while the first end-effector 624 is retrieving the next empty reel e.g. 604, a second end effector of the second winding module part may also actuate along the vertical Y-axis (i.e. along an axis into the paper) of the winding apparatus 600 to pick retrieve/pick up the filled reel 604 from the bottom transfer arm for facilitating end-packaging (e.g. cross-securing and labelling). The winding apparatus 600 may further comprise one or more end-packaging modules for end-packaging. The one or more end-packaging modules may comprise a cross-securing module, a labelling module and the like.

Figure 6C:
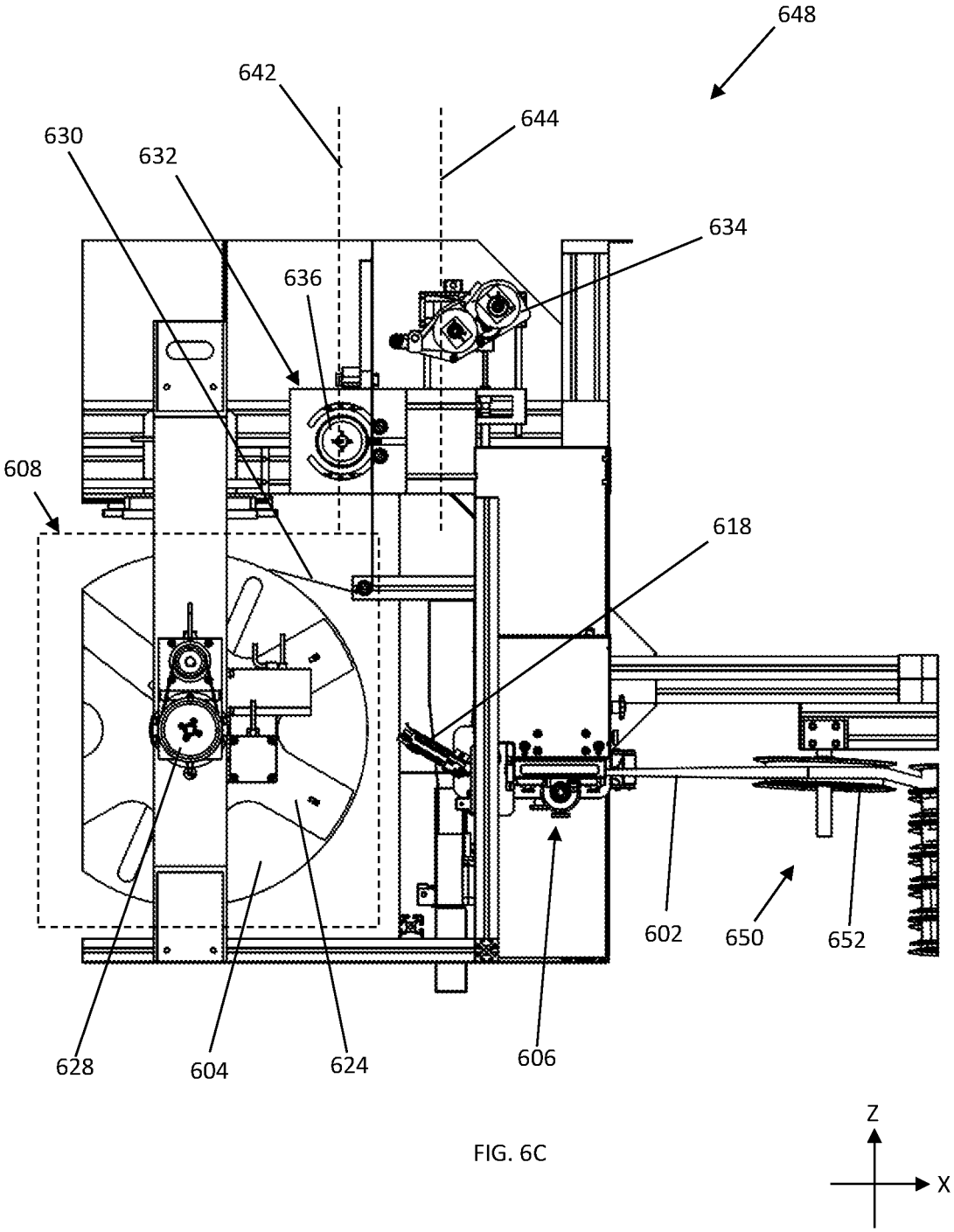
FIG. 6C is a first schematic top view drawing of a winding apparatus for illustrating a winding operation of a product strip onto a reel in another example embodiment.

FIG. 6C is a first schematic top view drawing of a winding apparatus 648 for illustrating a winding operation of a product strip 602 onto a reel 604 in another example embodiment. FIG. 6D is a second schematic top view drawing of the winding apparatus 648 for illustrating the winding operation of the product strip 602 onto the reel 604 in the another example embodiment. The winding apparatus 648 is substantially similar in structure and function to the winding apparatus 600. For ease of understanding, components of the winding apparatus 648 that are identical in structure and function as corresponding components of the winding apparatus 600 are labelled with the same reference numerals.

The winding apparatus 648 comprises an accumulator unit 650 that is different in structure from the accumulator unit 614 of FIG. 6A and FIG. 6B. The accumulator unit 650 is substantially similar in structure to the accumulator unit 344 of FIG. 3C and FIC. 3D. The accumulator unit 650 comprises an output roller unit 652 that is oriented vertically in the X-Y plane and is disposed in relation to (e.g. aligned to) the feeder module 606 such that the product strip 602 is arranged to be fed/transmitted into the feeder module 606. It will be appreciated that the output roller unit 652 of the accumulator unit 650 is different from the output roller of the accumulator unit 614 which is oriented horizontally in the X-Z plane. In other words, the output roller unit 652 does not function as an adapter/converter to re-orientate the product strip 602 for winding onto the reel 604. Instead, the accumulator unit 650 of the winding apparatus 648 is positioned to be spaced further apart from the feeder module 606 as compared to the accumulator unit 614 of the winding apparatus 600. This provides a space/gap which allows the product strip 602 to rotate/twist 90 degrees (due to end-to-end holding forces) as the product strip 602 is being dispensed from the output roller 652 of the accumulator unit 650 and fed/transmitted into the feeder module 606. That is, the product strip 602 that is being dispensed immediately from the output roller unit 652 of the accumulator unit 650 is orientated with its planar surface in a horizontal position (i.e. substantially parallel to the X-Z plane). The feeder module 606 receives the product strip 602 with the planar surface of the product strip in a vertical position and conveys the product strip 602 to the reel 604 in such a position. As the product strip 602 travels to the feeder module 606, the product strip rotates 90 degrees such that its planar surface is in a vertical position (i.e. substantially parallel to the X-Y plane) when entering the feeder module 606. This re-orientation allows the product strip 602 to be wound onto the reel 604 that is in a horizontal position. It will be appreciated that the space/gap allows the product strip 602 to be rotated/twisted without being deformed or tensed in a manner which would affect the quality of the product strip 602.

Figure 7A:
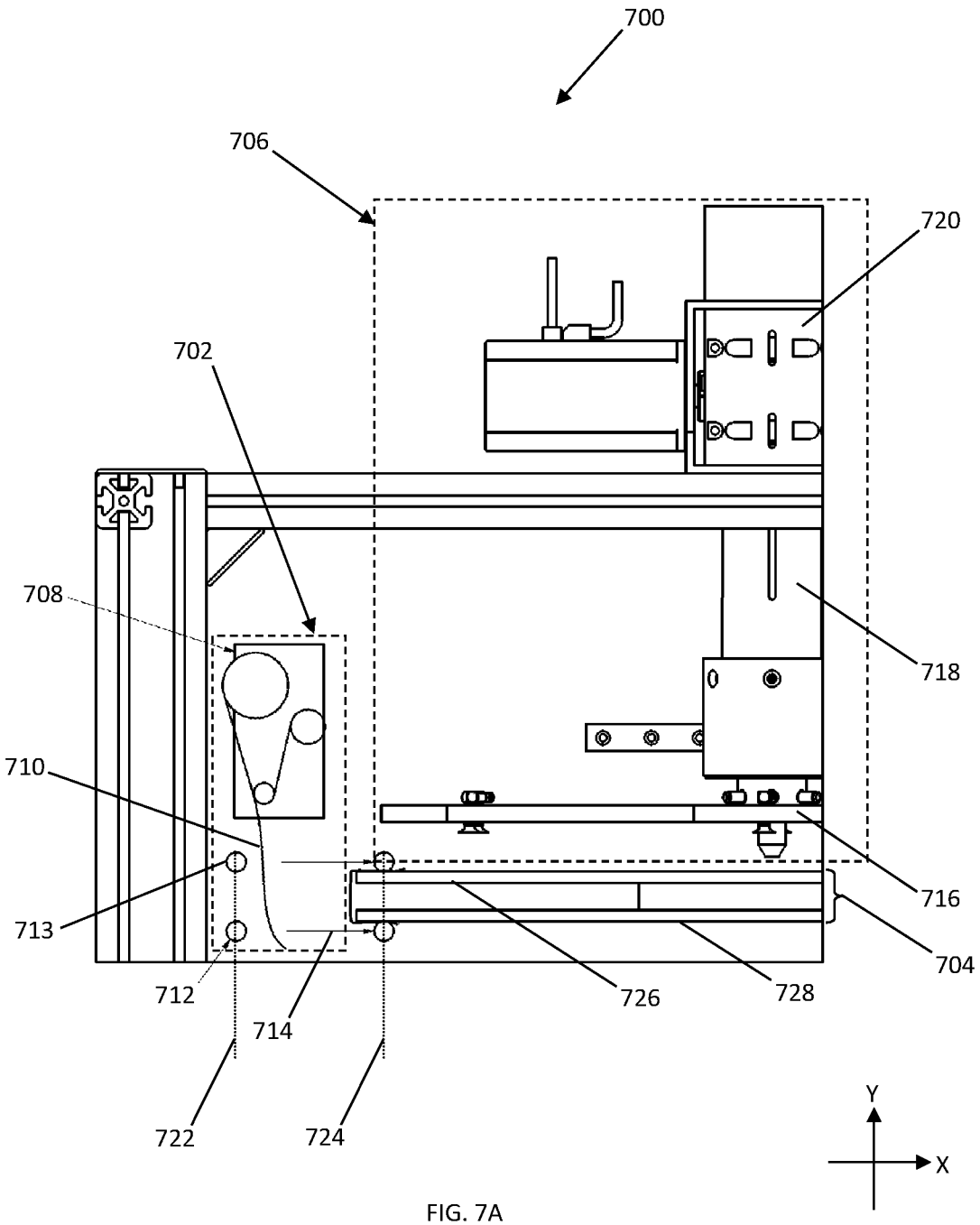
FIG. 7A is a first schematic side cross-sectional view drawing of a winding apparatus for illustrating a cross-securing operation in an example embodiment.
Figure 7B:
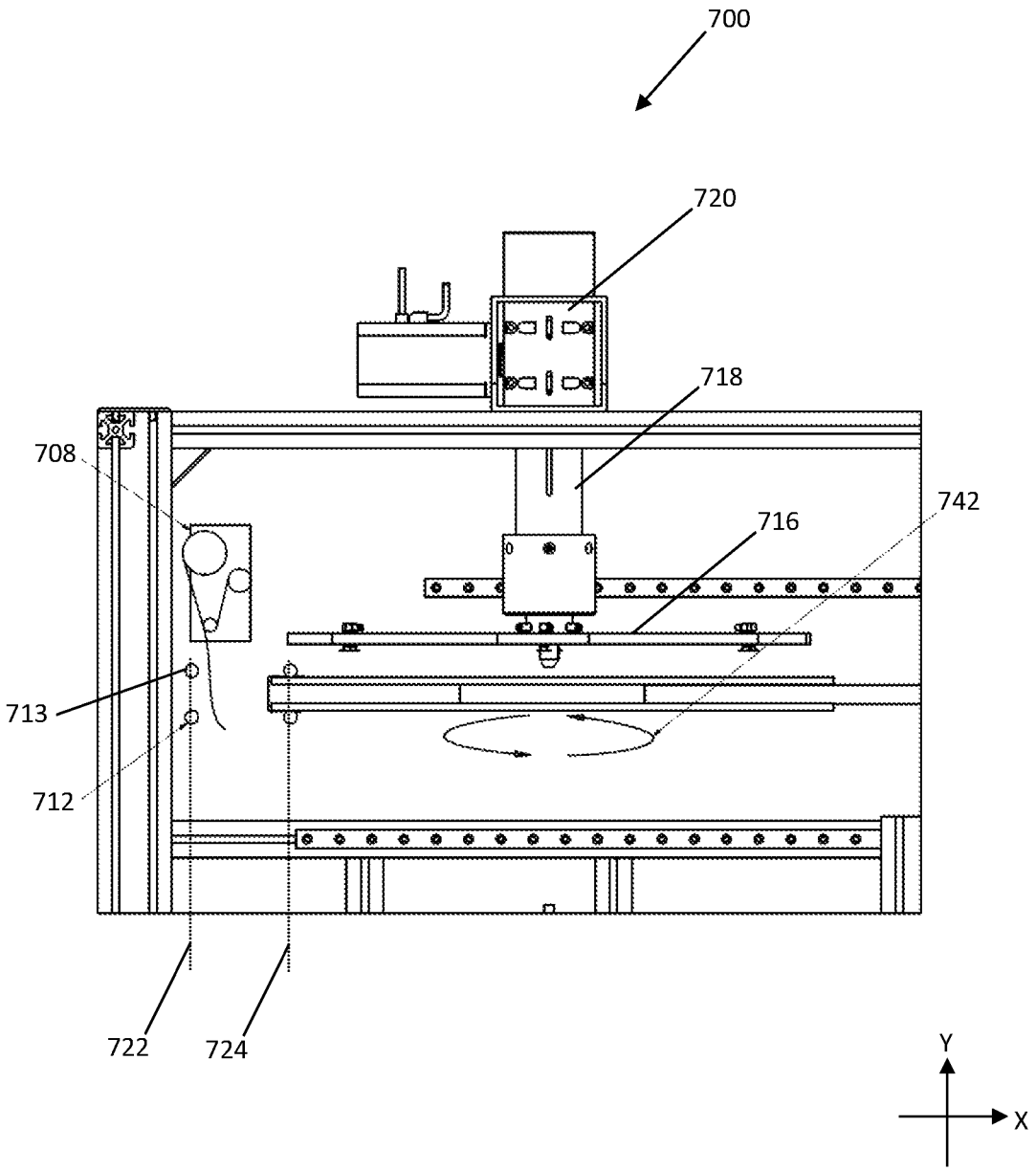
FIG. 7B is a second schematic side cross-sectional view drawing of the winding apparatus in the example embodiment.

FIG. 7A is a first schematic side cross-sectional view drawing of a winding apparatus 700 for illustrating a cross-securing, e.g. cross-taping, operation in an example embodiment. FIG. 7B is a second schematic side cross-sectional view drawing of the winding apparatus 700 in the example embodiment. The winding apparatus 700 comprises a cross-securing module 702 e.g. a cross-taping module 702 for securing one or more edge portions of a reel 704 in engagement with a second winding module part 706 (compare second winding module part 220 of FIG. 2).

The cross-taping module 702 comprises a securing member dispenser 708 e.g. a tape dispenser 708 and a pair of press rollers 712, 713 disposed in proximity to the tape dispenser 708. The securing member dispenser 708 e.g. the tape dispenser 708 functions to supply a second securing member 710 e.g. an adhesive tape 710. The adhesive tape 710 may be pre-cut tape 710. The adhesive tape 710 may be filament tape. The pair of press rollers 712, 713 is disposed such that the second securing member 710 e.g. the adhesive tape 710 is positioned between the pair of press rollers 712, 713 and the reel 704. The pair of press rollers 712, 713 is configured to translate along a cross-securing path 714 e.g. a substantially horizontal path 714 along the X-axis as shown, towards the reel 704 to apply the adhesive tape 710 onto one or more edge portions of the reel 704.

The second winding module part 706 e.g. a filled reel pick-up head 706 comprises an end-effector/holder 716 for engaging/grasping/gripping/holding the reel 704, an actuator 718 for moving the end-effector 716 along a second alignment path e.g. a substantially vertical path along the Y-axis as shown, and a motor 720 for rotating the end-effector 716 about its longitudinal axis which is substantially parallel to the vertical axis of the winding apparatus 700, i.e. rotation about the Y-axis as shown. The filled reel pick-up head 706 functions substantially similarly to the second winding module part 220 of FIG. 2. In the example embodiment, the second winding module part 706 is configured to move along the substantially vertical path along the Y-axis to position the reel 704 in relation to the cross-taping module 702, such that the edge portion of the reel 704 is adjacent to the pair of press rollers 712, 713 along the cross-securing path 714. That is, the cross-taping module 702 relies on a forward movement to roll the dispensed tape 710 over a reel corner. The second winding module part 706 is further configured to rotate the reel 704 by a pre-programmed angle about the longitudinal axis of the reel 704 during cross-taping operation to facilitate one or more applications of the second securing member 710 over the one or more edge portions of the reel 704.

During a cross-taping operation, the end effector 716 engages/grips the reel 704 which is wound with a product strip (i.e. a filled reel) and positions the reel 704 at a cross-taping position as shown in FIG. 7A. At the cross-taping position, the pair of press rollers 712, 713 from the cross-taping module 702 translates along the substantially horizontal path 714 from a default position 722 towards a taping position 724 such that edge portions of a top flange 726 and bottom flange 728 of the reel 704 are sandwiched between the pair of press rollers 712, 713. The translational movement of the pair of press rollers 712, 713 causes the pair of press rollers 712, 713 to contact a first piece of adhesive tape e.g. the pre-cut adhesive tape 710, that is dispensed from the tape dispenser 708 and disposed between the default position 722 and the taping position 724, and to be rolled/applied over the edge portions of the top flange 726 and the bottom flange 728 of the reel 704.

After the first piece of adhesive tape 710 is applied, the pair of press rollers 712, 713 translates away from the reel 704 back to the default position 722 from the taping position 724. To facilitate application of a second and subsequent pieces of adhesive tape 710 at a second and subsequent edge portions of the reel 704, the end-effector 716 that is holding the reel 704 rotates the reel 704 about its longitudinal axis, i.e. rotation about the vertical axis or Y-axis as shown, by an angle e.g. 90 degrees, such that the second and subsequent edge portions of the reel 704 to be taped is aligned to the taping position 724. In the example embodiment, the reel 704 rotates in a direction, e.g. an anti-clockwise direction as indicated by the arrow 742. After each rotation, the pair of press rollers 712, 713 is translated from the default position 722 to the taping position 724 to similarly roll/apply adhesive tape over the edge portions of the top flange 726 and the bottom flange 728 of the reel 704. It will be appreciated that the angle of rotation can be pre-programmed depending on user preference such as the angular separation between consecutive adhesive tapes and the number of adhesive tapes to be applied.

After the cross-taping operation is completed, i.e. a desired number of rotation and application of adhesive tape is achieved, with the pair of press rollers 712, 713 at the default position 722, the end effector 716 that is engaged/gripping the reel 704 translates downwards along the substantially vertical path to a drop-off position where the end-effector 716 releases its engagement/grip on the reel 704, thus allowing the reel 704 to be deposited/placed at the drop-off position. The end-effector 716 subsequently translates upwards along the substantially vertical path in preparation for receiving a next reel e.g. 704.

While FIG. 7A and FIG. 7B do not show an end-effector (compare 244 of FIG. 2) of a bottom transfer arm (compare 222 of FIG. 2), it will be appreciated that in other example embodiments, the end-effector 716 of the second winding module part 706 may engage the top flange 726 and the end-effector of the bottom transfer arm may engage the bottom flange 728 of the reel 704 at a same time, for end-packaging e.g. cross securing, labelling etc. Engagement of the end-effector of the bottom transfer arm to the bottom flange 728 of the reel 704 may provide additional support for the weight of the reel 704 during end-packaging. In such other example embodiments, the cross-taping module 702 may be positioned such that the actuator 718 does not have to translate along the second alignment path to position the reel 704 in relation to the cross-taping module 702. In such other example embodiments, the end-effector of the bottom transfer arm proceeds to release the engagement/grip on the bottom flange 728 of the reel 704 after end-packaging is completed, and moves away from under the second winding module part 706 to facilitate placing/drop-off of the reel 704.

Figure 7C:
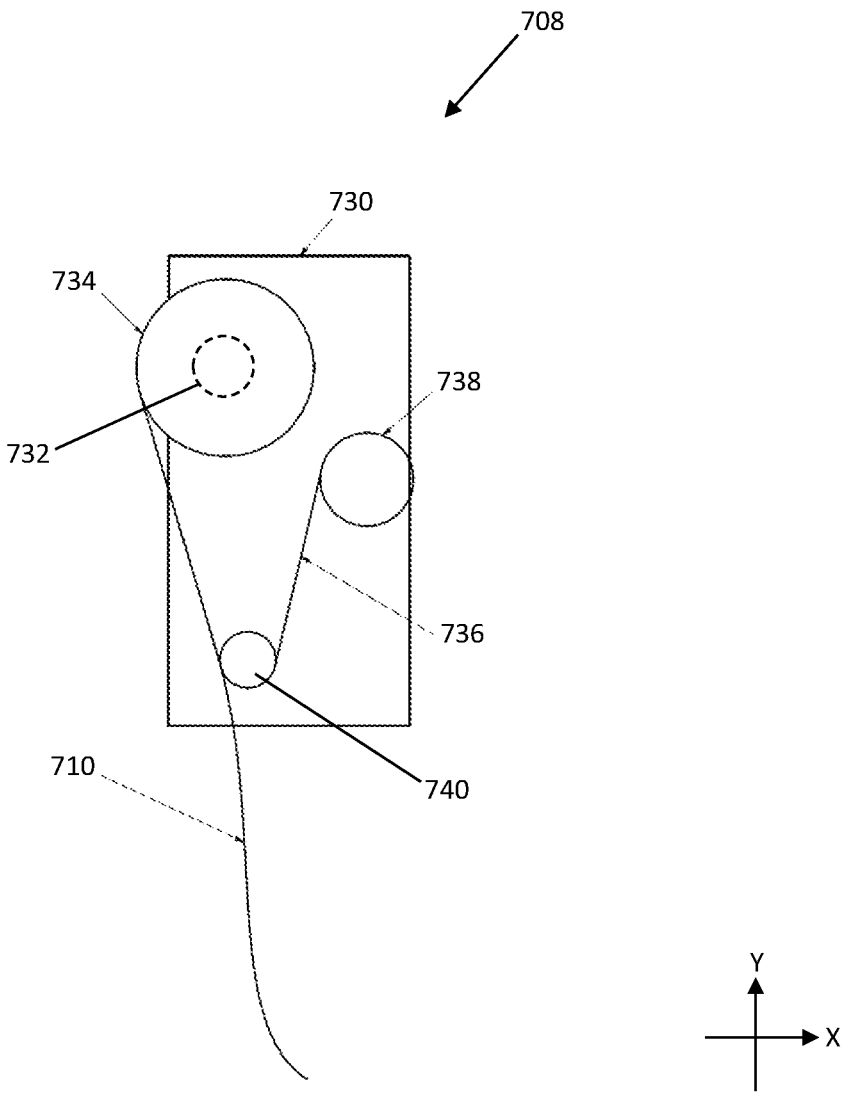
FIG. 7C is a schematic enlarged view drawing of a tape dispenser in the example embodiment.

FIG. 7C is a schematic enlarged view drawing of the tape dispenser 708 in the example embodiment. The tape dispenser 708 comprises a base 730, a support roller 732 mounted on the base 730 for rotatably receiving a roll of tape 734. The roll of tape 734 comprises the adhesive tape e.g. pre-cut tape 710 adhered to a supporting substrate/strip/strand/layer of non-adhesive tape carrier 736. That is, the adhesive tape may be applied upon a peel-off/separation from the tape carrier 736. The tape dispenser 708 further comprises a winder 738 and an output roller 740 mounted on the base 730. The support roller 732, winder 738 and output roller 740 are substantially cylindrical in shape and are each configured to rotate about its respective longitudinal axis, rotation about an axis into the paper, i.e. about the Z-axis. The winder 738 is configured to rotate and wind the strip of tape carrier 736 onto itself, thereby separating the pre-cut tape 710 from the strip of tape carrier 736. The output roller 740 is configured to cooperate with the winder 738 by dispensing the pre-cut tape 710 which has been separated from the tape carrier 736. It will be appreciated that the tape dispenser 708 may be, but not limited to, a standard tape dispenser known in the art, e.g. an off-the-shelf standard tape dispenser, which is suitable for use/integration with the cross-taping module 702 of FIG. 7A and FIG. 7B to roller a fixed length of tape.

The example embodiment may further comprise a label dispenser (not shown) for applying labels e.g. pre-printed labels onto the reel 704. The label dispenser may be integrated into the winding apparatus 700 using a similar tape dispenser such as the tape dispenser 708. The label dispenser may be, but not limited to, a standard tape dispenser known in the art. The operation for the label dispenser may be similar to the cross-taping module 702. The label may be applied using a pair or a single press roller to press the label onto a surface of a flange, e.g. the top flange 726, of the reel 704. The labels may be pre-printed labels from bar code printers. The pre-printed labels may display information such as production lot, date of production and bar code.

Figure 8A:
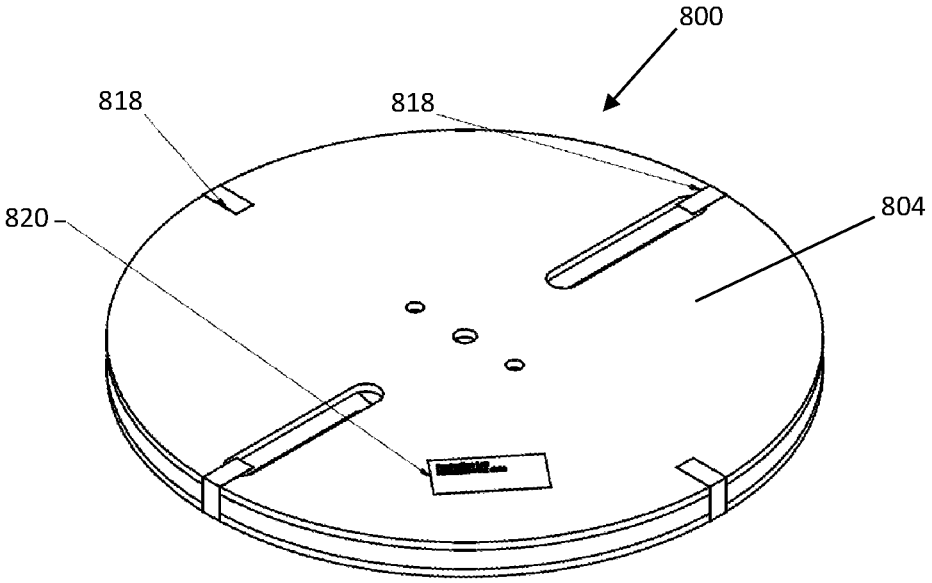
FIG. 8A is a schematic perspective view drawing of a reel in an example embodiment.
Figure 8B:
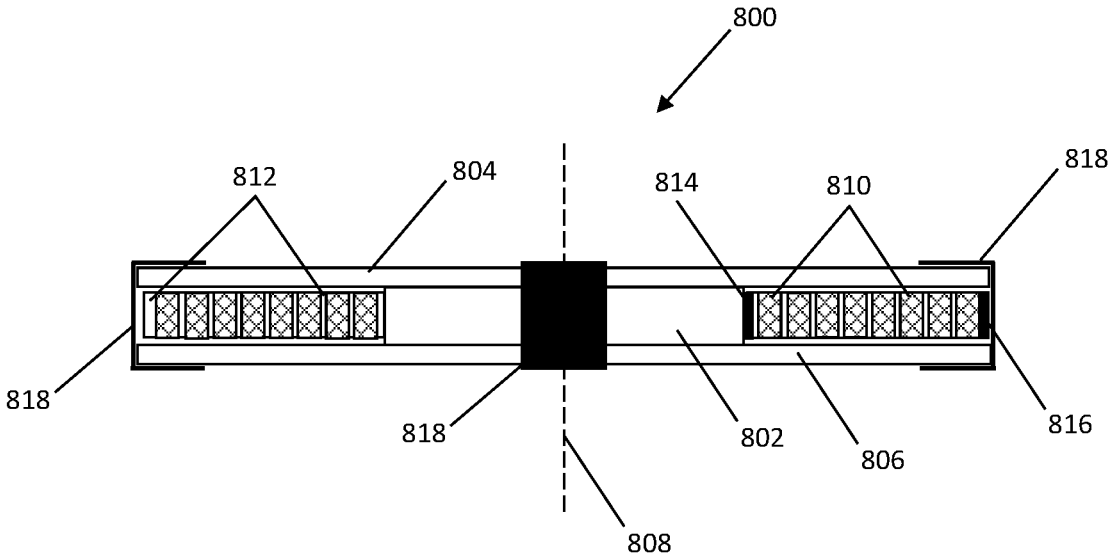
FIG. 8B is a schematic cross-sectional view drawing of the reel in the example embodiment.

FIG. 8A is a schematic perspective view drawing of a reel 800 in an example embodiment. FIG. 8B is a schematic cross-sectional view drawing of the reel 800 in the example embodiment. The reel 800 comprises a cylindrically shaped hub/barrel/stem 802 having a longitudinal axis 808 of rotation, a top flange 804 and a bottom flange 806 disposed at a top and bottom end of the hub 802. The axis 808 may be termed as a vertical axis passing through the hub 802. The flanges 804, 806 are disk-shaped and extend radially from the hub 802 in planes that are substantially normal to the longitudinal axis 808 of the hub 802. The reel 800 functions to store/hold a product strip e.g. of stamped products 810 by allowing the strip of stamped products 810 to be wound onto the hub 802 of the reel 800. The flanges 804, 806 are spaced apart from each other for the winding of the product strip therebetween. It will be appreciated that the reel 800 is known in the art for winding stamped products and its construction, dimensions and material can be customised accordingly to suit product requirement(s).

In the example embodiment, the strip of stamped products 810 are shown in the cross-sectional view drawing of FIG. 8B to fill up the reel 800 by being wound from the hub 802 to the edge of the flanges 804, 806. Each layer of the stamped products 810 may be separated by a layer of interleaf member e.g. interleaf paper 812. The interleaf paper 812 functions to provide a separation layer between adjacent layers of stamped products 810 in order to e.g. protect the stamped products 810 by preventing adjacent layers of stamped products 810 from contacting/rubbing against each other during transport or use. In addition, as the application of excessive tension on the strip of stamped products 810 may cause deformation and/or breakage of the strip or damage to the products, the interleaf paper 812 is provided such that tension is applied instead on the interleaf paper 812 during winding, thereby providing tension in the wound reel in order to properly pack/wind the stamped products 810 onto the reel 800. A first instance of a first securing member e.g. a first length of double-sided tape 814 is applied on a first end portion of the interleaf paper 812 in order to anchor/secure a starting portion (i.e. first-secure) of the interleaf paper 812 onto a portion of the hub 802. A second instance of the first securing member e.g. a second length of double-sided tape 816 is further applied on a second end portion of the interleaf paper 812 in order to secure an ending portion (i.e. end-secure) of the interleaf paper 812 to secure and prevent the stamped products 810 and/or interleaf paper 812 from unravelling from the reel 800.

In the example embodiment, the reel 800 which is fully wound with the stamped products 810 is taped with one or more second securing member e.g. four lengths of adhesive tape e.g. 818 along the circumference of the flanges 804, 806. The lengths of adhesive tape e.g. 818 are taped such that any two consecutive tapes are separated by an angular separation of 90 degrees. It will be appreciated that the number of adhesive tapes to be applied and the respective arrangement can vary depending on user preference and product requirement(s). The reel 800 can also be labelled by applying one or more labels e.g. pre-printed labels e.g. 820 on an outside surface of the flanges e.g. top flange 804. The pre-printed label 820 can be applied onto the reel 800 using one or more press rollers to apply/press the pre-printed label 820 onto the reel flange e.g. top flange 804. The pre-printed label 820 may display information such as production lot, date of production and bar code.

Figure 9:
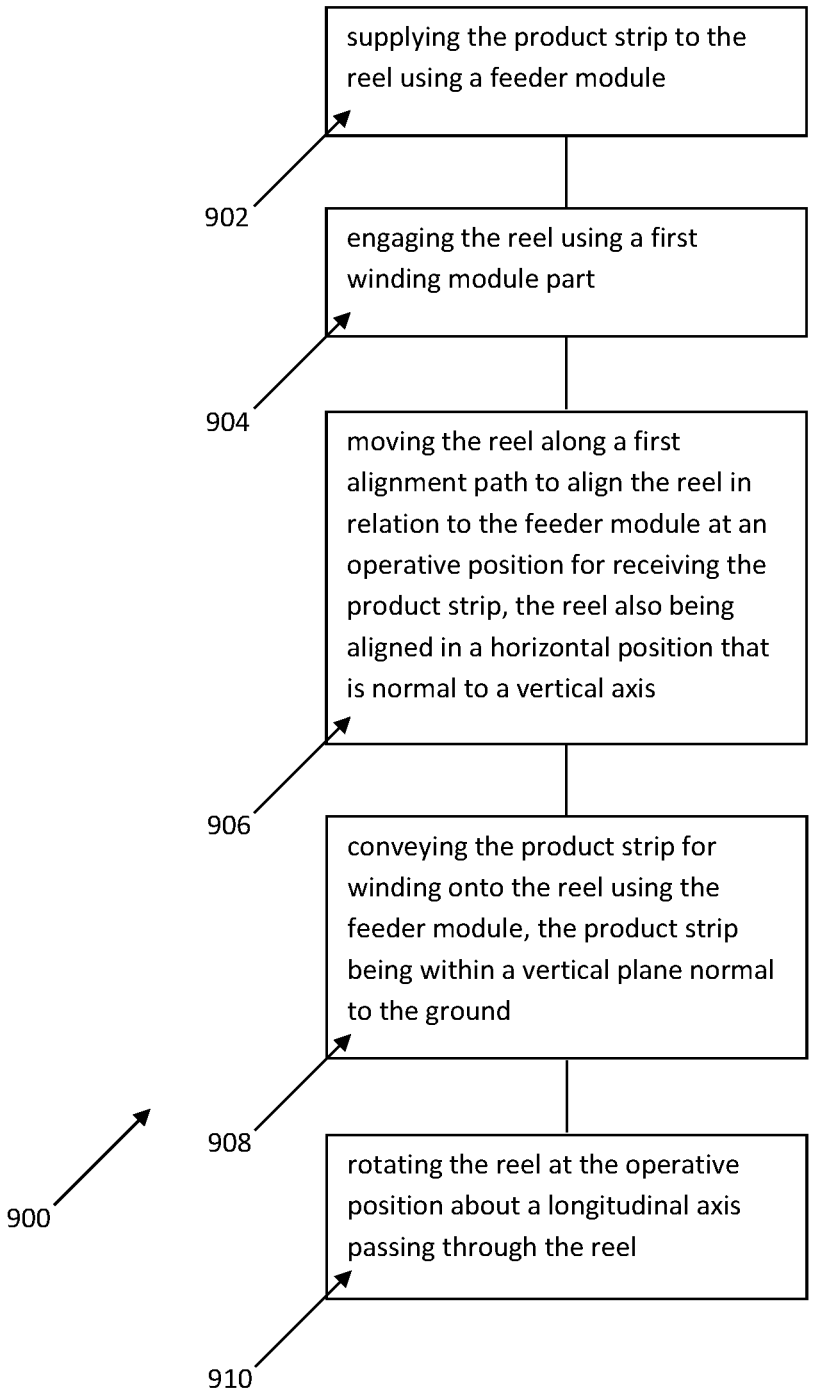
FIG. 9 is a schematic flowchart for illustrating a method of winding a product strip onto a reel using a winding apparatus in an example embodiment.

FIG. 9 is a schematic flowchart 900 for illustrating a method of winding a product strip onto a reel using a winding apparatus in an example embodiment. At step 902, the product strip is supplied to the reel using a feeder module. At step 904, the reel is engaged using a first winding module part. At step 906, the reel is moved along a first alignment path to align the reel in relation to the feeder module at an operative position for receiving the product strip, the reel also being aligned in a horizontal position that is normal to a vertical axis. At step 908, the product strip for winding onto the reel is conveyed using the feeder module, the product strip being within a vertical plane normal to the ground. At step 910, the reel is rotated at the operative position about a longitudinal axis passing through the reel.

In another example embodiment, a non-transitory tangible computer readable storage medium having stored thereon software instructions may be provided. The instructions, when executed by a computer processor e.g. a programmable logic controller (PLC) of a winding apparatus, cause the computer processor to perform a method of winding a product strip onto a reel, by executing the steps comprising supplying the product strip to the reel using a feeder module; engaging the reel using a first winding module part; moving the reel along a first alignment path to align the reel in relation to the feeder module at an operative position for receiving the product strip, the reel also being aligned in a horizontal position that is normal to a vertical axis; conveying the product strip for winding onto the reel using the feeder module, the product strip being within a vertical plane normal to the ground; and rotating the reel at the operative position about a longitudinal axis passing through the reel. It will be appreciated that the steps described herein may be non-sequential and may not be ordered as listed.

In the described example embodiments, the winding apparatus and method thereof may implement a "pick and place" concept whereby a first winding module part e.g. a top head winding module part is capable of moving linearly downwards, i.e. along a vertical axis, to engage/pick an empty reel and to move linearly upwards along the same axis to position the empty reel in an operative winding position for winding. The winding apparatus and method thereof may further implement a linear transfer concept for changing of reels. That is, filled reels are transferred horizontally, e.g. via a transfer arm from the first winding module part, to an adjacent second winding module part e.g. a filled reel pick-up head for end-packaging (e.g. cross-taping and labelling) so that the first winding module part is able to proceed with winding a next empty reel while the second winding module part is performing end-packaging. After end-packaging is performed, the second winding module part that is in engagement with or gripping the filled reel deposits/places the filled reel at a drop-off position. This configuration of parallel processing advantageously increases the throughput and efficiency of the winding apparatus and method of winding. This is further augmented/enhanced by a high capacity of standby empty reels for continuous production to minimise machine downtime, and the use of empty and filled reel containers e.g. trollies for minimising machine footprint.

In the described example embodiments, the winding apparatus and method thereof may employ a horizontal reel winding configuration that may be capable of addressing limitations associated with conventional machines that use a vertical reel winding configuration. In a conventional vertical winding configuration, a reel is positioned vertically with the flanges substantially parallel to a vertical plane (e.g. X-Y or Y-Z plane). During vertical winding, the product strip may shift sideways, e.g. left and right, along the hub of the reel, leading to misalignment between different layers of product strip wound onto the reel and resulting in an inferior winding quality. Significant tensioning is typically required to keep the product strip properly aligned onto the reel in a vertical winding configuration.

In contrast, a horizontal winding configuration used in the described example embodiments allows a product strip e.g. stamped products to rest on the reel by gravity during winding e.g. across an entire length of the product strip within the reel that is being wound. This may advantageously result in a superior winding quality as compared to reels that are wound using a vertical reel winding configuration since portions of a product strip disposed on a vertical reel (e.g. along a bottom circumference/arc of a vertical reel) would typically be affected by gravitational force to loosen and result in poorer winding quality. In this respect, there is also better control and manoeuvrability of components such as the product strip, interleaf member, and first securing member in a horizontal winding process as compared to a vertical winding process, since the product strip, interleaf member and first securing member may be disposed at substantially the same horizontal plane of the operative position during horizontal winding. It would thus be relatively easier for a user e.g. a technician to access different parts of the winding apparatus, e.g. for alignment, troubleshooting purposes etc.

In addition, it will be appreciated that certain product strips e.g. products with a more specialised shape/form/profile e.g. irregular-shaped products are not amenable to being wound using a vertical winding configuration as doing so would typically result in poor quality packing (e.g. due to the irregular-shaped product strips shifting sideways e.g. left and right inside the reel during winding). In this respect, winding such product strips using a horizontal winding configuration may provide a higher quality-finish of reeled products.

In the described example embodiments, the winding apparatus and method of winding a product strip may provide a modular approach which utilises a plurality of modules/stations cooperating with one another. For example, the winding apparatus comprises a first station/module for picking up and transferring an empty reel from a stack of empty reels to an operating position for reel winding, and a second station for end-packaging, e.g. cross and label taping, and unloading the filled reel to a stack of filled reels. The first station/module further cooperates with a feeding module which is arranged to feed the product strip in a standing or vertical orientation to wind the product strip onto the hub of a reel positioned in a horizontal position. The components of each module are configured to operate using relatively simple actuation mechanisms and do not require the use of sophisticated/complex robotic arms to e.g. change the reels or perform winding. It will be appreciated that in the described example embodiment, with the alignment of each reel to be wound in a horizontal position that is normal to a vertical axis of the winding apparatus and the transport of the reels in such a position, a winding apparatus may be constructed to be of a sleeker design as compared to conventional winding machines and can occupy a relatively smaller footprint as compared to such winding machines employing sophisticated/complex robotic arms. Such a modular approach using relatively simple actuation mechanisms advantageously enables the winding apparatus and method to be capable of being integrated with existing manufacturing line operations.

Example embodiments of the winding apparatus and method of winding a product strip onto a reel as disclosed herein are further described in the following clauses.

Clause 1. A winding apparatus for winding a product strip onto a reel, the winding apparatus comprising, a feeder module for supplying the product strip to the reel;

a first winding module part that is configured to engage the reel, the first winding module part being further configured to move along a first alignment path to align the reel in relation to the feeder module at an operative position for receiving the product strip;

wherein first winding module part is configured to align the reel in a horizontal position that is normal to a vertical axis of the winding apparatus and the reel is rotatable at the operative position about a longitudinal axis passing through the reel; and wherein the feeder module is arranged to convey the product strip for winding onto the reel, the product strip being within a vertical plane normal to the ground.

Clause 2. The winding apparatus of clause 1, further comprising, a second winding module part disposed adjacent to the first winding module part, said second winding module part being configured for rotating the reel about the longitudinal axis to facilitate packaging of the reel;

a transfer module disposed for movement between the first winding module part and the second winding module part;

wherein the transfer module is configured to engage the reel with the reel in its horizontal position, and to move along a transfer path to convey the reel from the first winding module part to the second winding module part; and wherein the second winding module part is configured to move along a second alignment path to engage the reel from the transfer module and to position the reel in relation to one or more end-packaging modules.

Clause 3. The winding apparatus of clause 1 or 2, further comprising, an accumulator unit coupled to the feeder module, said accumulator unit being configured to receive the product strip from an external machine and to hold a buffer length of the product strip;

wherein the first winding module part and/or the feeder module is capable of varying a rate of supply of the product strip to the reel based on the buffer length of the product strip in the accumulator unit.

Clause 4. The winding apparatus of any one of clauses 1 to 3, further comprising, an interleaf module for supplying an interleaf member to the reel such that the interleaf member is capable of being disposed between adjacent layers of the product strip wound onto the reel.

Clause 5. The winding apparatus of clause 4, wherein the interleaf module comprises, a swing arm for directing a strip of the interleaf member from an interleaf source to the reel;

a tensioning roller for applying tension to the interleaf member, the tensioning roller being configured to translate from a disengaged position to an engaged position such that the tensioning roller is capable of contacting the strip of interleaf member when the interleaf member is disposed between the interleaf source and the reel;

wherein the tension applied is controllable by varying a supply of current and/or voltage to an electromagnetic brake that is coupled to the tensioning roller.

Clause 6. The winding apparatus of clause 4 or 5, further comprising, a first securing member dispenser configured to apply a first instance of a first securing member to a first end portion of the interleaf member to first-secure the first end portion of the interleaf member to a portion of the reel, and to apply a second instance of the first securing member to a second end portion of the interleaf member to end-secure the second end portion of the interleaf member to the reel, the second end portion being end-secured upon completion of winding of the product strip onto the reel by the first winding module part.

Clause 7. The winding apparatus of any one of clauses 1 to 6, further comprising, a first compartment disposed in relation to the first winding module part, said first compartment being configured to receive a first container for stacking one or more empty reels; and a first stack lifter disposed in relation to the first winding module part, said first stack lifter being configured for automatically moving a stack of one or more empty reels to provide an empty reel to be engaged by the first winding module part.

Clause 8. The winding apparatus of clause 7, wherein the first container is arranged to be transported on a first autonomous vehicle.

Clause 9. The winding apparatus of any one of clauses 2 to 8, further comprising, a second compartment disposed in relation to the second winding module part, said second compartment being configured to receive a second container for stacking one or more filled reels; and a second stack lifter disposed in relation to the second winding module part, said second stack lifter being configured for automatically moving a stack of one or more filled reels to receive a filled reel from the second winding module part.

Clause 10. The winding apparatus of clause 9, wherein the second container is arranged to be transported on a second autonomous vehicle.

Clause 11. The winding apparatus of any one of clauses 2 to 10, wherein the one or more end-packaging modules comprise, a cross-securing module for securing one or more edge portions of the reel in engagement with the second winding module part, said cross-securing module comprising, a second securing member dispenser for supplying a second securing member;

a pair of press rollers disposed such that the second securing member is positioned between the pair of press rollers and the reel, the pair of press rollers being configured to translate along a cross-securing path towards the reel to apply the second securing member over the one or more edge portions of the reel; and wherein the second winding module part is configured to rotate the reel by a pre-programmed angle about the longitudinal axis to facilitate one or more applications of the second securing member over the one or more edge portions of the reel.

Clause 12. A method of winding a product strip onto a reel, the method comprising, supplying the product strip to the reel using a feeder module;

engaging the reel using a first winding module part;

moving the reel along a first alignment path to align the reel in relation to the feeder module at an operative position for receiving the product strip, the reel also being aligned in a horizontal position that is normal to a vertical axis;

conveying the product strip for winding onto the reel using the feeder module, the product strip being within a vertical plane normal to the ground; and rotating the reel at the operative position about a longitudinal axis passing through the reel.

Clause 13. The method of clause 12, further comprising, engaging the reel in its horizontal position using a transfer module;

moving the reel along a transfer path to convey the reel from the first winding module part to a second winding module part disposed adjacent to the first winding module part;

moving the second winding module part along a second alignment path to engage the reel from the transfer module;

positioning the reel in relation to one or more end-packaging modules; and rotating the reel about the longitudinal axis to facilitate packaging of the reel.

Clause 14. The method of clause 12 or 13, further comprising, receiving the product strip from an external machine using an accumulator unit coupled to the feeder module;

holding a buffer length of the product strip using the accumulator unit; and varying a rate of supply of the product strip to the reel using the first winding module part and/or the feeder module based on the buffer length of the product strip in the accumulator unit.

Clause 15. The method of any one of clauses 12 to 14, further comprising, supplying an interleaf member to the reel using an interleaf module such that the interleaf member is disposed between adjacent layers of the product strip wound onto the reel.

Clause 16. The method of clause 15, wherein the step of supplying the interleaf member to the reel using the interleaf module comprises, directing a strip of the interleaf member from an interleaf source to the reel using a swing arm;

translating a tensioning roller from a disengaged position to an engaged position to apply tension to the interleaf member;

contacting the strip of interleaf member when the interleaf member is disposed between the interleaf source and the reel; and controlling the tension applied by varying a supply of current and/or voltage to an electromagnetic brake that is coupled to the tensioning roller.

Clause 17. The method of clause 15 or 16, further comprising, applying a first instance of a first securing member to a first end portion of the interleaf member to first-secure the first end portion of the interleaf member to a portion of the reel; and applying a second instance of the first securing member to a second end portion of the interleaf member for end-securing the second end portion of the interleaf to the reel, the second end portion being end-secured upon completion of winding of the product strip onto the reel.

Clause 18. The method of any one of clauses 12 to 17, further comprising, receiving a first container for stacking one or more empty reels in a first compartment disposed in relation to the first winding module part; and automatically moving a stack of one or more empty reels using a first stack lifter disposed in relation to the first winding module part to provide an empty reel to be engaged by the first winding module part.

Clause 19. The method of clause 18, further comprising transporting the first container on a first autonomous vehicle.

Clause 20. The method of any one of clauses 13 to 19, further comprising, receiving a second container for stacking one or more filled reels in a second compartment disposed in relation to the second winding module part; and automatically moving a stack of one or more filled reels using a second stack lifter disposed in relation to the second winding module part to receive a filled reel from the second winding module part.

Clause 21. The method of clause 20, further comprising transporting the second container on a second autonomous vehicle.

Clause 22. The method of any one of clauses 13 to 21, wherein the step of positioning the reel in relation to one or more end-packaging modules comprises, securing one or more edge portions of the reel in engagement with the second winding module part using a cross-securing module;

supplying a second securing member using a second securing member dispenser; positioning the second securing member between a pair of press rollers and the reel;

translating the pair of press rollers along a cross-securing path towards the reel to apply the second securing member over the one or more edge portions of the reel; and rotating the reel using the second winding module part by a pre-programmed angle about the longitudinal axis to facilitate one or more applications of the second securing member over the one or more edge portions of the reel.

Clause 23. A non-transitory tangible computer readable storage medium having stored thereon software instructions that, when executed by a computer processor of a winding apparatus, cause the computer processor to perform a method of winding a product strip onto a reel, by executing the steps comprising, supplying the product strip to the reel using a feeder module;

engaging the reel using a first winding module part;

moving the reel along a first alignment path to align the reel in relation to the feeder module at an operative position for receiving the product strip, the reel also being aligned in a horizontal position that is normal to a vertical axis;

conveying the product strip for winding onto the reel using the feeder module, the product strip being within a vertical plane normal to the ground; and rotating the reel at the operative position about a longitudinal axis passing through the reel.

The terms "coupled" or "connected" as used in this description are intended to cover both directly connected or connected through one or more intermediate means, unless otherwise stated.

The terms "configured to (perform a task/action)" and "configured for (performing a task/action)" as used in this description include being programmable, programmed, connectable, wired or otherwise constructed to have the ability to perform the task/action when arranged or installed as described herein. The terms "configured to (perform a task/action)" and "configured for (performing a task/action)" are intended to cover "when in use, the task/action is performed", e.g. specifically configured to, and/or arranged to do a task/action.

The terms "simultaneous", "simultaneously", "at the same time" and the like as used in the description are intended to not be limited to only performance of an action in the same time instance. The terms may also cover an action taken or a position taken such that a resultant action may be construed as being performed in the same time instance. For example, for a first end effector to engage a reel "at the same time" as a second end-effector, this may mean that the first end effector may engage the reel at a first point in time and wait until the second end-effector completes its engagement with the reel at another point in time. Thereafter, the reel may be construed as engaged with both the first and second end effectors "at the same time".

The description herein may be, in certain portions, explicitly or implicitly described as algorithms and/or functional operations that operate on data within a computer memory or an electronic circuit. These algorithmic descriptions and/or functional operations are usually used by those skilled in the information/data processing arts for efficient description. An algorithm is generally relating to a self-consistent sequence of steps leading to a desired result. The algorithmic steps can include physical manipulations of physical quantities, such as electrical, magnetic or optical signals capable of being stored, transmitted, transferred, combined, compared, and otherwise manipulated.

Further, unless specifically stated otherwise, and would ordinarily be apparent from the following, a person skilled in the art will appreciate that throughout the present specification, discussions utilizing terms such as "scanning", "calculating", "determining", "replacing", "generating", "initializing", "outputting", and the like, refer to action and processes of an instructing processor/computer system, or similar electronic circuit/device/component, that manipulates/processes and transforms data represented as physical quantities within the described system into other data similarly represented as physical quantities within the system or other information storage, transmission or display devices etc.

The description also discloses relevant device/apparatus for performing the steps of the described methods. Such apparatus may be specifically constructed for the purposes of the methods, or may comprise a general purpose computer/processor or other device selectively activated or reconfigured by a computer program stored in a storage member. The algorithms and displays described herein are not inherently related to any particular computer or other apparatus. It is understood that general purpose devices/machines may be used in accordance with the teachings herein. Alternatively, the construction of a specialized device/apparatus to perform the method steps may be desired.

In addition, it is submitted that the description also implicitly covers a computer program, in that it would be clear that the steps of the methods described herein may be put into effect by computer code. It will be appreciated that a large variety of programming languages and coding can be used to implement the teachings of the description herein. Moreover, the computer program if applicable is not limited to any particular control flow and can use different control flows without departing from the scope of the invention.

Furthermore, one or more of the steps of the computer program if applicable may be performed in parallel and/or sequentially. Such a computer program if applicable may be stored on any computer readable medium. The computer readable medium may include storage devices such as magnetic or optical disks, memory chips, or other storage devices suitable for interfacing with a suitable reader/general purpose computer. In such instances, the computer readable storage medium is non-transitory. Such storage medium also covers all computer-readable media e.g. medium that stores data only for short periods of time and/or only in the presence of power, such as register memory, processor cache and Random Access Memory (RAM) and the like. The computer readable medium may even include a wired medium such as exemplified in the Internet system, or wireless medium such as exemplified in bluetooth technology. The computer program when loaded and executed on a suitable reader effectively results in an apparatus that can implement the steps of the described methods.

The example embodiments may also be implemented as hardware modules. A module is a functional hardware unit designed for use with other components or modules. For example, a module may be implemented using digital or discrete electronic components, or it can form a portion of an entire electronic circuit such as an Application Specific Integrated Circuit (ASIC). A person skilled in the art will understand that the example embodiments can also be implemented as a combination of hardware and software modules.

Additionally, when describing some embodiments, the disclosure may have disclosed a method and/or process as a particular sequence of steps. However, unless otherwise required, it will be appreciated the method or process should not be limited to the particular sequence of steps disclosed. Other sequences of steps may be possible. The particular order of the steps disclosed herein should not be construed as undue limitations. Unless otherwise required, a method and/or process disclosed herein should not be limited to the steps being carried out in the order written. The sequence of steps may be varied and still remain within the scope of the disclosure.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. For an example, when "comprising" is used, reference to a "one" feature is also intended to be a reference to "at least one" of that feature. Terms such as "consisting", "consist", and the like, may, in the appropriate context, be considered as a subset of terms such as "comprising", "comprise", and the like. Therefore, in embodiments disclosed herein using the terms such as "comprising", "comprise", and the like, it will be appreciated that these embodiments provide teaching for corresponding embodiments using terms such as "consisting", "consist", and the like. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

Figure 10:
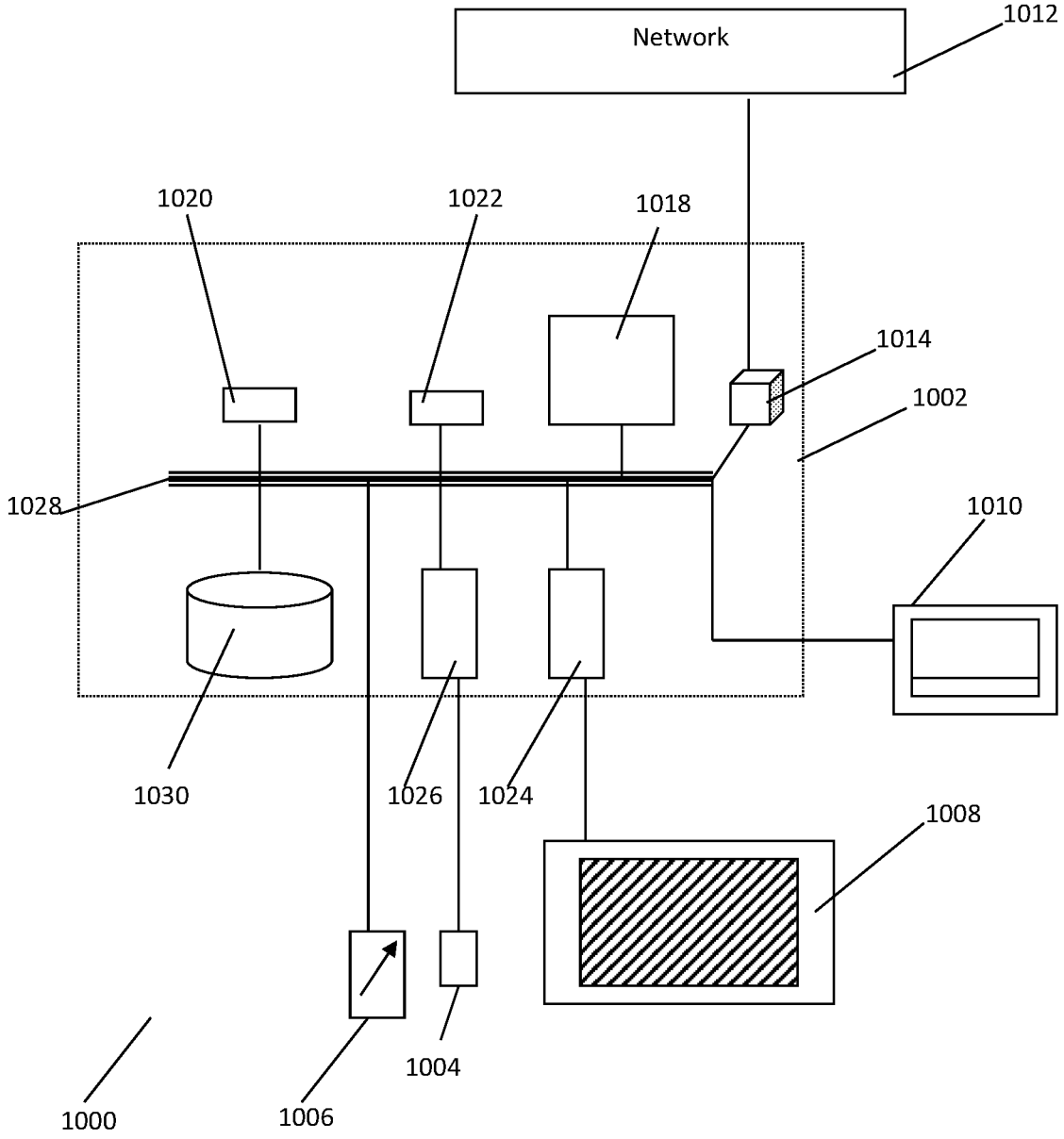
FIG. 10 is a schematic drawing of a computer system suitable for implementing an example embodiment.

Different example embodiments can be implemented in the context of data structure, program modules, program and computer instructions executed in a computer implemented environment. A general purpose computing environment is briefly disclosed herein. One or more example embodiments may be embodied in one or more computer systems, such as is schematically illustrated in FIG. 10.

One or more example embodiments may be implemented as software, such as a computer program being executed within a computer system 1000, and instructing the computer system 1000 to conduct a method of an example embodiment. In various embodiments, the computer system 1000 is specially configured to perform the method of winding a product strip onto a reel as disclosed herein.

The computer system 1000 comprises a computer unit 1002, input modules such as a keyboard 1004 and a pointing device 1006 and a plurality of output devices such as a display 1008, and printer 1010. A user can interact with the computer unit 1002 using the above devices. The pointing device can be implemented with a mouse, track ball, pen device or any similar device. One or more other input devices (not shown) such as a joystick, game pad, satellite dish, scanner, touch sensitive screen or the like can also be connected to the computer unit 1002. The display 1008 may include a cathode ray tube (CRT), liquid crystal display (LCD), field emission display (FED), plasma display or any other device that produces an image that is viewable by the user.

The computer unit 1002 can be connected to a computer network 1012 via a suitable transceiver device 1014, to enable access to e.g. the Internet or other network systems such as Local Area Network (LAN) or Wide Area Network (WAN) or a personal network. The network 1012 can comprise a server, a router, a network personal computer, a peer device or other common network node, a wireless telephone or wireless personal digital assistant. Networking environments may be found in offices, enterprise-wide computer networks and home computer systems etc. The transceiver device 1014 can be a modem/router unit located within or external to the computer unit 1002, and may be any type of modem/router such as a cable modem or a satellite modem.

It will be appreciated that network connections shown are exemplary and other ways of establishing a communications link between computers can be used. The existence of any of various protocols, such as TCP/IP, Frame Relay, Ethernet, FTP, HTTP and the like, is presumed, and the computer unit 1002 can be operated in a client-server configuration to permit a user to retrieve web pages from a web-based server. Furthermore, any of various web browsers can be used to display and manipulate data on web pages.

The computer unit 1002 in the example comprises a processor 1018, a Random Access Memory (RAM) 1020 and a Read Only Memory (ROM) 1022. The ROM 1022 can be a system memory storing basic input/output system (BIOS) information. The RAM 1020 can store one or more program modules such as operating systems, application programs and program data.

The computer unit 1002 further comprises a number of Input/Output (I/O) interface units, for example I/O interface unit 1024 to the display 1008, and I/O interface unit 1026 to the keyboard 1004. The components of the computer unit 1002 typically communicate and interface/couple connectedly via an interconnected system bus 1028 and in a manner known to the person skilled in the relevant art. The bus 1028 can be any of several types of bus structures including a memory bus or memory controller, a peripheral bus, and a local bus using any of a variety of bus architectures.

It will be appreciated that other devices can also be connected to the system bus 1028. For example, a universal serial bus (USB) interface can be used for coupling a video or digital camera to the system bus 1028. An IEEE 1394 interface may be used to couple additional devices to the computer unit 1002. Other manufacturer interfaces are also possible such as FireWire developed by Apple Computer and i.Link developed by Sony. Coupling of devices to the system bus 1028 can also be via a parallel port, a game port, a PCI board or any other interface used to couple an input device to a computer. It will also be appreciated that, while the components are not shown in the figure, sound/audio can be recorded and reproduced with a microphone and a speaker. A sound card may be used to couple a microphone and a speaker to the system bus 1028. It will be appreciated that several peripheral devices can be coupled to the system bus 1028 via alternative interfaces simultaneously.

An application program can be supplied to the user of the computer system 1000 being encoded/stored on a data storage medium such as a CD-ROM or flash memory carrier. The application program can be read using a corresponding data storage medium drive of a data storage device 1030. The data storage medium is not limited to being portable and can include instances of being embedded in the computer unit 1002. The data storage device 1030 can comprise a hard disk interface unit and/or a removable memory interface unit (both not shown in detail) respectively coupling a hard disk drive and/or a removable memory drive to the system bus 1028. This can enable reading/writing of data. Examples of removable memory drives include magnetic disk drives and optical disk drives. The drives and their associated computer-readable media, such as a floppy disk provide non-volatile storage of computer readable instructions, data structures, program modules and other data for the computer unit 1002. It will be appreciated that the computer unit 1002 may include several of such drives. Furthermore, the computer unit 1002 may include drives for interfacing with other types of computer readable media.

The application program is read and controlled in its execution by the processor 1018. Intermediate storage of program data may be accomplished using RAM 1020. The method(s) of the example embodiments can be implemented as computer readable instructions, computer executable components, or software modules. One or more software modules may alternatively be used. These can include an executable program, a data link library, a configuration file, a database, a graphical image, a binary data file, a text data file, an object file, a source code file, or the like. When one or more computer processors execute one or more of the software modules, the software modules interact to cause one or more computer systems to perform according to the teachings herein.

The operation of the computer unit 1002 can be controlled by a variety of different program modules. Examples of program modules are routines, programs, objects, components, data structures, libraries, etc. that perform particular tasks or implement particular abstract data types. The example embodiments may also be practiced with other computer system configurations, including handheld devices, multiprocessor systems, microprocessor-based or programmable consumer electronics, network PCs, minicomputers, mainframe computers, personal digital assistants, mobile telephones and the like. Furthermore, the example embodiments may also be practiced in distributed computing environments where tasks are performed by remote processing devices that are linked through a wireless or wired communications network. In a distributed computing environment, program modules may be located in both local and remote memory storage devices.

In example embodiments, the product strip is described as an elongated strip for winding onto the reel. However, it will be appreciated that the product strip is not limited as such and may include e.g. products arranged on any substrate that is capable of being wound onto a reel.

In example embodiments, an interleaf member e.g. interleaf paper is provided to act as a separation layer between adjacent layers of product strips wound onto a reel. However, it will be appreciated that such an interleaf member may be excluded in example embodiments such that only a product strip is wound onto a reel.

In described example embodiments, the motorised feed roller of the feeder module is described to break contact with the product strip 402 during a winding operation. However, it will be appreciated that the motorised feed roller of the feeder module may instead engage (i.e. contact) the product strip during a winding operation. For this alternative embodiment, the motorised feed roller is not powered and is allowed to be passive rotatable when the feed rollers are engaged. This may be applicable for some products that are more delicate or require more guidance, i.e. the feed rollers are engaged during a winding operation to provide additional guidance and support.

In example embodiments, the winding module is described to comprise a first winding module part for winding a product strip onto a reel and a second winding module part for facilitating end-packaging of the reel. However, it will be appreciated that the winding module is not limited as such. The winding apparatus may comprise only the first winding module part to perform engaging a reel for winding. The winding apparatus may also comprise a single winding module to perform both winding of the product strip onto the reel and facilitating end-packaging of the reel.

In example embodiments, a first winding module part is shown on the right-hand side of an apparatus and a second winding module part is shown on the left-hand side of the apparatus. However, it will be appreciated that positioning of the components on the left and right are arbitrary. Such positions may be swapped/reversed depending on user requirements.

In example embodiments, a first winding module part and a second winding module part are described exemplarily as disposed above a reel and are arranged to engage the reel via its top flange. A transfer module is described exemplarily as disposed below the reel and is arranged to engage the reel via its bottom flange. However, it will be appreciated that such orientation may be swapped/reversed e.g. such that the first and second winding module parts are disposed below the reel and are arranged to engage the reel via its bottom flange and the transfer module is disposed above the reel and is arranged to engage the reel via its top flange. As such, the described movements of the various modules are examples only.

In example embodiments, the first alignment path of the first winding module part and the second alignment path of the second winding module part are described as linear paths that are substantially parallel to the vertical axis of the winding apparatus. However, it will be appreciated that the first and second alignment paths are not limited as such, and may include a circular path, a linear path along other directions etc. For example, a first winding module part may translate in a circular path within a same plane to engage a reel and may translate in that circular path to align the reel in relation to a feeder module.

In example embodiments, a transfer path of a transfer module is described as a substantially horizontal path substantially parallel to the X-axis. However, it will be appreciated that the transfer path is not limited as such, and may include a circular path, a linear path along other directions etc. The transfer module is disposed for transferring a reel between a first winding module part and a second winding module part. For example, the transfer module may be disposed under the first winding module part and the second winding module part but such disposition is exemplary and may be modified. For another example, a transfer module may translate in a circular path within a same plane to engage a reel from first winding module part and may translate in that circular path to transfer the reel to a second winding module part.

In example embodiments, the reel is described to rotate in an anti-clockwise direction. However, it will be appreciated that such description is arbitrary, i.e. the reel may be rotated in any direction, clockwise or anticlockwise, depending on configuration.

In example embodiments, a product strip is described as being conveyed along a horizontal path from a feeder module to a reel. However, it will be appreciated that the product strip may be conveyed along e.g. a sloping path as long as a lateral-facing edge/side of the product strip (i.e. the product strip being in a vertical position) is able to sit/rest on an inner surface of a bottom flange of the reel during winding, without disengaging, e.g. falling off, from the reel.

In example embodiments, the container for stacking filled/empty reels is not limited to a trolley and may include autonomous vehicles which are capable of self-driving and parking.

In example embodiments, a first container is arranged to be transported on a first autonomous vehicle and a second container is arranged to be transported on a second autonomous vehicle. It will be appreciated that the first autonomous vehicle and second autonomous vehicle can be a same vehicle.

In example embodiments, a first securing member is described to be a double-sided tape capable for first-securing a starting portion and for end-securing an ending portion of an interleaf member. However, it will be appreciated the first securing member is not limited as such and may include other forms of adhesive such as liquid adhesive, compound, glue etc.

In example embodiments, a first securing member is described for first-securing a starting portion and for end-securing an ending portion of an interleaf member. However, it will be appreciated that in alternative embodiments, the first securing member may also be used for first-securing a starting portion of a product strip and for end-securing an ending portion of a product strip. That is, the first securing member may be used to anchor/secure a first starting portion of the product strip and/or interleaf member onto the reel (at the start of winding onto an empty reel), as well as used to secure a second ending portion of the product strip and/or interleaf member to prevent the wound product strip and/or interleaf member from unravelling/loosening from the reel (at the end of winding onto a filled reel).

In example embodiments, the motors for driving movement in various parts of the winding apparatus e.g. first and second winding module parts, feeder module, transfer module, cross-securing module etc. may each be a stepper motor, a DC motor, an AC motor, a servo motor, or the like.

In example embodiments, references are made to vertical and horizontal displacements. It will be appreciated that a reel placed in a horizontal position is considered as such and a product strip orientated in a vertical position is considered as such as long as the product strip in a non-horizontal position may be wound onto the reel without disengaging, e.g. falling off, from the reel.

In example embodiments, a processing module may control components and parameters of the winding apparatus. For example, the processing module may control the feeder module operations such as a rate of supply, threading length, feed angle of the product strip to the first winding module part etc. For example, the processing module may control the first and second winding modules operations such as a rotation speed of the engaged reel, actuation along the first and second alignment paths etc, engagement and release of a reel etc. The processing module may also monitor and coordinate operations of various components in the winding apparatus during a winding operation. For example, the processing module may coordinate feeding of the threading length of the product strip by the feeder module with rotation of the reel by the first winding module part, stopping supply of the product strip during a reel change and storing excess product strip in the accumulator unit, transferring a filled reel from the first winding module part to the second winding module part for end-packaging etc.

It will be appreciated by a person skilled in the art that other variations and/or modifications may be made to the specific embodiments without departing from the scope of the invention as broadly described. For example, in the description herein, features of different example embodiments may be mixed, combined, interchanged, incorporated, adopted, modified, included etc. or the like across different example embodiments. The present embodiments are, therefore, to be considered in all respects to be illustrative and not restrictive.

The invention claimed is:

1. A winding apparatus (200) for winding a product strip (202) onto a reel (204), characterised in that the winding apparatus (200) comprises, a feeder module (216) for supplying the product strip (202) to the reel (204);

a first winding module part (218) that is configured to engage the reel (204), the first winding module part (218) being further configured to move along a first alignment path to align the reel (204) in relation to the feeder module (216) at an operative position for receiving the product strip (202);

wherein the first winding module part (218) is configured to align the reel (204) in a horizontal position that is normal to a vertical axis of the winding apparatus (200) and the reel (204) is rotatable at the operative position about a longitudinal axis (212) passing through the reel (204);

wherein the feeder module (216) is arranged to convey the product strip (202) for winding onto the reel (204), the product strip (202) being within a vertical plane normal to the ground;

a second winding module part (220) disposed adjacent to the first winding module part (218), said second winding module part (220) being configured for rotating the reel (204) about the longitudinal axis (212) to facilitate packaging of the reel (204); and a transfer module (222) disposed for movement between the first winding module part (218) and the second winding module part (220);

wherein the transfer module (222) is configured to engage the reel (204) with the reel (204) in its horizontal position, and to move along a transfer path to convey the reel (204) from the first winding module part (218) to the second winding module part (220); and wherein the second winding module part (220) is configured to move along a second alignment path to engage the reel (204) from the transfer module (222) and to position the reel (204) in relation to one or more end-packaging modules.

2. The winding apparatus (200, 506) as claimed in claim 1, further comprising, an interleaf module (500) for supplying an interleaf member (502) to the reel (204, 504) such that the interleaf member (502) is capable of being disposed between adjacent layers of the product strip (202, 508) wound onto the reel (204, 504).

3. The winding apparatus (200, 506) as claimed in claim 2, further comprising, a swing arm (514) for directing a strip of the interleaf member (502, 630) from an interleaf source to the reel (204, 504, 604);

a tensioning roller (636) for applying tension to the interleaf member (502, 630), the tensioning roller (636) being configured to translate from a disengaged position (642) to an engaged position (644) such that the tensioning roller (636) is capable of contacting the strip of interleaf member (502, 630) when the interleaf member (502, 630) is disposed between the interleaf source and the reel (204, 504, 604);

wherein the tension applied is controllable by varying a supply of current and/or voltage to an electromagnetic brake that is coupled to the tensioning roller (636).

4. The winding apparatus (200, 300) as claimed in claim 1, further comprising, a first compartment (326) disposed in relation to the first winding module part (218, 310), said first compartment (326) being configured to receive a first container (330) for stacking one or more empty reels (204, 304); and a first stack lifter (334) disposed in relation to the first winding module part (218, 310), said first stack lifter (334) being configured for automatically moving a stack of one or more empty reels (204, 304) to provide an empty reel (204, 304) to be engaged by the first winding module part (218, 310).

5. The winding apparatus (200, 300) as claimed in claim 4, wherein the first container (330) is capable of transport on a first autonomous vehicle.

6. The winding apparatus (200, 300) as claimed in claim 1 further comprising, a second compartment (328) disposed in relation to the second winding module part (220, 312), said second compartment (328) being configured to receive a second container (332) for stacking one or more filled reels (204, 304); and a second stack lifter (336) disposed in relation to the second winding module part (220, 312), said second stack lifter (336) being configured for automatically moving a stack of one or more filled reels (204, 304) to receive a filled reel (204, 304) from the second winding module part (220, 312).

7. The winding apparatus (200, 300) as claimed in claim 6, wherein the second container (332) is capable of transport on a second autonomous vehicle.

8. The winding apparatus (200, 700) as claimed in claim 1, wherein the one or more end-packaging modules comprise, a cross-securing module (702) for securing one or more edge portions of the reel (204, 704) in engagement with the second winding module part (220, 706), said cross-securing module (702) comprising, a second securing member dispenser (708) for supplying a second securing member (710);

a pair of press rollers (712, 713) disposed such that the second securing member (710) is positioned between the pair of press rollers (712, 713) and the reel (204, 704), the pair of press rollers (712, 713) being configured to translate along a cross-securing path (714) towards the reel (204, 704) to apply the second securing member (710) over the one or more edge portions of the reel (204, 704); and wherein the second winding module part (220, 706) is configured to rotate the reel (204, 704) by a pre-programmed angle about the longitudinal axis (212) to facilitate one or more applications of the second securing member (710) over the one or more edge portions of the reel (204, 704).

9. A method of winding a product strip (202) onto a reel (204), characterised in that the method comprises, supplying the product strip (202) to the reel (204) using a feeder module (216);

engaging the reel (204) using a first winding module part (218);

moving the reel (204) along a first alignment path to align the reel (204) in relation to the feeder module (216) at an operative position for receiving the product strip (202), the reel (204) also being aligned in a horizontal position that is normal to a vertical axis;

conveying the product strip (202) for winding onto the reel (204) using the feeder module (216), the product strip (202) being within a vertical plane normal to the ground;

rotating the reel (204) at the operative position about a longitudinal axis (212) passing through the reel (204);

engaging the reel (204) in its horizontal position using a transfer module (222);

moving the reel (204) along a transfer path to convey the reel (204) from the first winding module part (218) to a second winding module part (220) disposed adjacent to the first winding module part (218);

moving the second winding module part (220) along a second alignment path to engage the reel (204) from the transfer module (222);

positioning the reel (204) in relation to one or more end-packaging modules; and rotating the reel (204) about the longitudinal axis (212) to facilitate packaging of the reel (204).

10. The method as claimed in claim 9, further comprising, supplying an interleaf member (502) to the reel (204, 504) using an interleaf module (500) such that the interleaf member (502) is disposed between adjacent layers of the product strip (202, 508) wound onto the reel (204, 504).

11. The method as claimed in claim 10, wherein the step of supplying the interleaf member (502) to the reel (204, 504, 604) using the interleaf module (500) comprises, directing a strip of the interleaf member (502, 630) from an interleaf source to the reel (204, 504, 604) using a swing arm (514);

translating a tensioning roller (636) from a disengaged position (642) to an engaged position (644) to apply tension to the interleaf member (502, 630);

contacting the strip of interleaf member (502, 630) when the interleaf member (502, 630) is disposed between the interleaf source and the reel (204, 504, 604); and controlling the tension applied by varying a supply of current and/or voltage to an electromagnetic brake that is coupled to the tensioning roller (636).

12. The method as claimed in claim 9, further comprising, receiving a first container (330) for stacking one or more empty reels (204, 304) in a first compartment (326) disposed in relation to the first winding module part (218, 310); and automatically moving a stack of one or more empty reels (204, 304) using a first stack lifter (334) disposed in relation to the first winding module part (218, 310) to provide an empty reel (204, 304) to be engaged by the first winding module part (218, 310).

13. The method as claimed in claim 12, further comprising transporting the first container (330) on a first autonomous vehicle.

14. The method as claimed in claim 9, further comprising, receiving a second container (332) for stacking one or more filled reels (204, 304) in a second compartment (328) disposed in relation to the second winding module part (220, 312); and automatically moving a stack of one or more filled reels (204, 304) using a second stack lifter (336) disposed in relation to the second winding module part (220, 312) to receive a filled reel (204, 304) from the second winding module part (220, 312).

15. The method as claimed in claim 14, further comprising transporting the second container (332) on a second autonomous vehicle.

16. The method as claimed in claim 9, wherein the step of positioning the reel (204, 704) in relation to one or more end-packaging modules comprises, securing one or more edge portions of the reel (204, 704) in engagement with the second winding module part (220, 706) using a cross-securing module (702);

supplying a second securing member (710) using a second securing member dispenser (708);

positioning the second securing member (710) between a pair of press rollers (712, 713) and the reel (204, 704);

translating the pair of press rollers (712, 713) along a cross-securing path (714) towards the reel (204, 704) to apply the second securing member (710) over the one or more edge portions of the reel (204, 704); and rotating the reel (204, 704) using the second winding module part (220, 706) by a pre-programmed angle about the longitudinal axis (212) to facilitate one or more applications of the second securing member (710) over the one or more edge portions of the reel (204, 704).

* * * * *